US005971825A

United States Patent [19]

Hattori

[11] Patent Number: 5,971,825

[45] Date of Patent: Oct. 26, 1999

[54] FABRICATION OF FIELD EMISSION ELEMENT WITH SHARP EMITTER TIP

[75] Inventor: Atsuo Hattori, Hamamatsu, Japan

[73] Assignee: Yamaha Corporation

[21] Appl. No.: 08/832,095

[22] Filed: Apr. 3, 1997

[30] Foreign Application Priority Data

| | | | |
|---|---|---|---|
| Apr. 3, 1996 | [JP] | Japan | 8-081808 |
| Apr. 3, 1996 | [JP] | Japan | 8-081809 |
| Apr. 3, 1996 | [JP] | Japan | 8-081810 |

[51] Int. Cl.[6] ..... H01J 9/04

[52] U.S. Cl. ..... 445/50; 445/24

[58] Field of Search ..... 445/50, 24

[56] References Cited

U.S. PATENT DOCUMENTS

| | | | |
|---|---|---|---|
| 5,141,459 | 8/1992 | Zimmerman | 445/24 |
| 5,203,731 | 4/1993 | Zimmerman | 445/24 |
| 5,334,908 | 8/1994 | Zimmerman | 313/336 |
| 5,529,524 | 6/1996 | Jones | 445/24 |
| 5,534,743 | 7/1996 | Jones et al. | 313/309 |
| 5,548,181 | 8/1996 | Jones | 313/309 |
| 5,561,339 | 10/1996 | Jones et al. | 313/309 |
| 5,587,623 | 12/1996 | Jones | 313/497 |
| 5,720,641 | 2/1998 | Hattori | 445/50 |
| 5,720,642 | 2/1998 | Hattori | 445/50 |
| 5,795,208 | 8/1998 | Hattori | 445/24 |

*Primary Examiner*—Sandra O'Shea
*Assistant Examiner*—Gene H. Rhodes
*Attorney, Agent, or Firm*—Ostrolenk, Faber, Gerb & Soffen, LLP

[57] ABSTRACT

A method of manufacturing a field emission element includes the steps of: forming an overhang portion on a substrate, the overhang portion having a cross section with confronting two parts; depositing a first sacrificial film on the overhang portion with the two parts, the first sacrificial film having a cross section with two parts; depositing a reaction control film on the first sacrificial film with the two parts, the first sacrificial film controlling chemical reaction of the first sacrificial film and having a cross section with two parts; chemically react the first sacrificial film so as to make the two parts of the first sacrificial film contact each other; depositing a field emission cathode film on the contacted area of the first sacrificial film; and exposing a tip of the field emission cathode film.

24 Claims, 60 Drawing Sheets

FABRICATION OF FIELD EMISSION ELEMENT WITH SHARP EMITTER TIP

BACKGROUND OF THE INVENTION a) Field of the Invention

The present invention relates to a manufacture method of a field emission element.

b) Description of the Related Art

A field emission element emits electrons from a sharp tip of an emitter by utilizing electric field concentration. For example, a flat panel display can be structured by using a field emitter array (FEA) having a number of emitters disposed on the array. Each emitter (or a group of emitters) controls one pixel of the display.

FIGS. 53A and 53B illustrate conventional manufacture methods of a field emission element.

As shown in FIG. 53A, on a substrate 101 having a recess with a vertical side, a sacrificial film 103 is deposited by a deposition method having good step coverage. At the corner between the vertical side and upper surface of the substrate 101, the sacrificial film 103 is deposited to have a cross section like a circle or ellipse so that a gentle slope is formed at this corner. The sacrificial film 103 deposited over the recess has an upward broadening taper shape. By regulating the shape of the recess and the deposition amount, a space with a sharp cusp can be formed.

An emitter electrode (cathode) film 105 is deposited by using this sacrificial film 103 as a mold. After the substrate 101 under the emitter and the sacrificial film 103 are removed, the emitter electrode 105 having a sharp tip can be formed. If the radius of curvature of the tip A of the emitter electrode 105 becomes large depending upon the recess shape and the deposition conditions of the sacrificial film, an electric field is hard to concentrate and the electrical performance is not good.

As shown in FIG. 53B, if a sacrificial film 103 is deposited thick by a deposition method having poor step coverage, two side wall parts in cross section of the sacrificial film 103 swell and become partially in unison. As an electrode film is deposited on this sacrificial film 103, an emitter electrode 105 having a relatively small apex angle of the emitter tip can be formed.

With this method, it is necessary to deposit the sacrificial film thick so that the tip of the emitter electrode is formed at an upper position above the substrate 101. If a field emission element having a gate electrode in addition to an emitter electrode to be formed, for example, a conductive film is formed on a substrate and a recess is formed in and through this conductive film. Therefore, this gate electrode is generally formed near at the boundary between the substrate 101 and the sacrificial film 103. With the method illustrated in FIG. 53B, the emitter electrode 105 is formed remotely from the gate electrode so that a high drive voltage of the field emission element is required and the electrical performance is lowered.

A large radius of curvature of the emitter electrode tip makes an electric field hard to concentrate, lowering the performance of the field emission element. A relative position of the emitter and gate electrodes greatly influences the performance of the field emission element.

SUMMARY OF THE INVENTION

It is an object of the present invention to provide a manufacture method of a field emission element having a field emission cathode (emitter) with a small apex angle and radius of curvature of the emitter tip.

It is another object of the present invention to provide a manufacture method of a field emission element having a field emission cathode, capable of positioning an emitter tip with high precision.

According to one aspect of the present invention, there is provided a method of manufacturing a field emission element, comprising: (a) forming an overhang portion on a substrate, the overhang portion having a cross section with confronting two parts; (b) depositing a first sacrificial film on the overhang portion with the two parts, the first sacrificial film being made of material capable of chemical reaction, having a cross section with two parts, and having a curved surface continuous from above the overhang portion to below the overhang portion; (c) depositing a reaction control film on the first sacrificial film thicker at an upper area of the first sacrificial film with the two parts than at a lower area of the first sacrificial film, the reaction control film having a cross section with two parts and controlling to decelerate chemical reaction of the first sacrificial film; (d) chemically reacting the first sacrificial film having the reaction control film to expand the volume of a lower region of the first sacrificial film more than an upper region thereof so as to make the two parts of the overhang portion contact each other; (e) depositing a field emission cathode film on the contacted area of the two parts; and (f) exposing a tip of the field emission cathode film.

The first sacrificial film and the reaction control film having a thickness distribution are deposited on the overhang portion having the two parts in cross section, and thereafter chemical reaction is executed to expand the volume of the first sacrificial film locally and in a limited region. The two parts of the overhang portion become in contact with each other by the volume expansion in the limited region. A sharp valley or cusp portion is formed at this contact area, the cusp portion having a cross section like two contacted circles or ellipses. By using this cusp portion as a mold, a field emission emitter having a small apex angle and radius of curvature of the emitter tip can be manufactured.

According to another aspect of the present invention, there is provided a method of manufacturing a field emission element, comprising: (a) forming an overhang portion on a substrate, the overhang portion having a cross section with confronting two parts; (b) depositing a first sacrificial film on the overhang portion with the two parts, the first sacrificial film being made of material capable of chemical reaction, having a cross section with two parts, and having a curved surface continuous from above the overhang portion to below the overhang portion; (c) depositing a reaction control film on the first sacrificial film thicker at an upper area of the first sacrificial film with the two parts than at a lower area of the first sacrificial film, the reaction control film having a cross section with two parts and controlling to decelerate chemical reaction of the first sacrificial film; (d) reacting the first sacrificial film having the reaction control film to expand the volume of a lower region of the first sacrificial film more than an upper region thereof; (e) depositing an insulating film on the overhang portion with the two parts and making the two parts of the overhang portion be contacted via the insulating film; (f) depositing a field emission cathode film on the contacted area of the two parts; and (g) exposing step of exposing a tip of the field emission cathode film.

The first sacrificial film and the reaction control film having a thickness distribution are deposited on the overhang portion having the two parts in cross section, and thereafter chemical reaction is executed to expand the volume of the first sacrificial film locally and in a limited region. Thereafter, the insulating film is deposited to fill the gap between the two parts of the overhang portion. A sharp valley or cusp portion is formed at this contact area, the cusp portion having a cross section like two contacted circles or ellipses. Since the insulating film is thin, the film can be formed at high precision. By using this cusp portion as a mold, a field emission emitter having a small apex angle and radius of curvature of the emitter tip can be manufactured.

A two-electrode structure may be incorporated in the field emission element, wherein: the first sacrificial film is made of semiconductor or conductive material; the step (d) performs chemically reacting only part of the first sacrificial film; the field emission cathode film is a field emission cathode made of conductive material; and the step (f) performs exposing a tip of the field emission cathode and an edge of an unreacted region of the first sacrificial film.

The relative position of the emitter electrode and gate electrode can be set precisely by a proper combination of process conditions of the step of depositing a first sacrificial film on the overhang portion with the two parts, the step of depositing a reaction control film having a thickness distribution, and the step of chemically reacting the first sacrificial film.

BRIEF DESCRIPTION OF THE DRAWINGS

FIG. 10A shows an emitter electrode having a needle-like tip, and FIG. 10B is a perspective view of an emitter electrode having a wedge-like tip extending in one direction.

FIG. 41A shows the shape of an one-stage type emitter, and FIG. 41B shows the shape of a multi-stage (two-stage) type emitter.

FIG. 42A shows the shape of an one-stage type emitter, and FIG. 42B shows the shape of a multi-stage (two-stage) type emitter.

FIG. 43A shows the shape of an one-stage type emitter, and FIG. 43B shows the shape of a multi-stage (two-stage) type emitter.

FIG. 44A shows the shape of an one-stage type emitter, and FIG. 44B shows the shape of a multi-stage (two-stage) type emitter.

FIG. 45A shows the shape of an one-stage type emitter, and FIG. 45B shows the shape of a multi-stage (two-stage) type emitter.

FIG. 46A shows the shape of an one-stage type emitter, and FIG. 46B shows the shape of a multi-stage (two-stage) type emitter.

FIG. 47A shows the shape of an one-stage type emitter, and FIG. 47B shows the shape of a multi-stage (two-stage) type emitter.

FIG. 48A shows the shape of an one-stage type emitter, and FIG. 48B shows the shape of a multi-stage (two-stage) type emitter.

FIG. 49A shows the shape of an one-stage type emitter, and FIG. 49B shows the shape of a multi-stage (two-stage) type emitter.

DETAILED DESCRIPTION OF THE PREFERRED EMBODIMENTS

FIGS. 1A to 1H are diagrams illustrating the manufacture steps of a field emission element according to the first embodiment of the invention. In the following, the manufacture steps of an emitter (cathode) constituting a field emission element will be described.

Figure 1A:
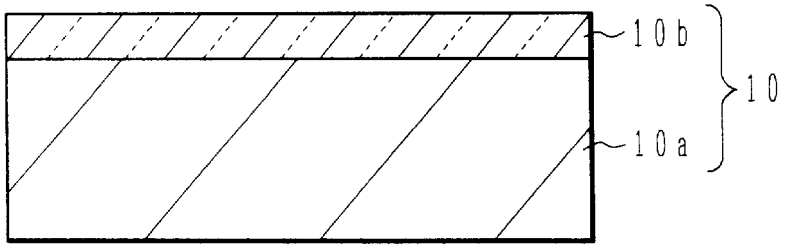
FIGS. 1A to 1H are diagrams illustrating the manufacture steps of a field emission element according to a first embodiment of the invention.

As shown in FIG. 1A, a substrate 10 is structured by a starting substrate 10*a* and a lamination film 10*b* of about 140 nm thick stacked upon the starting substrate 10*a*. For example, the starting substrate 10*a* is made of an Si substrate having a thickness of several tens to several hundreds $\mu$m, and the lamination film 10*b* is made of $SiN_x$. Although silicon nitride has stoichiometry of $Si_3N_4$, a silicon nitride film deposited by CVD or the like has different stoichiometry shifted from $Si_3N_4$. This shift amount may be changed and such silicon nitride is expressed by $SiN_x$. This is also applied to aluminum nitride.

The lamination film 10*b* may be made of $SiO_2$ instead of $SiN_x$. The starting substrate 10*a* may be made of Al. If Al is used, the lamination film 10*b* is made of $AlN_x$, $Al_2O_3$, or the like. In the following, it is assumed that the starting substrate 10*a* is made of Si and the lamination film 10*b* is made of $SiN_x$.

A resist film having a predetermined pattern is formed on the lamination film 10*b*. By using the resist pattern as a mask, the lamination film 10*b* is selectively etched to form a hole 12 shown in FIG. 1B in the lamination film 10*b* so that a surface of the starting substrate 10*a* is exposed from an aperture of the hole 12. A lamination film 10*c* having two opposing parts in cross section is therefore formed. The two parts in cross section are the right side lamination film 10*c* and the left side lamination film 10*c* as viewed in the cross section of FIG. 1B. These two parts are continuous in plan view. The above selective etching is performed by reactive ion etching (RIE) using $SF_6$ containing etching gas. The hole 12 has a diameter of about 0.5 $\mu$m and a depth of about 140 nm.

Figure 1B:
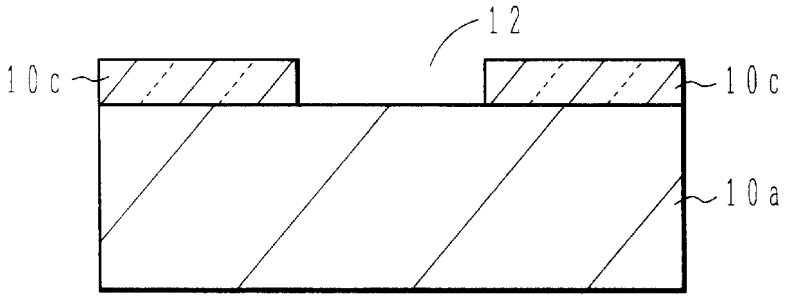
Figure 1C:
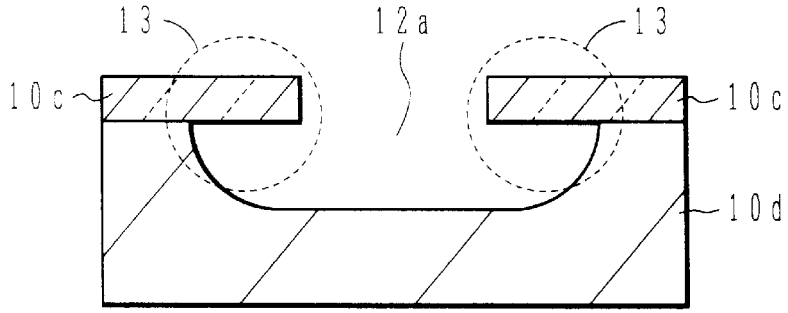

As shown in FIG. 1C, by using the lamination film 10*c* as an etching mask, the starting substrate 10*a* is wet etched to form a hole 12*a* in the starting substrate. A substrate 10*d* is therefore formed. The hole 12*a* forms a hollow space and has a diameter of about 1.5 $\mu$m and a depth of about 0.5 $\mu$m. Isotropical wet etching is performed through the hole 12 to etch the starting substrate 10*a* not only along the vertical direction of the substrate 10*a* but also along the horizontal direction in the cross-section of the starting substrate 10*a*. Therefore, the starting substrate 10*a* is etched partially at the underneath of the lamination film 10*c*. The lamination film 10*c* extends like a hood near at the hole 12*a*. As shown in FIG. 1C, an overhang portion 13 is therefore formed having two opposing parts in cross section separated along the horizontal direction of the substrate. The two opposing parts in section are called hereinafter simply "two parts".

Figure 1D:
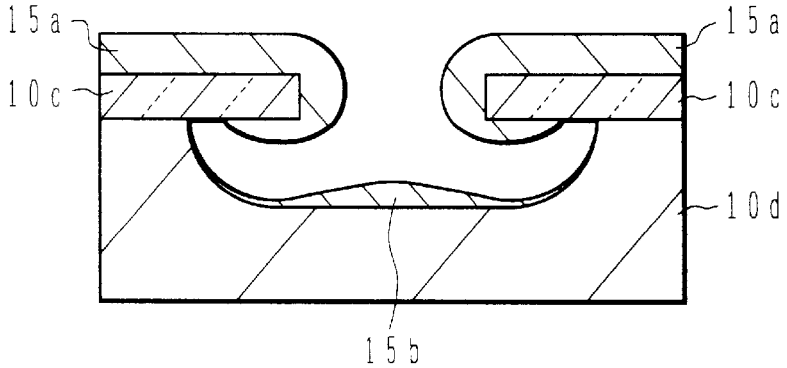

As shown in FIG. 1D, a first sacrificial film 15*a* made of, for example, polysilicon is deposited by CVD on the lamination film 10*c* with two parts. Conformability and the like of a polysilicon film formed by CVD can be controlled by a pressure, a substrate temperature, and the like during deposition. Either atmospheric pressure CVD or low pressure CVD may be used. At the same time, a first sacrificial film 15*b* is also deposited through an opening on the substrate 10*d* at the bottom of the hole 12*a*.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used instead of CVD. For example, the first sacrificial films 15*a* and 15*b* of amorphous silicon may be formed by a DC sputtering system using, as a target, polysilicon which contains P or B. For example, sputtering is performed under the conditions of a power of 1 kW and an Ar gas pressure of 8 mTorr.

As the first sacrificial film 15*a* continues to grow, the two parts contact to be unison at the opening and above the lamination film 10*c*. In this embodiment, deposition of the first sacrificial film 15 is stopped while the two parts still have a sufficient gap therebetween.

Figure 1E:
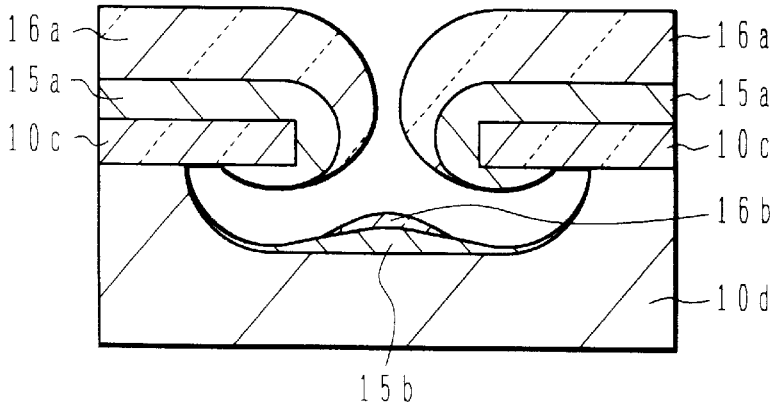

Next, as shown in FIG. 1E, second sacrificial films 16*a* and 16*b* made of, for example, $SiO_2$, are anisotropically deposited on the first sacrificial films 15*a* and 15*b* by CVD or sputtering. Sputtering is a deposition method having anisotropy. Directivity may be controlled. CVD with chemical reaction of two or more gases has the characteristics that material is difficult to be deposited on the bottom of a deep recess. Directivity may be controlled by a pressure, a temperature or the like. The second sacrificial film 16*a* is deposited generally uniformly in thickness on the first sacrificial film 15*a* constituted of the two parts. The side wall of the two parts is thick at the upper area, and gradually reduces its thickness at the lower area. The bottom area of the overhang portion of the two parts is not deposited or very thinly deposited with the second sacrificial film 16*a*. The second sacrificial film 16*b* is deposited on the first sacrificial film 15*b*.

$SiO_2$ is deposited by plasma CVD, for example, under the conditions of a temperature of 415° C., a power of 290 W, a pressure of 1.5 Torr, and flow rates of 100 sccm of $SiH_4$, 500 sccm of $N_2O$, and 500 sccm of $N_2$.

The second sacrificial films 16*a* and 16*b* may be made of $Al_2O_3$, $Ta_2O_5$, $MoO_x$, or $TiO_2$, in addition to $SiO_2$.

Next, wet oxidation is performed to expand the volume of the overhang portion constituted of the two parts. The second sacrificial film 16*a* made of $SiO_2$ functions to limit the amount of oxidant (oxygen or the like) supplied from the surface of the second sacrificial film 16*a* to the surface of the first sacrificial film 15*a* made of Si. The amount of oxidant supplied to the overhang portion of the first sacrificial film 15*a* is small at the area where the second sacrificial film is thick, and large at the area where the second sacrificial film is thin. At the side of the second sacrificial film 16*a* having a thickness distribution, oxidation reaction progresses more at the lower area than at the upper area. Therefore, volume expansion is large at the lower side and the lower side of the two parts becomes in unison faster than at the upper side. The reacted first sacrificial film 15*a* is silicon oxide. The deposited second sacrificial film 16*a* and reacted first sacrificial film 15*a* are collectively called a reacted film 16*c*.

Figure 1F:
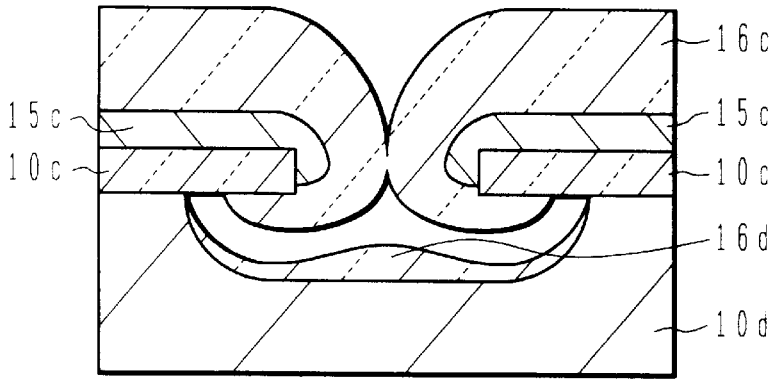

As shown in FIG. 1F, the two parts at each side of the overhang portion contact each other at the lower side of the volume expanded reacted film 16*c*. A reacted film 16*d* is formed on the substrate 10*d*. A first sacrificial film 15*c* is a left portion of the first sacrificial film 15*a* not oxidized, and is made of, for example, polysilicon.

After the wet oxidation, if the chemical reaction is stopped immediately after the two parts in cross section of the overhang portion contact each other, a cusp portion having an acute angle can be formed at the contact area as shown in FIG. 1F. This cusp portion has an acute angle area having a cross section like two contacted circles or ellipses. If oxidation continues after the opening is closed, the contact point of the two parts of the sacrificial film gradually moves up. However, since the upper side is formed with the thick second sacrificial film, the range of the contact point moving upward is limited. Even with this change of the contact point position, the apex angle at the contact area maintains an acute angle. By using this cusp portion as a mold, an emitter electrode is formed.

For example, wet oxidation is performed by using a vertical furnace under the conditions of a furnace temperature of 850° C., a supply of $H_2$ gas at 30000 cc/min, and a supply of $O_2$ gas at 20000 cc/min.

Figure 1G:
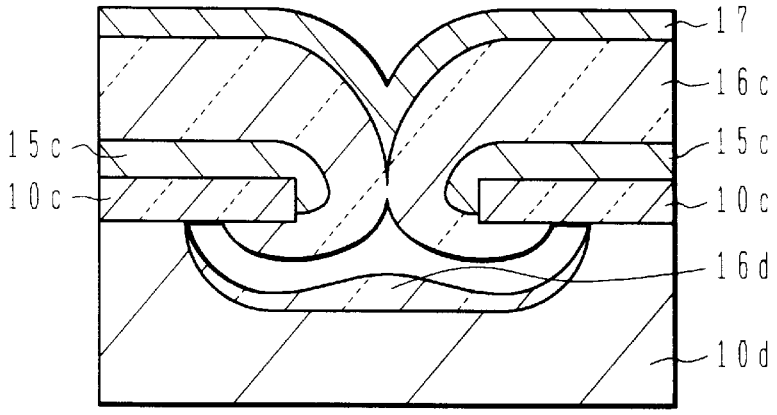

As shown in FIG. 1G, an emitter electrode 17 made of, for example, TiN is deposited on the reacted film 16*c* about 0.2 μm by reactive sputtering. For example, the reactive sputtering is performed by using a DC sputtering system under the conditions of a power of 5 kW, a pressure of 4 mTorr, a target of Ti, a supply of $N_2$ gas at 84 sccm, and a supply of Ar gas at 56 sccm. The emitter electrode 17 may be made of Mo, Cr, Ti, or W, instead of TiN. CVD instead of sputtering may be used.

Since the contact point of the reacted film 16*c* is formed at the lower side, the tip of the emitter electrode 17 is formed at the surface level of the lamination film 10*c*.

Figure 1H:
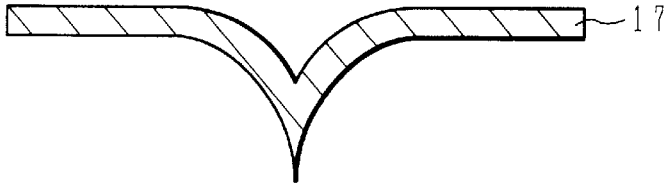

The substrate 10*d* is wet etched by $HF+HNO_3+H_2O$, and thereafter the reacted film 16*c* is wet etched by $HF+NH_4F$ to expose the tip of the emitter electrode as shown in FIG. 1H.

It can be predicted that the tip of the emitter electrode 17 has a projection of 0.3 to 0.8 μm high, an apex angle of about 20° and a radius of curvature of about 10 nm. With the manufacture method described above, the radius of curvature and apex angle of the tip of the emitter electrode 17 can be made small so that an electric field concentrates easily at the tip of the emitter electrode.

Figure 2A:
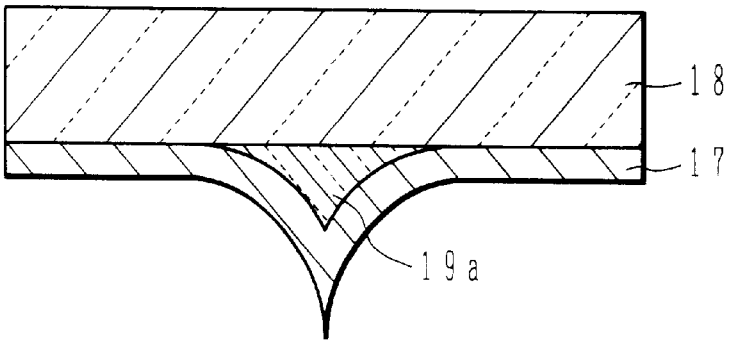
FIGS. 2A to 2C are diagrams illustrating three methods of reinforcing an emitter electrode with a support substrate.
Figure 2B:
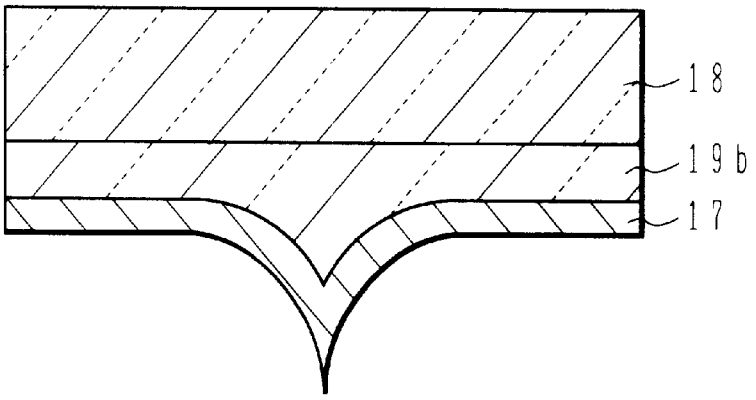
Figure 2C:
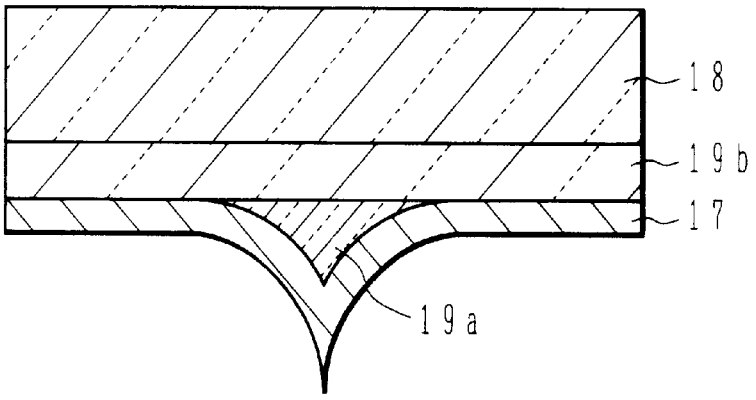

FIGS. 2A to 2C are diagrams illustrating three methods of reinforcing an emitter electrode 17 with a support substrate 18. Since the emitter electrode 17 is as thin as about 0.2 μm, it is desired to reinforce the emitter electrode 17 with the support substrate 18.

FIG. 2A illustrates the first method. After the field emission element shown in FIG. 1G is manufactured, the bottom recess of the emitter electrode 17 is filled with a planarizing film 19*a* of, for example, an SOG film. Thereafter, the planarizing film 19*a* is abraded by chemical mechanical polishing (CMP) or by etch-back to planarize the bottom surface of the emitter electrode 17. The planarizing film 19*a* may be formed by reflowing PSG or BPSG instead of using the SOG film.

Next, a support substrate 18 is adhered to the emitter electrode 17. The support substrate 18 is made of, for example, glass, quartz, or $Al_2O_3$. Thereafter, the wet etching process illustrated in FIG. 1H is performed to expose the tip of the emitter electrode 17.

FIG. 2B illustrates the second method. Adhesive 19*b* such as low melting point glass is reflowed on the emitter electrode in the state shown in FIG. 1G to adhere the emitter electrode 17 and a support substrate 18 together. The adhesive 19*b* also serves to planarize the bottom surface of the emitter electrode 17.

In place of the low melting point glass, Al may be used as the adhesive 19*b*. In this case, the emitter electrode 17 and support substrate 18 may be adhered by anodic bonding using electrostatic forces generated upon application of a high voltage of 1 kV and maintaining the temperature at 400 to 500° C. If Al is used as the adhesive 19*b*, the adhesive 19*b* may be used as an emitter wiring. Thereafter, similar to the process shown in FIG. 1H, the tip of the emitter electrode is exposed by wet etching.

FIG. 2C illustrates the third method. After the process shown in FIG. 1G, the bottom recess of the emitter electrode 17 is filled with a planarizing film 19*a* made of, for example, W. In this case, if the emitter electrode 17 made of TiN is made as thin as 0.1 to 0.05 μm, a void can be suppressed from being formed in the emitter tip. TiN serves as an adhesive layer when W is-deposited by CVD. Since the strength of the emitter electrode is reinforced by W, the emitter electrode can be made thin. Thereafter, the planarizing film 19*a* is etched back to planarize the bottom surface of the emitter electrode 17. A support substrate 18 is adhered to the emitter electrode 17 by using adhesive 19*b* such as Al. Thereafter, similar to the process shown in FIG. 1H, the tip of the emitter is exposed by wet etching.

In this embodiment, the process of forming the second sacrificial film 16*a* shown in FIG. 1E is important for determining the shape of the emitter electrode. The second sacrificial film 16*a* has a function of a reaction control film. The second sacrificial film 16*a* may be formed by the following method.

Figure 3A:
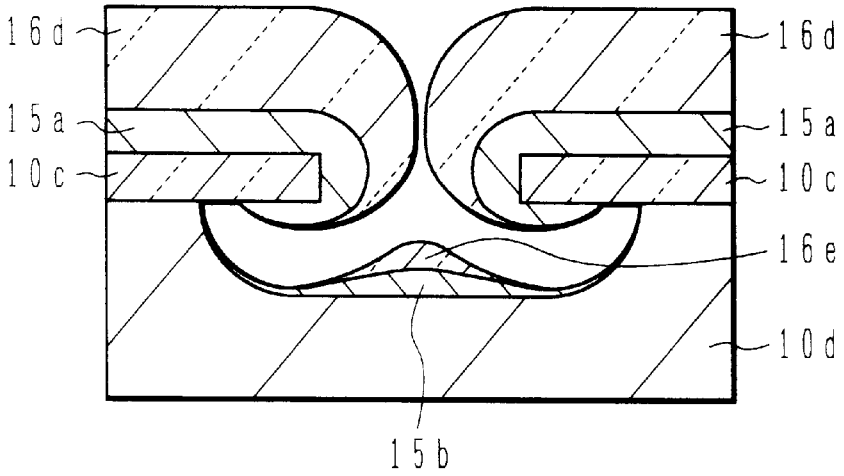
FIGS. 3A and 3B are diagrams illustrating another method of forming a second sacrificial film.
Figure 3B:
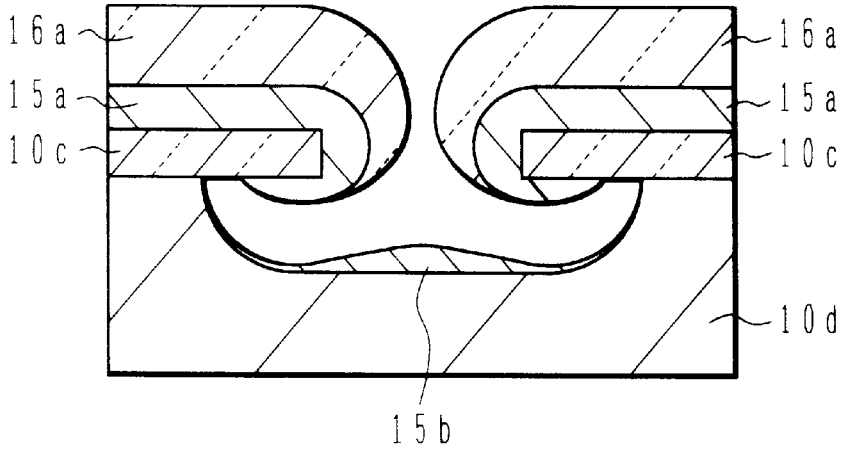

FIGS. 3A and 3B are diagrams illustrating another method of forming the second sacrificial film.

After the process illustrated in FIG. 1D, second sacrificial films 16*d* and 16*e* are deposited thick by CVD or the like, as shown in FIG. 3A. The second sacrificial film 16*d* is controlled to have two parts. The side wall of the two parts of the second sacrificial film 16*d* is made thick at the upper area near the opening, and gradually reduces its thickness at the lower area.

Next, the surface of the second sacrificial film 16*d* is etched by a uniform amount by isotropic wet etching. Therefore, as shown in FIG. 3B, a desired thickness distribution of the second sacrificial film 16*a* can be obtained. The bottom area of the overhang portion of the second sacrificial film 16*a* can be made thin. Thereafter, the processes starting from FIG. 1F are executed.

In the process illustrated in FIG. 1F, the reacted films 16*c* and 16*d* are formed by wet oxidation. Instead of wet oxidation, these reacted films may be formed by nitridation.

For example, nitridation is performed under the conditions of a temperature of 1050° C., an RF power of 10 kW, a pressure of 130 Pa, and a supply of $NH_3$ at 1 slm. Other reactions capable of increasing the volume may also be used.

The emitter electrode manufacture methods have been described so far. Next, a method of manufacturing another type of a field emission element of a two-electrode element (so-called diode) will be described. The two-electrode element has a structure of two electrodes, emitter and gate.

Figure 4:
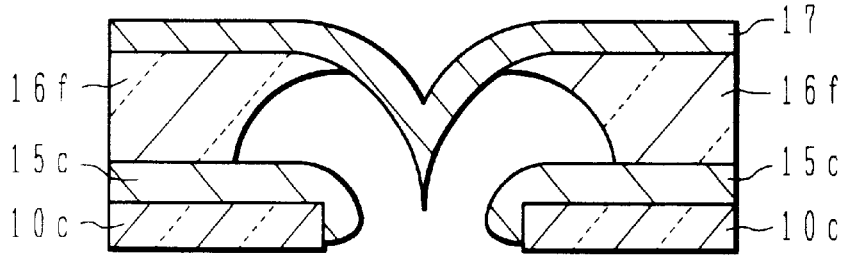
FIG. 4 is a diagram illustrating the manufacture steps of a two-electrode field emission element.

FIG. 4 is a diagram illustrate the method of manufacturing a two-electrode element. First, an element shown in FIG. 1G is formed by the above described processes. Thereafter, the substrate 10*d*, reacted film 16*d*, and part of the reacted film 16*c* are etched. By partially removing the reacted film 16*c* and leaving the reacted film 16*f* unetched as shown in FIG. 4, the tip of the emitter electrode 17 is exposed.

If the first sacrificial film 15*c* is made of conductive polysilicon or amorphous silicon, the first sacrificial film 15*c*, which is unreacted, can be used as a gate electrode. The two-electrode element has two electrodes—the emitter electrode (field emission cathode) 17 and gate electrode (control electrode) 15*c*. The reacted film 16*f* electrically isolates the emitter electrode 17 and gate electrode 15*c*. The lamination film 10*c* may be removed by etching.

A relative position of the emitter electrode 17 and gate electrode 15*c* plays an important role of a two-electrode element. A shorter distance between the emitter electrode 17 and gate electrode 15*c* is principally better. It is therefore desired to position the tip of the emitter electrode 17 near at a straight line interconnecting the two parts of the gate electrodes 15*c*.

Figure 5A:
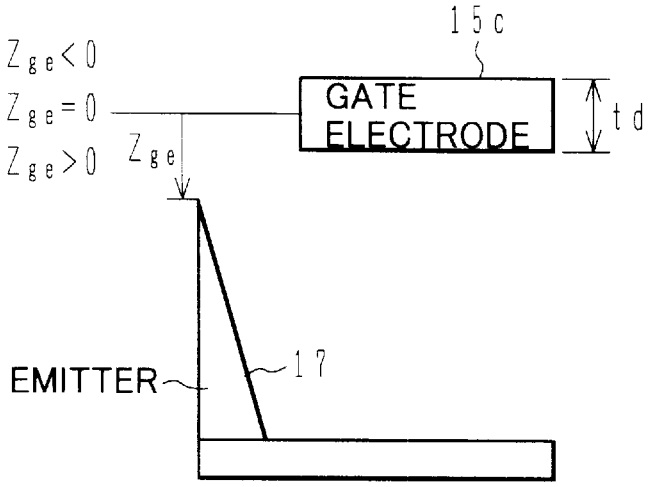
FIG. 5A is a schematic diagram showing a relative position of emitter and gate electrodes.

FIG. 5A is a schematic diagram showing the relative position of the gate electrode 15*c* and emitter electrode 17. The relative position is turned upside down from that shown in FIG. 4. A distance Zge is a distance from the tip of the emitter electrode 17 to the center of a thickness td of the gate electrode 15*c*, along an electron emission direction.

Figure 5B:
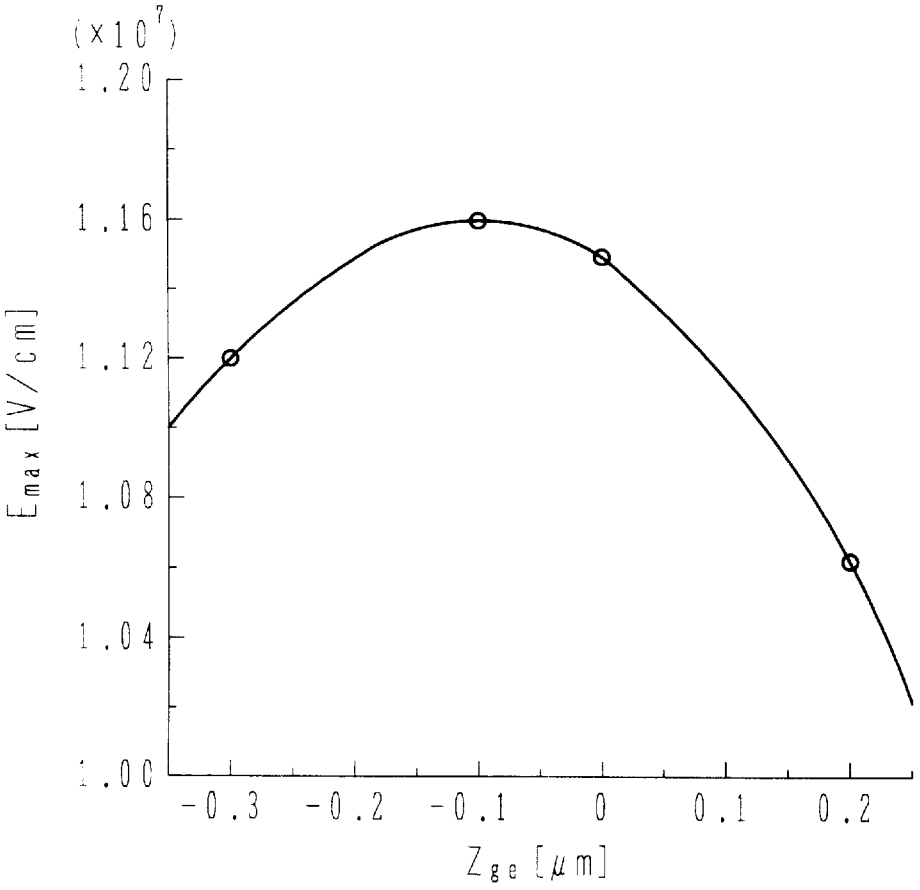
FIG. 5B is a graph showing a relationship between a distance between emitter and gate electrodes and a maximum field intensity.

FIG. 5B is a graph showing a relationship between the distance Zge and a maximum field intensity Emax at the tip of the emitter electrode, with the thickness td of the gate electrode 15*c* being fixed to 0.4 $\mu$m. The abscissa represents the distance Zge, and the ordinate represents the maximum field intensity Emax of the tip of the emitter electrode 17.

This graph shows a change in the maximum field intensity Emax of the emitter electrode as the distance Zge between the emitter and gate electrodes is changed from—0.35 $\mu$m to 0.25 $\mu$m. The larger the maximum field intensity Emax, the more the electric field concentrates on the tip of the emitter electrode and the more the performance of the field emission element is improved. At the distance Zge of—0.1 $\mu$m, the maximum field intensity Emax takes an extreme value of $1.16\times10^7$ V/cm. Namely, the optimum position of the tip of the emitter electrode 17 is slightly higher in FIG. 5A (slightly lower in FIG. 4) than the center of the thickness of the gate electrode.

According to this embodiment, after the first and second sacrificial films are formed, oxidation or nitridation is performed to expand the volume. The position of the tip of the emitter electrode 17 can be controlled precisely from the following reasons.

A film formed by CVD becomes thick approximately proportional to time. In contrast, a film formed by chemical reaction such as oxidation becomes thick approximately proportional to a square root of time. In other words, the film thickness tends to saturate as the time lapses. With oxidation or the like, the film thickness can be controlled more finely and the tip position of the emitter electrode can be controlled more precisely, the more the time lapses. Furthermore, a film having a better uniform quality can be formed by oxidation than CVD.

Furthermore, a reaction speed can be regulated by adjusting the thickness of the second sacrificial film 16*a* deposited on the first sacrificial film 15*a*. The thicker the second sacrificial film 16*a*, the slower the reaction speed of the first sacrificial film 15*a*. If the second sacrificial film 16*a* is made thin at the lower side of the overhang portion constituted of the two parts, the reaction at this area can be enhanced.

The two-electrode element uses the emitter electrode 17 as a cathode and the gate electrode 15*c* as a control electrode. If the tip of the emitter electrode 17 is set to a proper position by controlling the reaction of the first sacrificial film 15*a* by the second sacrificial film 16*a*, electrons can be easily emitted from the tip of the emitter electrode 17 even at a low control voltage applied to the gate electrode.

The two-electrode element has the emitter electrode 17 with a small apex angle and radius of curvature of the tip so that the performance of the field emission element can be improved.

Figure 6A:
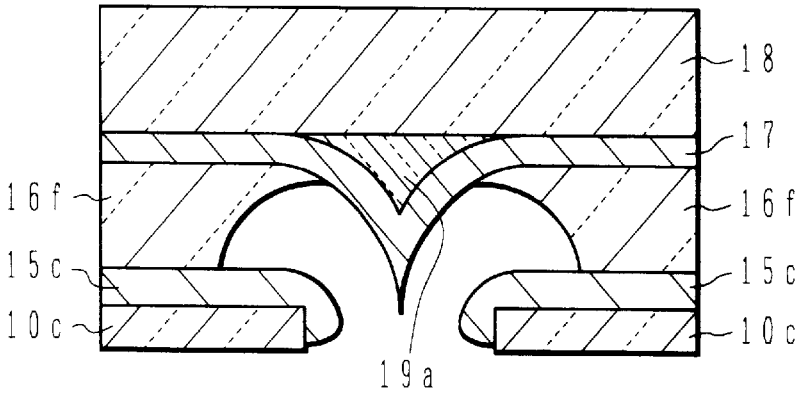
FIGS. 6A to 6C are diagrams illustrating three methods of reinforcing a two-electrode field emission element with a support substrate.
Figure 6B:
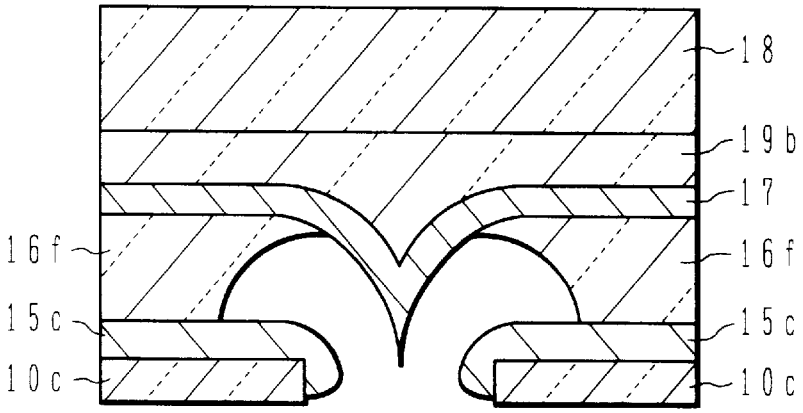
Figure 6C:
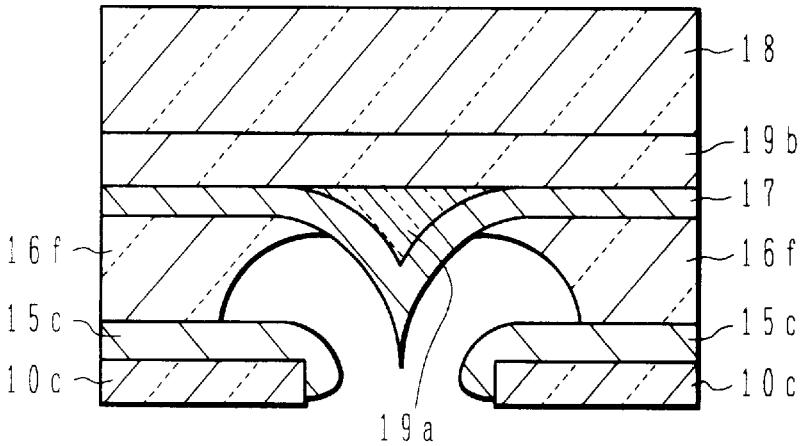

FIGS. 6A to 6C are diagrams illustrating three methods of reinforcing a two-electrode element with a support substrate 18.

FIG. 6A illustrates the first method. A bottom recess of the emitter electrode 17 is filled with a planarizing film 19*a* of, for example, an SOG film, a PSG film, or a BPSG film. Thereafter, the planarizing film 19*a* is etched back by CMP to planarize the bottom surface of the emitter electrode 17. Next, a support substrate 18 is adhered to the emitter electrode 17. The support substrate 18 is made of, for example, glass, quartz, or $Al_2O_3$.

FIG. 6B illustrates the second method. Adhesive 19*b* such as low melting point glass is reflowed on the emitter electrode 17 to planarize the bottom surface of the emitter and adhere the emitter electrode 17 and a support substrate 18 together. Al may be used as the adhesive 19*b* to anodically bond the emitter electrode 17 and support substrate 18.

FIG. 6C illustrates the third method. The bottom recess of the emitter electrode is filled with a planarizing film 19*a* made of, for example, W. Thereafter, the planarizing film 19*a* is etched back to planarize the bottom surface of the emitter electrode 17. A support substrate 18 is adhered to the emitter electrode 17 by using adhesive 19*b* such as Al.

Figure 7:
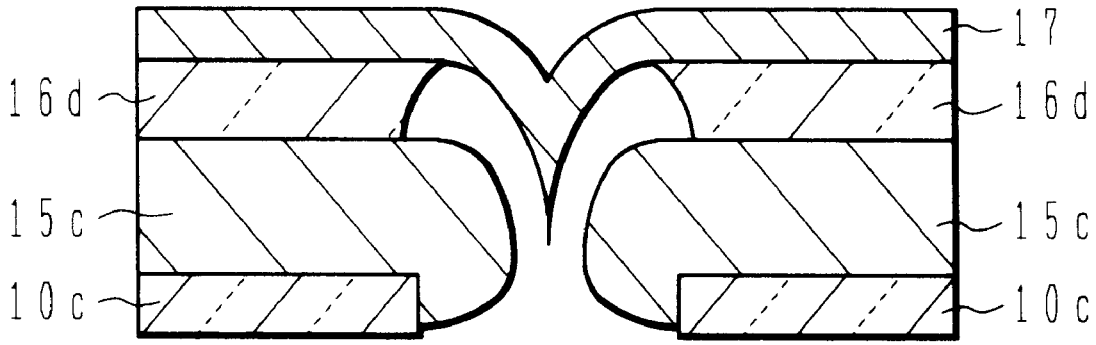
FIG. 7 is a diagram showing another example of a field emission element.

FIG. 7 is a diagram illustrating another method of manufacturing a two-electrode element. This two-electrode element has a gate electrode (first sacrificial film) 15*c* thicker than that of the two-electrode element shown in FIG. 4. The first sacrificial film is deposited thick and the second sacrificial film is deposited thin, by CVD or the like. Thereafter, oxidation is performed.

As the first sacrificial film is deposited thick, the gap between the two parts constituting the overhang portion becomes considerably small. Therefore, even slight oxidation can make the two parts of the overhang portion in contact with each other. Since the first sacrificial film is oxidized only a little, the first sacrificial film not oxidized, i.e., the gate electrode 15*c*, becomes thick and the side projection thereof becomes large. The distance (gate hole) between the two parts constituting the gate electrode becomes small. Accordingly, electrons can be easily emitted from the tip of the emitter electrode even at a low gate-emitter control voltage. Similar advantages are also obtained by a three-electrode element to be described later.

In order to make the first sacrificial film thick, the sacrificial film 15*a* shown in FIG. 1D is anisotropically deposited on the lamination film 10*c*. By anisotropically depositing the first sacrificial film 15*a*, it becomes possible to make the upper area of the overhang portion thick and the lower area relatively thin. If the first sacrificial film is isotropically deposited, the first sacrificial film 15*a* deposited at the overhang portion becomes likely to be made in contact with the first sacrificial film deposited on the substrate 10*d*. It is therefore difficult to form the first sacrificial film 15*a* constituted of the two parts.

If the gate electrode 15*c* is made thick, the tip of the emitter electrode can be positioned further to the center of the thickness of the gate electrode, or at the level lower than the center of the thickness.

The manufacture method of a two-electrode element has been described. Next, a manufacture method of another type of a field emission element of a three-electrode element will be described.

Figure 8A:
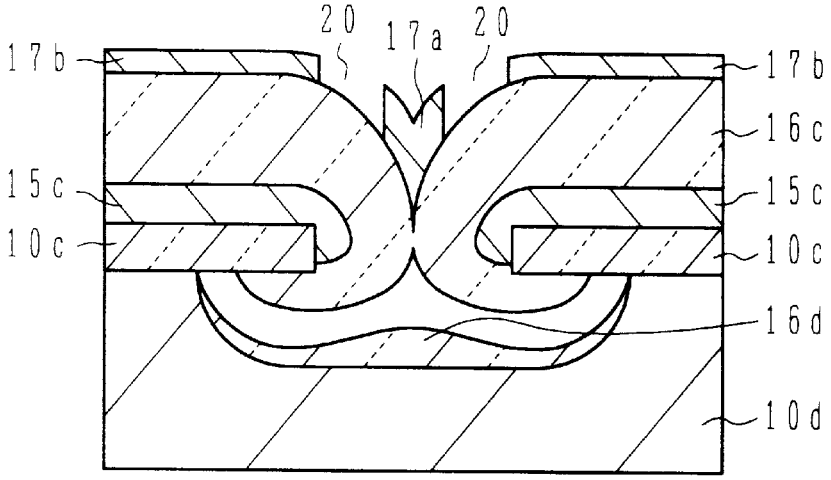
FIGS. 8A and 8B are diagrams illustrating the manufacture steps of a three-electrode field emission element.
Figure 8B:
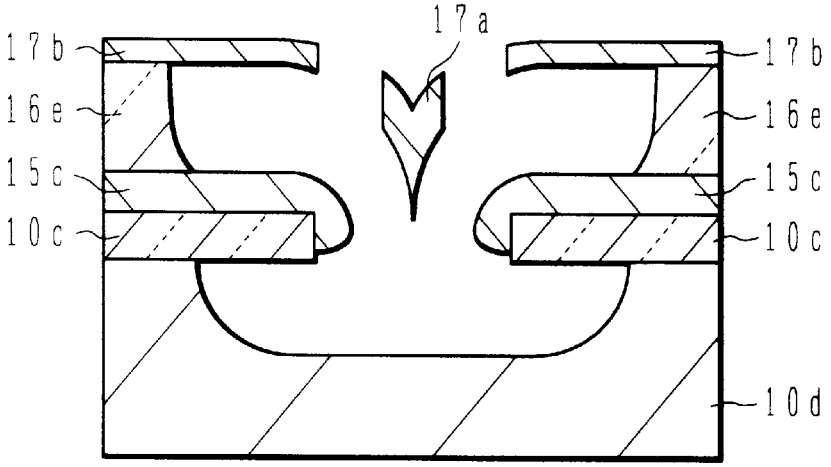

FIGS. 8A and 8B are diagrams illustrating a method of manufacturing a three-electrode element (so-called triode). The three-electrode element has three electrodes, an anode electrode, an emitter electrode, and a gate electrode. First, the element shown in FIG. 1G is manufactured by the previously described processes.

Thereafter, as shown in FIG. 8A, a resist film having a predetermined pattern (not shown) is formed on the emitter electrode 17. By using this resist pattern as a mask, slit openings 20 are formed on both sides of an emitter electrode 17*a* by RIE (reactive ion etching) using $Cl_2$ containing etchant. An emitter electrode 17*b* is formed at the outer sides of the slit openings 20.

The diameter of the emitter electrode 17*a* is about 0.3 $\mu$m, and the depth of the slit openings 20 is about 0.2 $\mu$m.

Next, as shown in FIG. 8B, part of the reacted film 16*c* and the whole of the reacted film 16*d* are wet etched. For example, $HF+NH_4F$ is used for wet etching the reacted films 16*c* and 16*d* made of $SiO_2$.

Part of the reacted film 16*c* is etched and a reacted film 16*e* is left unetched as shown in FIG. 8B so that the emitter electrode 17*a*, gate electrode 15*c*, and anode electrode 10*d* are exposed. The gate electrode 15*c* is made of, for example, polysilicon.

Figure 9:
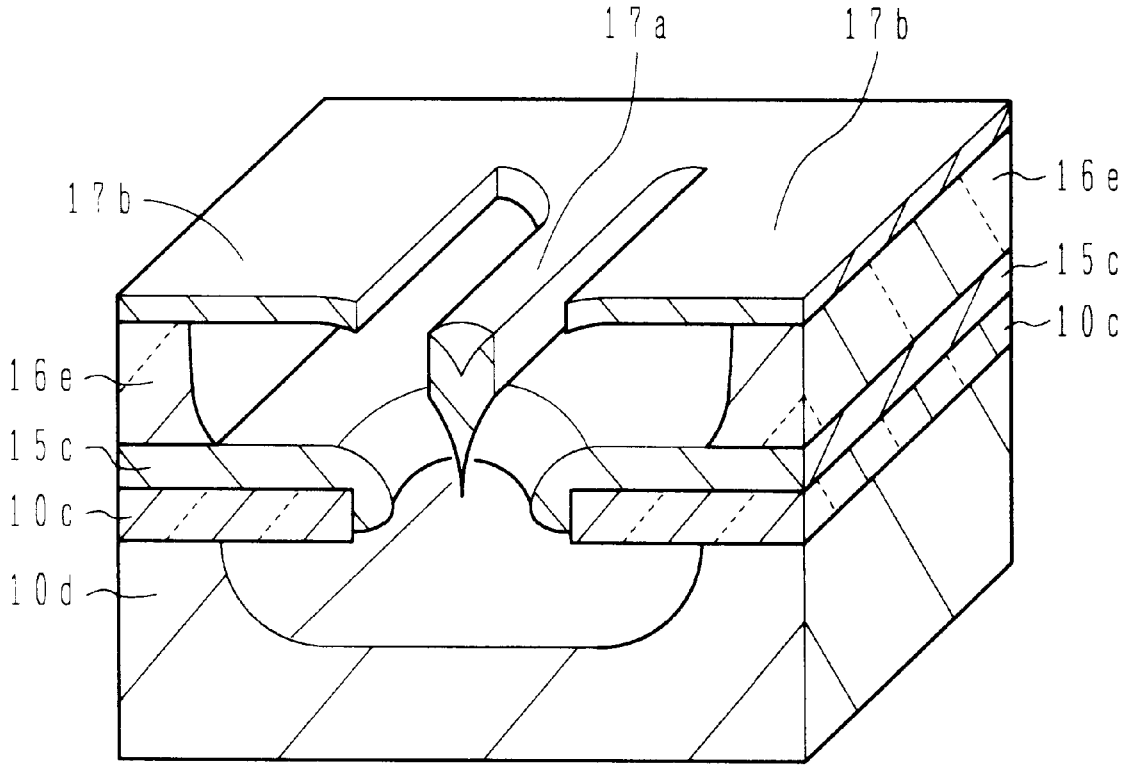
FIG. 9 is a perspective view of a three-electrode field emission element.

FIG. 9 is a perspective view of a three-electrode element. The emitter electrode 17*a* is integrally formed with the emitter electrode 17*b*. The gate electrode 15*c* has a circular hole or gate hole near at the tip of the emitter electrode 17*a*. The tip of the emitter electrode 17*a* has a needle-like sharp edge near at the gate hole of the gate electrode 15*c*.

Figure 10A:
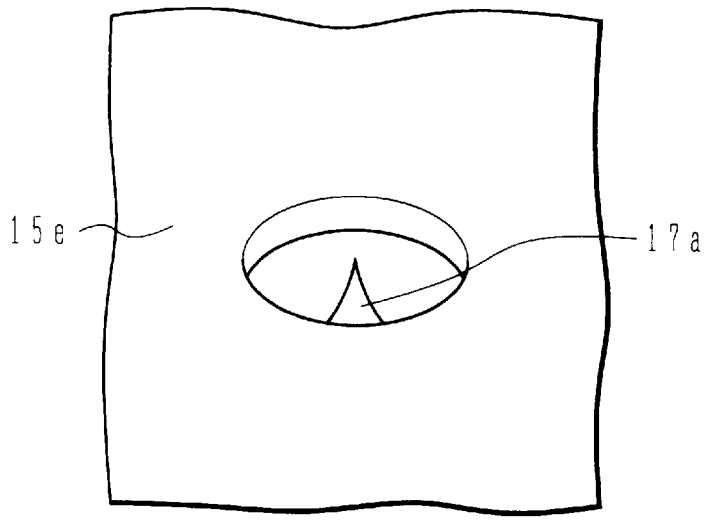
FIGS. 10A and 10B are diagrams showing the three-electrode field emission element shown in FIG. 9 turned upside down.

FIG. 10A is a perspective view showing the three-electrode element shown in FIG. 9 turned upside down, the emitter electrode 17*a* being viewed through the substrate via the gate hole of the gate electrode. The tip of the emitter electrode 17*a* has a needle-like sharp edge. The tip of the emitter electrode 17*a* may have different shapes.

Figure 10B:
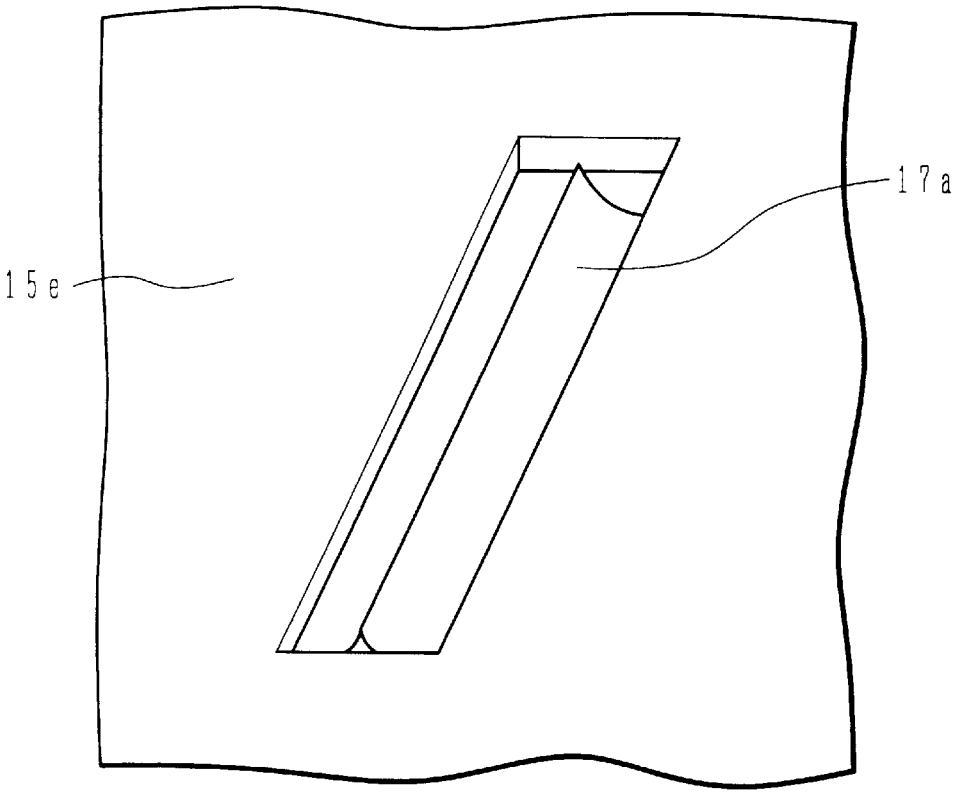

FIG. 10B is a perspective view showing a three-electrode element having a slit gate hole of the gate electrode 15*c*. The emitter electrode 17*a* has a wedge-like tip extending along the longitudinal direction of the gate hole.

The three-electrode element shown in FIG. 9 has the emitter electrode 17 as a cathode and an anode electrode 10*d* wherein a positive potential is applied to the gate electrode 15*c* to emit electrons from the emitter electrode 17*a* toward the anode electrode 10*d*.

Also in the case of a three-electrode element, the apex angle and radius of curvature of the tip of the emitter electrode 17*a* can be made small. The relative position of the emitter electrode 17*a* and gate electrode 15*c* can be controlled precisely.

In the above description, the lamination film 10*c* is made of insulating material such as $SiN_x$. Next, forming the lamination film 10*c* by conductive material will be described.

Figure 11:
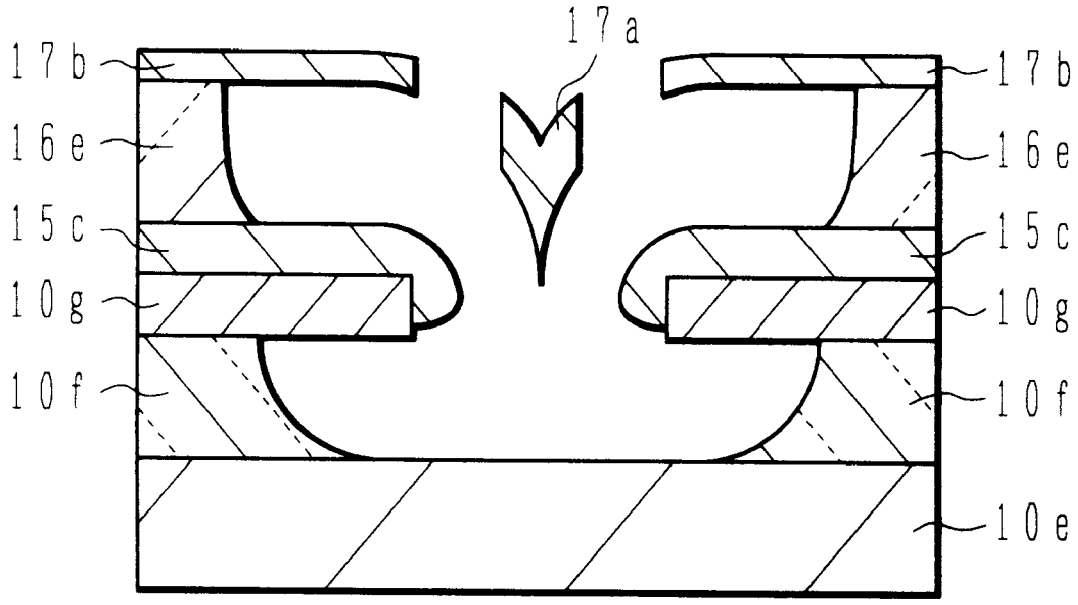
FIG. 11 is a diagram showing another three-electrode field emission element.

FIG. 11 is a cross sectional view showing another example of a three-electrode element. A lamination film (first gate electrode) 10*g* is made of conductive material such as $WSi_x$, $TaSi_x$, and $MoSi_x$. Between the anode electrode 10*e* and lamination film 10*g*, an insulating film 10*f* made of $SiO_2$, $SiN_x$, or the like is formed. The manufacture method of this three-electrode element will be described next.

The substrate 10 shown in FIG. 1A is constituted of the starting substrate 10*a* and the lamination film 10*b* made of insulating material and stacked on the starting substrate 10*a*. In the case of the three-electrode element shown in FIG. 11, on a substrate 10*e* made of, for example, Si, an insulating film 10*f* made of $SiO_2$ or the like and a lamination film 10*g* made of conductive material are sequentially laminated. Thereafter, the processes described previously are performed to manufacture the three-electrode element shown in FIG. 11.

By using the conductive lamination film 10*g*, a lamination of the first gate electrode 10*g* and second gate electrode 15*c* forms a low resistance gate electrode. The gate electrodes 10*g* and 15*c* are electrically isolated from the anode electrode 10*e* by the insulating film 10*f*.

The lamination film 10*g* is not necessarily made of conductive material, but it may be made of insulating material.

In the first embodiment, on the first sacrificial film forming a gate electrode, the second sacrificial film as a reaction control film made of, for example, $SiO_2$, is deposited. The second sacrificial film suppresses the supply amount of oxidant to the first sacrificial film and locally controls the reaction of the first sacrificial film.

If the second sacrificial film is made of $SiO_xN_y$ instead of $SiO_2$, the supply amount of oxidant can be reduced further. The second sacrificial film may be $SiO_2$ or $SiO_xN_y$.

In using $SiO_xN_y$ as the second sacrificial film, the x-y ratio of $SiO_xN_y$ can be set as desired. If y is set to 0, $SiO_2$ is used, whereas if x is set to 0, $SiN_x$ is used.

The second sacrificial film of $SiO_2$ or $SiO_xN_y$ suppresses the supply amount of oxidant to the first sacrificial film and serves as a reaction control film. If the second sacrificial film is made of $SiN_x$, oxidant hardly passes therethrough so that it serves as a reaction preventing film.

The second sacrificial film made of $SiO_2$ has been described above. Next, the second sacrificial film made of $SiN_x$ will be described.

FIGS. 12A to 12E are diagrams illustrating the manufacture steps of a field emission element according to the second embodiment of the invention. In the following, the manufacture steps of an emitter constituting a field emission element will be described.

Figure 12A:
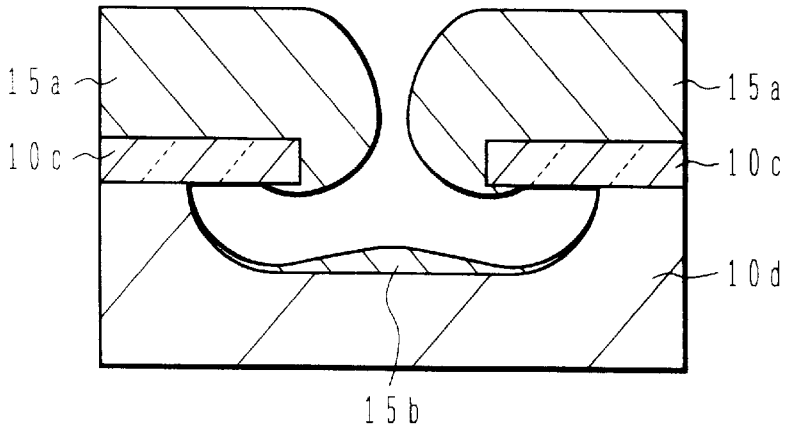
FIGS. 12A to 12E are diagrams illustrating the manufacture steps of a field emission element according to a second embodiment of the invention.

FIG. 12A illustrates the manufacture step after the steps of FIGS. 1A to 1C. As shown in FIG. 12A, a first sacrificial film 15*a* made of, for example, polysilicon is deposited by CVD on the lamination film 10*c* with two parts. At the same time, a first sacrificial film 15*b* is also deposited through an opening on the substrate 10*d* at the bottom of the hole 12*a*.

The first sacrificial film 15*a* is deposited uniformly thick on the upper surface of the lamination film 10*c*, and thin on the lower surface thereof. The two parts of the first sacrificial film 15*a* are maintained.

The first sacrificial films 15*a* and 15*b* may be made of amorphous silicon, $WSi_x$, $MoSi_x$, $TaSi_x$, Al, Ta, Mo, or Ti, instead of polysilicon.

Figure 12B:
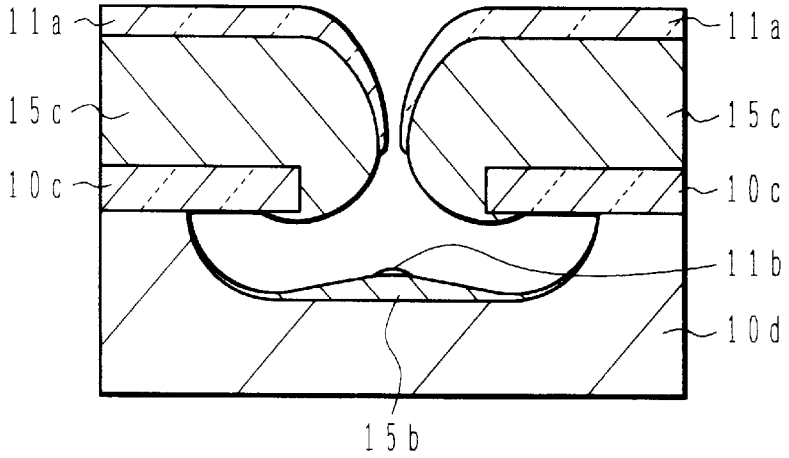

Next, as shown in FIG. 12B, reaction preventing films 11*a* and 11*b* made of $SiN_x$ are deposited. The reaction preventing film 11*a* is anisotropically deposited on the first sacrificial film 15*a* with the two parts, covering the upper surface and the upper side surface of the overhang portion (first sacrificial film 15*a*). The lower surface and the lower side surface of the overhang portion are not deposited with the reaction preventing film 11*a*. The reaction preventing film 11*b* is deposited on the first sacrificial film 15*b*. The reaction preventing films 11*a* and 11*b* have a function of preventing oxidation reaction. A silicon nitride film functions to intercept most of oxygens and becomes a reaction preventing film of oxidation reaction.

The reaction preventing films 11*a* and 11*b* of $SiN_x$ are deposited by plasma CVD, for example, under the conditions of a temperature of 415° C., a power of 300 W, a pressure of 1 Torr, and flow rates of 35 sccm of $SiH_4$ and 500 sccm of $N_2$.

The reaction preventing film 11*a* may be deposited thick. The reaction preventing film 11*a* is thereafter isotropically wet etched by a uniform amount from the surface thereof to obtain a desired thickness distribution. The reaction preventing film on the lower surface of the overhang portion, if any, can be reliably removed.

Next, by using the reaction preventing film 11*a* as a mask, the exposed portion of the first sacrificial film 5*a* is oxidized by wet oxidation. The upper surface and the upper side surface of the first sacrificial film 15*a* are covered with the reaction preventing film 11*a*, and the lower surface and the lower side surface thereof are not covered with the reaction preventing film 11*a*. Oxidation reaction is stopped at the area covered with the reaction preventing film 11*a*, and is enhanced at the area not covered with the reaction preventing film 11*a*. Namely, oxidation is enhanced at the lower surface and the lower side surface of the overhang portion and the volume of this area expands.

Figure 12C:
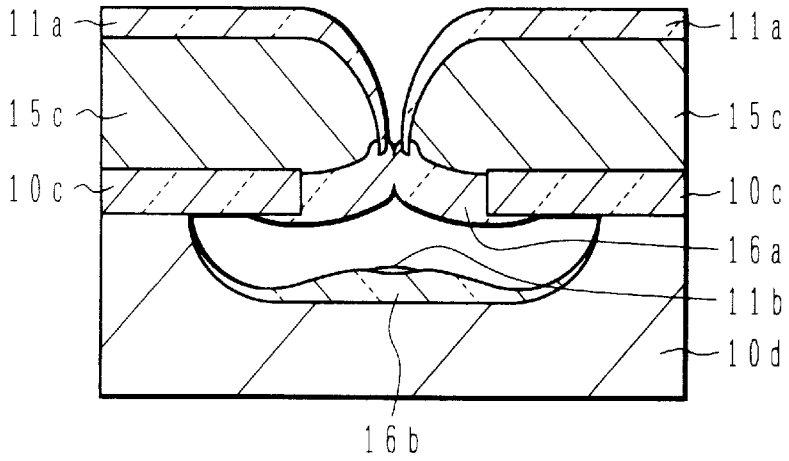

Oxidation continues until the two parts of the overhang portion become in contact with each other through their volume expansion at the lower surface. As the first sacrificial film 15*a* is oxidized, a reacted film 16*a* of $SiO_2$ is formed as shown in FIG. 12C. The reacted film 16*a* contacts the two parts of the overhang portion.

The first sacrificial film is not completely oxidized, but the first sacrificial film 15*c* sown in FIG. 12C is left. A reacted film 16*b* is formed on the substrate 10*d*.

A cusp portion formed when the two parts contact each other has a shape of two-stage curves. The first stage curve is a curve formed by the mold of the reaction preventing film 11*a* at the upper area of the overhang portion. The second stage curve is a curve formed by the mold of the reaction preventing film 11*a* at the lower area of the overhang portion. The cusp portion formed when the two parts become in contact with each other has a sharp acute angle having a cross section like two contacted circles or ellipses. By using this cusp portion as a mold, a two-stage type emitter electrode is formed.

Figure 12D:
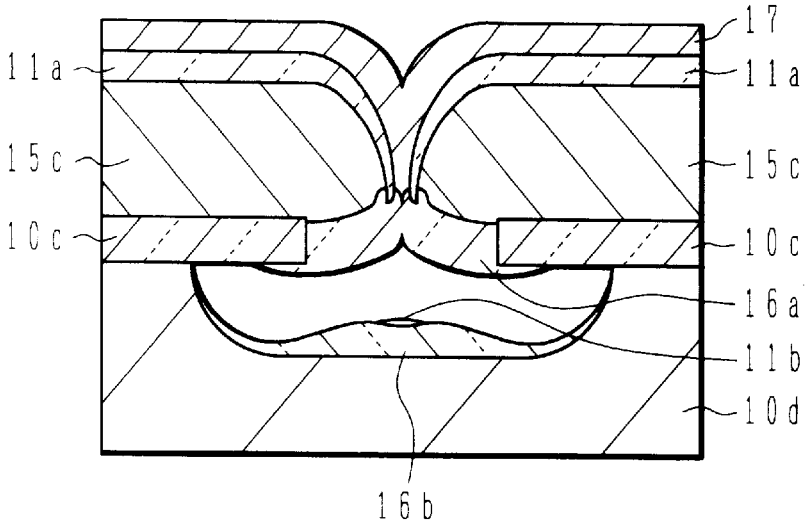

As shown in FIG. 12D, an emitter electrode 17 made of, for example, TiN is deposited on the reacted film 16*a* and reaction preventing film 11*a* about 0.2 $\mu$m by reactive sputtering. The emitter electrode 17 may be made of Mo, Cr, Ti, or W, instead of TiN. CVD instead of sputtering may be used.

Figure 12E:
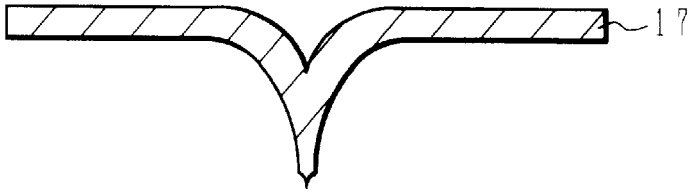

As shown in FIG. 12E, the substrate 10*d*, reacted film 16*a*, and reaction preventing film 11*a* are wet etched to expose the emitter electrode.

In the second embodiment, the reaction preventing film ($SiN_x$) is formed on the first sacrificial film, and oxidation is executed by using the reaction preventing film as a mask. Use of the reaction preventing film can prevent reaction at the upper area of the overhang portion and allows only the lower area thereof to be reacted. As a result, the two-stage type emitter electrode 17 can be formed.

As compared to the one-stage type emitter electrode shown in FIG. 1H, the apex angle and radius of curvature of the tip of the two-stage type emitter electrode can be easily made smaller. Even if the mold having a small apex angle and radius of curvature is used, emitter material can be easily filled in the cusp portion of the mold so that the relative position between the emitter electrode and gate electrode can be determined precisely. If the apex angle and radius of curvature of the emitter electrode are made small, electric field can be easily concentrated on the emitter electrode so that the product uniformity, reproductivity, and performance of field emission elements can be improved.

The mold for the one-stage type emitter electrode has an emitter area gradually narrowing from the base of the emitter electrode to the tip thereof. It is therefore difficult to film emitter material or form an emitter electrode film deep into the narrowed tip. In contrast, the mold for the second-stage type emitter electrode has an emitter area defined by two-stage curves. Therefore, as compared to the one-stage type emitter electrode gradually narrowing toward the tip by using only the first stage curve only, a broad opening area can be provided at the boundary between the first and second-stage curves so that the emitter electrode can be easily formed deep into its tip. The tip of the second-stage emitter electrode is therefore difficult to be broken, and the shape of the mold can be formed with good reproductivity.

The emitter electrode manufacture methods have been described so far. Next, a method of manufacturing another type of a field emission element of a two-electrode element will be described.

Figure 13:
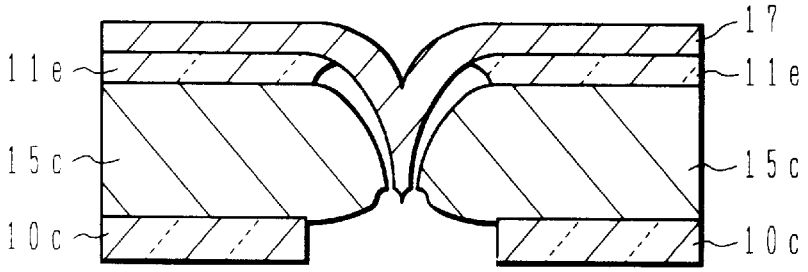
FIG. 13 is a diagram showing a two-electrode field emission element.

FIG. 13 is a diagram illustrate the method of manufacturing a two-electrode element. First, an element shown in FIG. 12D is formed by the above described processes. Thereafter, the substrate 10*d*, reacted film 16*a*, and part of the reaction preventing film 11*a* are etched. By partially removing the reaction preventing film 11*a* and leaving the reaction preventing film 11*e* as shown in FIG. 13, the tip of the emitter electrode 17 is exposed.

If the first sacrificial film 15*c* is made of conductive polysilicon or amorphous silicon, the first sacrificial film 15*c*, which is unreacted, can be used as a gate electrode. The two-electrode element has two electrodes—the emitter electrode 17 and gate electrode 15*c*. The reaction preventing film 11*e* electrically isolates the emitter electrode 17 and gate electrode 15*c*. The lamination film 10*c* may be removed by etching.

In the second embodiment, since the first sacrificial film is oxidized to expand the volume, the position of the tip of the emitter electrode 17 can be controlled more precisely than volume expansion using CVD, from the reasons described above.

Also in the case of a two-electrode element, the emitter electrode 17 of the two-stage type can be formed and the apex angle and radius of curvature of the tip can be easily made smaller. Even if the mold having a small apex angle and radius of curvature is used, emitter material can be easily filled in the cusp portion of the mold so that the relative position between the emitter electrode 17 and gate electrode 15*c* can be determined precisely. If the apex angle and radius of curvature of the emitter electrode are made small, electric field can be easily concentrated on the emitter electrode 17 so that the product uniformity, reproductivity, and performance of field emission elements can be improved.

The manufacture method of a two-electrode element has been described. Next, a manufacture method of another type of a field emission element of a three-electrode element will be described.

Figure 14A:
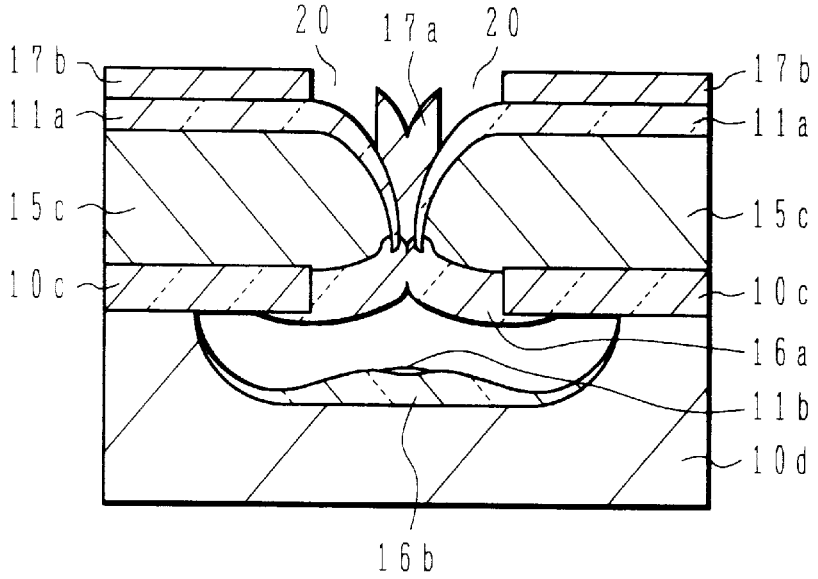
FIGS. 14A and 14B are diagrams illustrating the manufacture steps of a three-electrode field emission element.
Figure 14B:
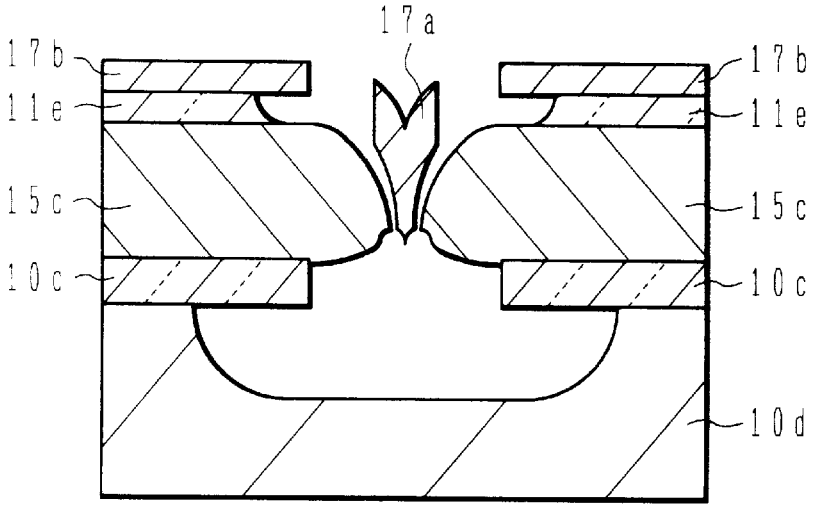

FIGS. 14A and 14B are diagrams illustrating a method of manufacturing a three-electrode element. First, the element shown in FIG. 14D is manufactured by the previously described processes.

Thereafter, as shown in FIG. 14A, a resist film having a predetermined pattern (not shown) is formed on the emitter electrode 17. By using this resist pattern as a mask, slit openings 20 are formed on both sides of an emitter electrode 17*a* by RIE (reactive ion etching) using $Cl_2$ containing etchant. An emitter electrode 17*b* is formed at the outer sides of the slit openings 20.

The diameter of the emitter electrode 17*a* is about 0.3 $\mu$m, and the depth of the slit openings 20 is about 0.2 $\mu$m.

Next, as shown in FIG. 14B, the reacted film 16*a* and part of the reaction preventing film 11*a* are wet etched to leave a reaction preventing film 11*e*, so that so that the emitter electrode 17*a*, gate electrode 15*c*, and anode electrode 10*d* are exposed. The gate electrode 15*c* is made of, for example, polysilicon.

Figure 15:
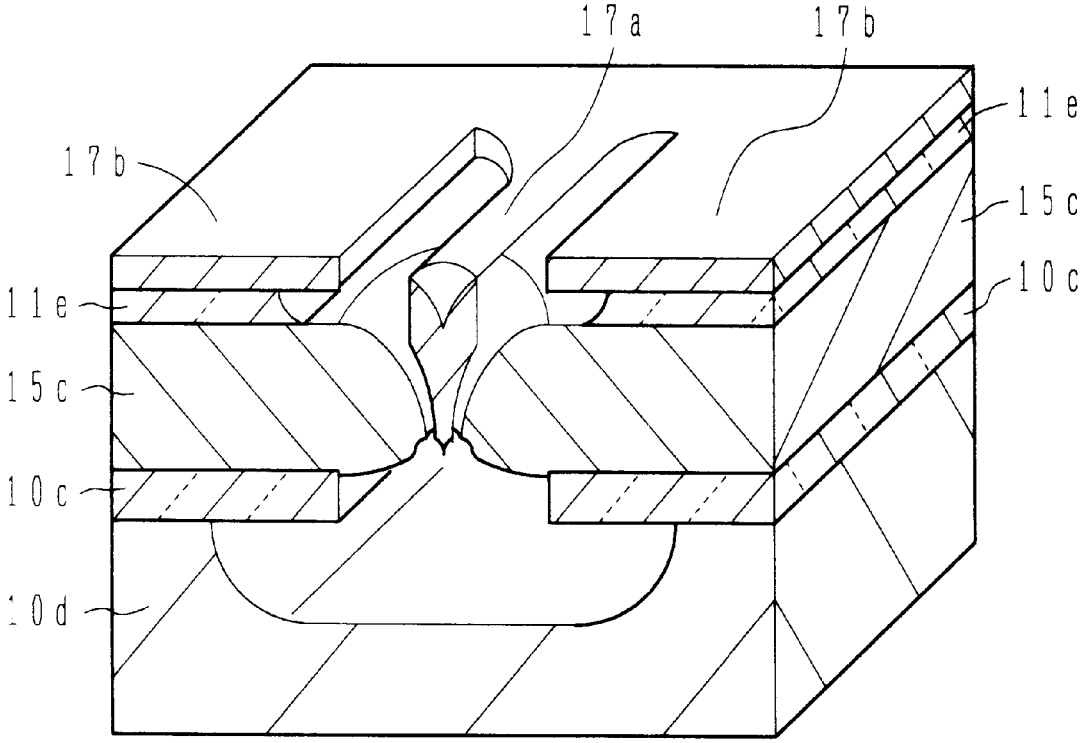
FIG. 15 is a perspective view of a three-electrode field emission element.
Figure 16:
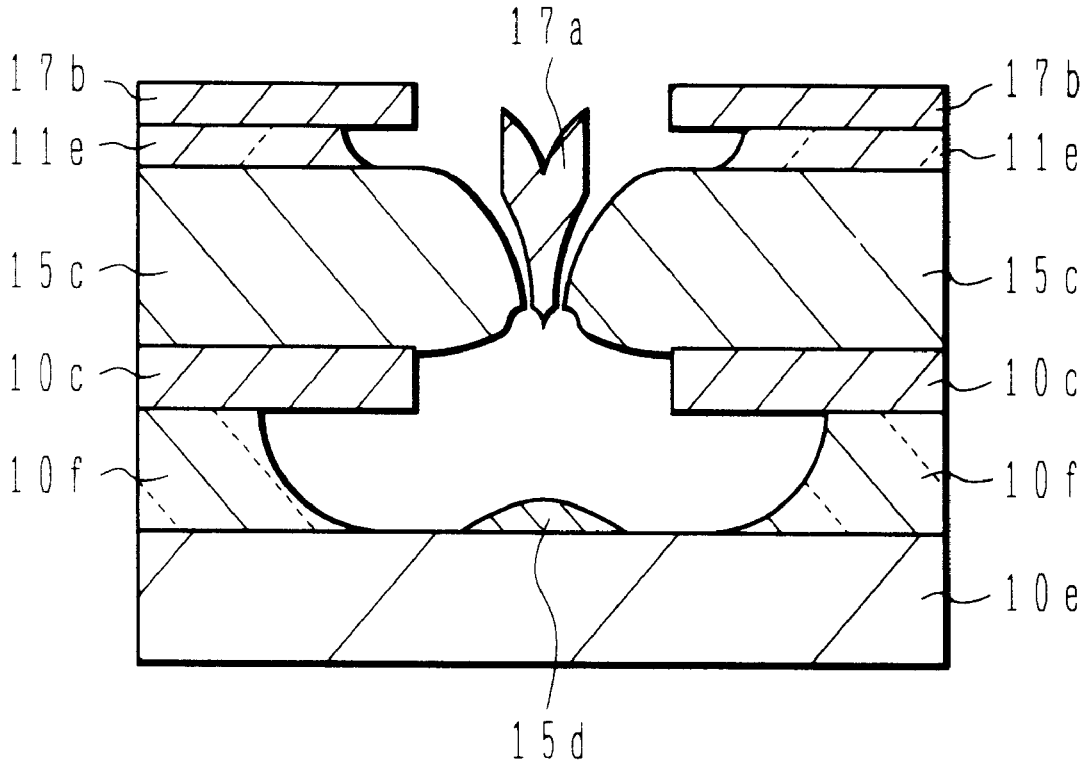
FIG. 16 is a diagram showing another three-electrode field emission element.

FIG. 15 is a perspective view of a three-electrode element. The emitter electrode 17*a* is integrally formed with the emitter electrode 17*b*. The gate electrode 15*c* has a circular hole or gate hole near at the tip of the emitter electrode 17*a*. The tip of the emitter electrode 17*a* has a needle-like sharp edge near at the gate hole of the gate electrode 15*c*.

The three-electrode element has the emitter electrode 17 as a cathode and an anode electrode 10*d* wherein a positive potential is applied to the gate electrode 15*c* to emit electrons from the emitter electrode 17*a* toward the anode electrode 10*d*.

Also in the case of a three-electrode element, the apex angle and radius of curvature of the tip of the emitter electrode 17*a* can be made small. The relative position of the emitter electrode 17*a* and gate electrode 15*c* can be controlled precisely.

In the above description, the lamination film 10*c* is made of insulating material such as $SiN_x$. The lamination film 10*c* may be made of conductive material by using the structure shown in FIG. 11.

In a three-electrode element having a lamination film 10*c* of conductive material, an anode electrode 10*e* has an additional anode electrode 15*d* which was deposited on the anode electrode 10*e* when an gate electrode 15*c* was formed thick. The anode electrode 15*d* is made of, for example, polysilicon.

In the above description, reaction process such as oxidation is executed by masking the first sacrificial film with a reaction preventing film. Next, the case wherein reaction process is executed by forming another sacrificial film on the reaction preventing film and first sacrificial film, will be described.

FIGS. 17A to 17F are diagrams illustrating the manufacture steps of a field emission element according to the third embodiment of the invention. In the following, the manufacture steps of an emitter constituting a field emission element will be described.

Figure 17A:
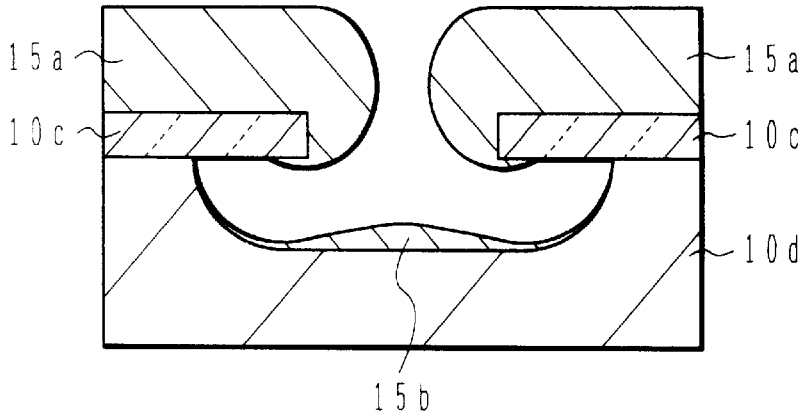
FIGS. 17A to 17F are diagrams illustrating the manufacture steps of a field emission element according to a third embodiment of the invention.

FIG. 17A illustrates the manufacture step after the steps of FIGS. 1A to 1C. As shown in FIG. 17A, a first sacrificial film 15*a* made of, for example, polysilicon is deposited by CVD on the lamination film 10*c* with two parts. At the same time, a first sacrificial film 15*b* is also deposited through an opening on the substrate 10*d* at the bottom of the hole 12*a*.

The first sacrificial film 15*a* is deposited uniformly thick on the upper surface of the lamination film 10*c*, and thin on the lower surface thereof. The two parts of the first sacrificial film 15*a* are maintained.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used in place of CVD.

Figure 17B:
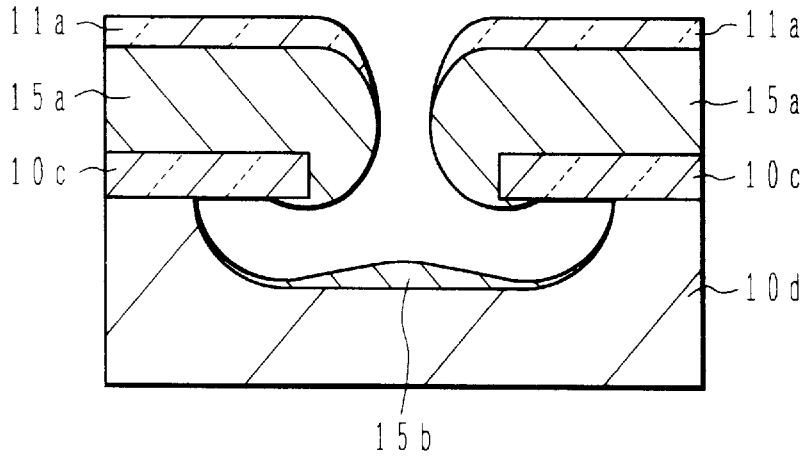

Next, as shown in FIG. 17B, a reaction preventing film 11*a* made of, for example, $SiN_x$, is deposited on the first sacrificial film 15*a*. The reaction preventing film 11*a* is anisotropically deposited on the first sacrificial film 15*a* with the two parts, covering the upper surface and the upper side surface of the overhang portion (first sacrificial film 15*a*). The lower surface and the lower side surface of the overhang portion are not deposited with the reaction preventing film 11*a*. The reaction preventing film 11*a* has a function of preventing oxidation reaction.

The reaction preventing film 11*a* may be deposited thick. The reaction preventing film 11*a* is thereafter isotropically wet etched by a uniform amount from the surface thereof to obtain a desired thickness distribution. The reaction preventing film on the lower surface of the overhang portion, if any, can be reliably removed.

Figure 17C:
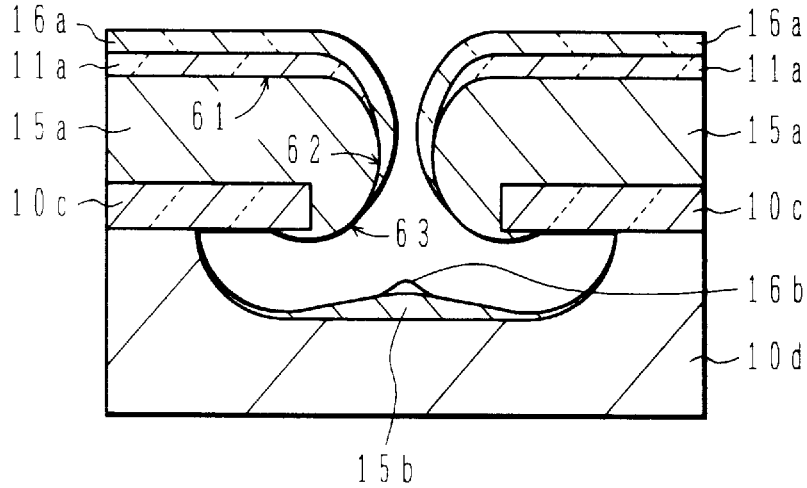

As shown in FIG. 17C, a second sacrificial film 16*a* made of, for example, $SiO_2$, is deposited by plasma CVD, covering the reaction preventing film 11*a*. As the second sacrificial film 16*a* is deposited, it reaches, via the gap between the two parts of the overhang portion, to the first sacrificial film 15*b*.

The surface of the first sacrificial film 15*a* has three regions 61, 62, and 63. The region 61 is covered with the reaction preventing film 11*a* and second sacrificial film 16*a*, and positioned at the upper area of the overhang portion. The region 62 is covered with only the second sacrificial film 16*a*, and positioned at the slightly lower side area of the overhang portion. The region 63 is covered with no film and exposed, and positioned at the lower area of the overhang portion.

Next, the first sacrificial film 15*a* is oxidized by wet oxidation. The region 61 of the first sacrificial film 15*a* is covered with the reaction preventing film 11*a* so that oxygen is rarely supplied, whereas the exposed region 63 is supplied with a sufficient amount of oxygen. The region 62 is covered with the second sacrificial film 16*a* so that the supply amount of oxygen depends upon the thickness of the second sacrificial film 16*a*. The thicker the second sacrificial film 16*a*, the more the supply amount of oxygen.

The oxidation reaction progress degrees in the three regions 61, 62, and 63 are different. The regions 63, 62, and 61 are oxidized more easily in this order. The region 63 with its surface being exposed is oxidized most. Conversely, the region 61 covered with the reaction preventing film 11*a* is hardly oxidized.

Figure 17D:
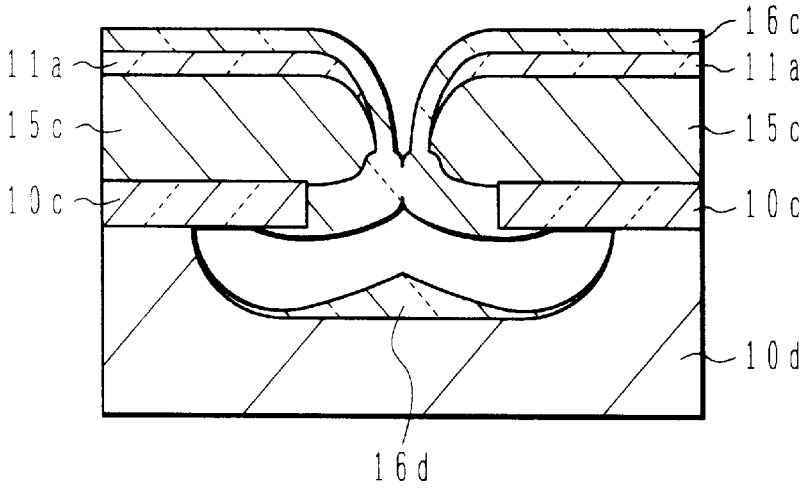

As the oxidation process proceeds, the volumes of the regions 63 and 62 of the first sacrificial film not covered with the reaction preventing film 11*a* expand. Oxidation reaction proceeds most at the lower side surface of the overhang portion at which the region 63 is positioned, and the two parts of the overhang portion at the lower side surface connect each other. A reacted film 16*c* with the connected two parts is shown in FIG. 17D. When the two parts are connected each other, the oxidation reaction is stopped. As the first sacrificial film 15*a* (FIG. 17C) is oxidized, it becomes $SiO_2$ and is integrated with the same material $SiO_2$ of the second sacrificial film 16*a* to thereby form the reacted film 16*c* ($SiO_2$) shown in FIG. 17D. The first sacrificial film is not completely oxidized, but the first sacrificial film 15*c* shown in FIG. 17D is left.

The reacted film 16*c* is formed when the two parts of the overhang portion contact each other. A sharp cusp portion is formed at this contact area. The surface of the reacted film 16*c* has a shape of two-stage curves. The first curve is at the region where oxidation reaction is intercepted (at the upper area of the overhang portion), and the second curve is at the region where oxidation reaction is enhanced (at the lower area of the overhang). The cusp portion formed at the oxidation reaction enhanced region has a sharp acute angle having a cross section like two contacted circles or ellipses. By using this cusp portion as a mold, a two-stage type emitter electrode is formed.

Figure 17E:
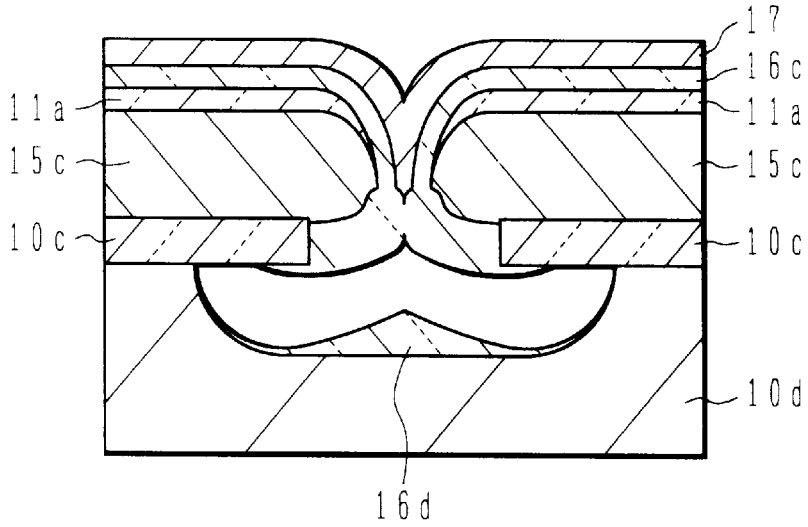

As shown in FIG. 17E, an emitter electrode 17 made of, for example, TiN is deposited on the reacted film 16*c* about 0.2 $\mu$m by reactive sputtering. The emitter electrode 17 may be made of Mo, Cr, Ti, or W, instead of TiN. CVD instead of sputtering may be used.

Figure 17F:
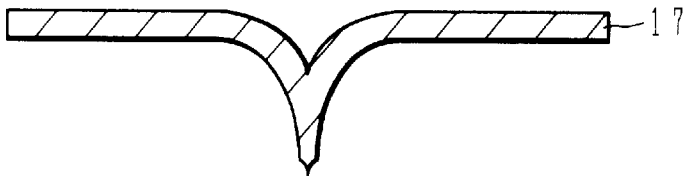

As shown in FIG. 17F, the substrate 10*d* and reacted film 16*c* are wet etched to expose the emitter electrode 17.

In the third embodiment, in forming the emitter electrode 17 of the two-stage type, the reaction preventing film ($SiN_x$) is formed on the first sacrificial film and then the second sacrificial film is formed. It is easy to make small the apex angle and radius of curvature of the tip of the two-stage type emitter electrode. Therefore, the performance of field emission elements can be improved.

The emitter electrode manufacture methods have been described so far. Next, a method of manufacturing another type of a field emission element of a two-electrode element will be described.

Figure 18:
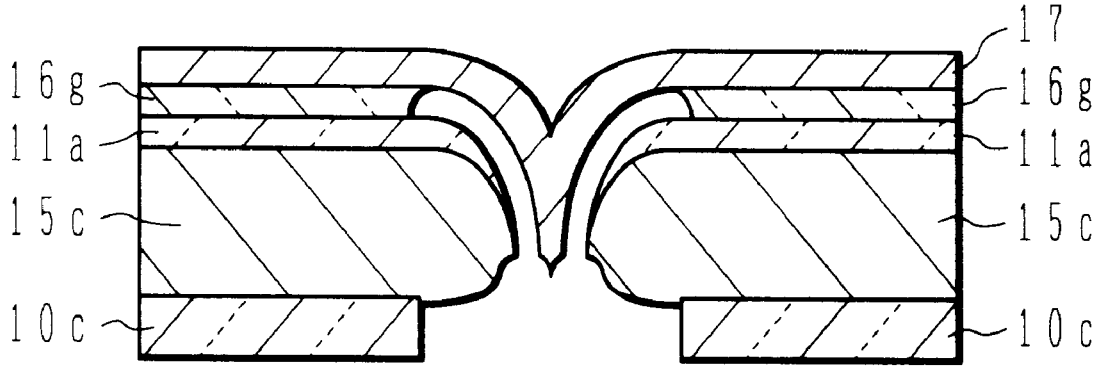
FIG. 18 is a diagram showing a two-electrode field emission element.

FIG. 18 is a diagram illustrate the method of manufacturing a two-electrode element. First, an element shown in FIG. 17E is formed by the above described processes. Thereafter, the substrate 10*d* and part of the reacted film 16*c* are etched. By partially removing the reacted film 16*c* and leaving the reacted film 16*g* as shown in FIG. 13, the tip of the emitter electrode 17 is exposed.

Even if conductive foreign substance is captured between the emitter electrode 17 and gate electrode 15*c*, leakage or short circuit is hard to occur. By leaving the reacted film 16*g* having a dielectric constant larger than a vacuum dielectric constant of 1 on the gate electrode, the equipotential surface (line) can be set to the proximity of the emitter electrode 17 so that the electric field at the emitter electrode tip becomes strong.

If the first sacrificial film 15*c* is made of conductive polysilicon or amorphous silicon, the first sacrificial film 15*c*, which is unreacted, can be used as a gate electrode. The two-electrode element has two electrodes—the emitter electrode 17 and gate electrode 15*c*. The reacted film 16*g* and reaction preventing film 11*a* electrically isolate the emitter electrode 17 and gate electrode 15*c*. Since the insulating film has a two-layer structure, the dielectric breakdown voltage can be improved, because a probability of a presence of pin hole or weak spot at the same area of the two layers is a product of two probabilities of the two layer. The reaction preventing film 11*a* may be made of conductive material. The lamination film 10*c* may be removed by etching.

The manufacture method of a two-electrode element has been described. Next, a manufacture method of another type of a field emission element of a three-electrode element will be described.

Figure 19A:
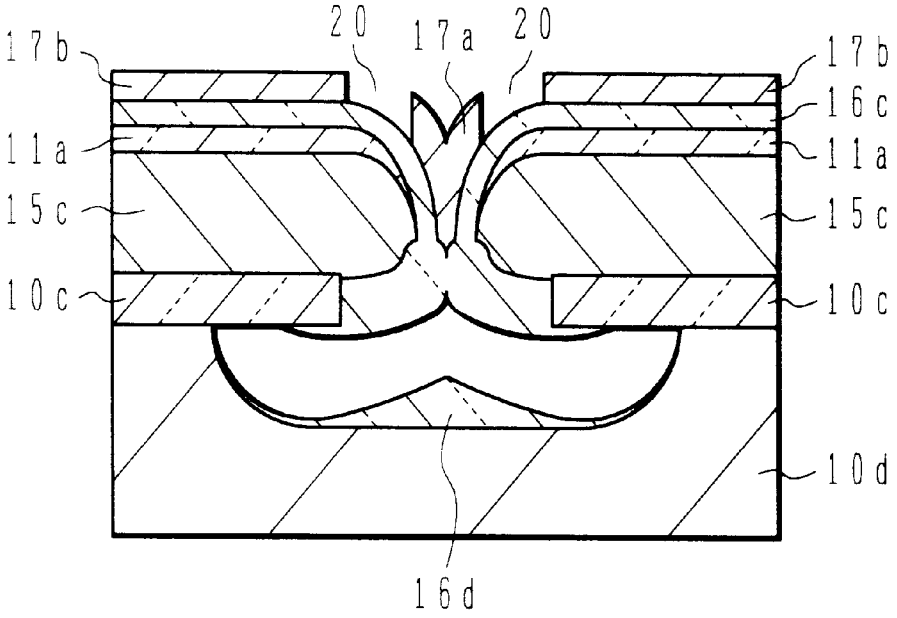
FIGS. 19A and 19B are diagrams illustrating the manufacture steps of a three-electrode field emission element.
Figure 19B:
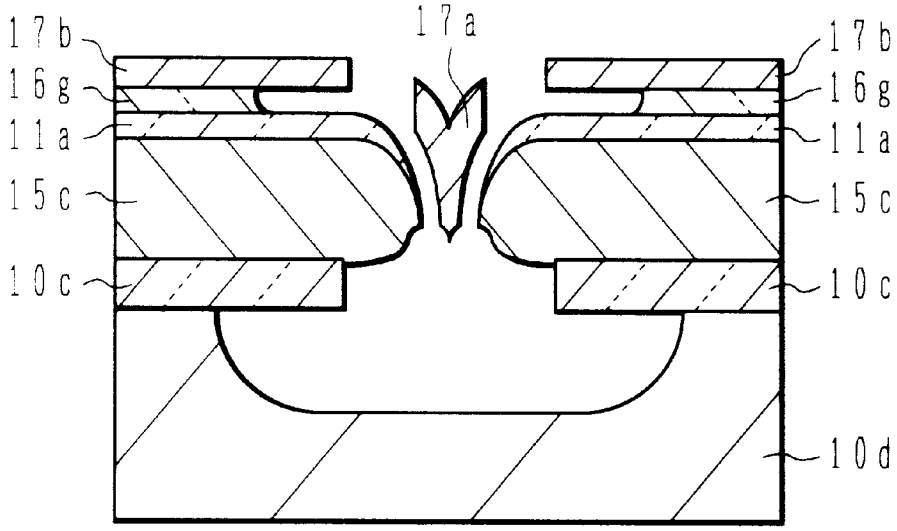

FIGS. 19A and 19B are diagrams illustrating a method of manufacturing a three-electrode element.

First, the element shown in FIG. 17E is manufactured by the previously described processes. Thereafter, as shown in FIG. 19A, a resist film having a predetermined pattern (not shown) is formed on the emitter electrode 17. By using this resist pattern as a mask, slit openings 20 are formed on both sides of an emitter electrode 17*a* by RIE using $Cl_2$ containing etchant. An emitter electrode 17*b* is formed at the outer sides of the slit openings 20. The diameter of the emitter electrode 17*a* is about 0.3 $\mu$m, and the depth of the slit openings 20 is about 0.2 $\mu$m.

Next, as shown in FIG. 19B, the reacted film 16*d* and part of the reacted film 16*c* are wet etched to leave a reacted film 16*g*, so that the emitter electrode 17*a*, gate electrode 15*c*, and anode electrode 10*d* are exposed.

In the above description, oxidation reaction is performed by forming the reaction preventing film on the first sacrificial film and further forming the second sacrificial film thereon. Next, the different lamination order of these three films will be described wherein oxidation reaction is performed by forming the second sacrificial film on the first sacrificial film and then forming a reaction preventing film thereon.

FIGS. 20A to 20F are diagrams illustrating the manufacture steps of a field emission element according to the fourth embodiment of the invention. In the following, the manufacture steps of an emitter constituting a field emission element will be described.

Figure 20A:
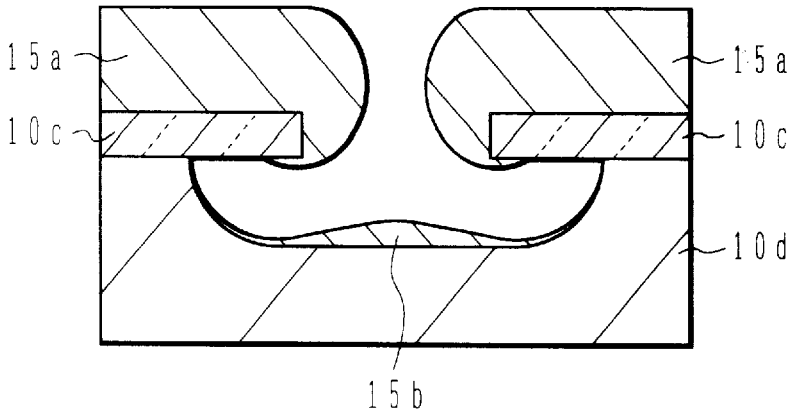
FIGS. 20A to 20F are diagrams illustrating the manufacture steps of a field emission element according to a fourth embodiment of the invention.

FIG. 20A illustrates the manufacture step after the steps of FIGS. 1A to 1C. As shown in FIG. 20A, a first sacrificial film 15*a* made of, for example, polysilicon is deposited by CVD on the lamination film 10*c* with two parts. At the same time, a first sacrificial film 15*b* is also deposited through an opening on the substrate 10*d* at the bottom of the hole 12*a*.

The first sacrificial film 15*a* is deposited uniformly thick on the upper surface of the lamination film 10*c*, and thin on the lower surface thereof. The two parts of the first sacrificial film 15*a* are maintained.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used in place of CVD.

Figure 20B:
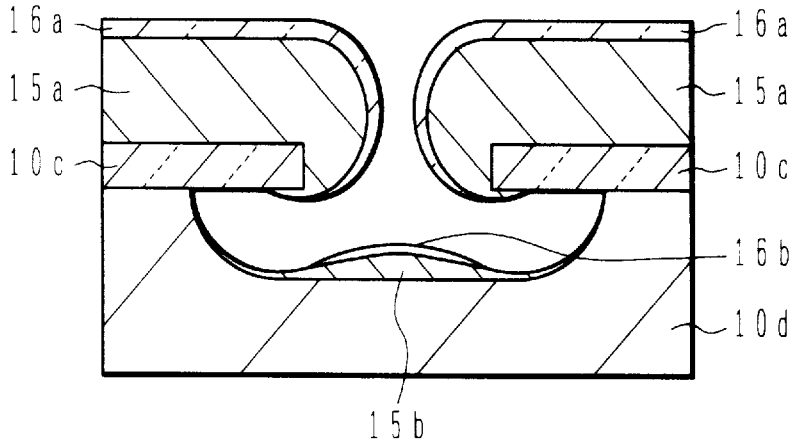

Next, as shown in FIG. 20B, a second sacrificial film 16*a* made of, for example, $SiO_2$ is deposited on the surface of the first sacrificial film 15*a* by CVD. A second sacrificial film 16*b* is also deposited on the first sacrificial film 15*b*. The second sacrificial film 16*a* is deposited uniformly thick on the upper surface of the first sacrificial film 15*a*, and gradually reduces its thickness at the side surface of the overhang portion toward the lower side surface.

The second sacrificial film is deposited by plasma CVD, for example, under the conditions of a temperature of 415° C., a power of 290 W, a pressure of 1.5 Torr, and flow rates of 100 sccm of $SiH_4$, 500 sccm of $N_2O$, and 500 sccm of $N_2$.

Figure 20C:
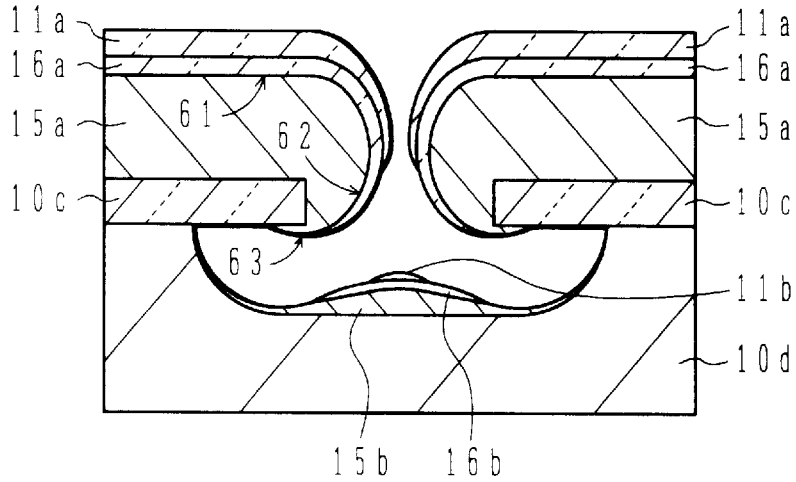

As shown in FIG. 20C, a reaction preventing film 11*a* made of, for example, $SiN_x$, is deposited partially on the second sacrificial film 15*a*. The reaction preventing film 11*a* is deposited only on the upper surface and the upper side surface of the overhang portion with the two parts, and not deposited on the lower side surface thereof. The reaction preventing film 11*a* has a function of preventing oxidation reaction of the first sacrificial film 15*a*. A reaction preventing film 11*b* is deposited, via a gap between the two parts of the overhang portion, on the second sacrificial film 16*b*.

The reaction preventing film 11*a* may be deposited thick. The reaction preventing film 11*a* is thereafter isotropically wet etched by a uniform amount from the surface thereof to obtain a desired thickness distribution. The reaction preventing film on the lower surface of the overhang portion, if any, can be reliably removed.

The surface of the first sacrificial film 15*a* has three regions 61, 62, and 63. The region 61 is covered with the reaction preventing film 11*a* and second sacrificial film 16*a*, and positioned at the upper area of the overhang portion. The region 62 is covered with only the second sacrificial film 16*a*, and positioned at the lower side area of the overhang portion. The region 63 is covered with no film and exposed, and positioned at the lower area of the overhang portion.

Next, the first sacrificial film 15*a* is oxidized by wet oxidation. The region 61 of the first sacrificial film 15*a* is covered with the reaction preventing film 11*a* so that oxygen is rarely supplied, whereas the exposed region 63 is supplied with a sufficient amount of oxygen. The region 62 is covered with the second sacrificial film 16*a* so that the supply amount of oxygen depends upon the thickness of the second sacrificial film 16*a*. The thicker the second sacrificial film 16*a*, the more the supply amount of oxygen. The oxidation reaction progress degrees in the three regions 61, 62, and 63 are different. The regions 63, 62, and 62 are oxidized more easily in this order.

Figure 20D:
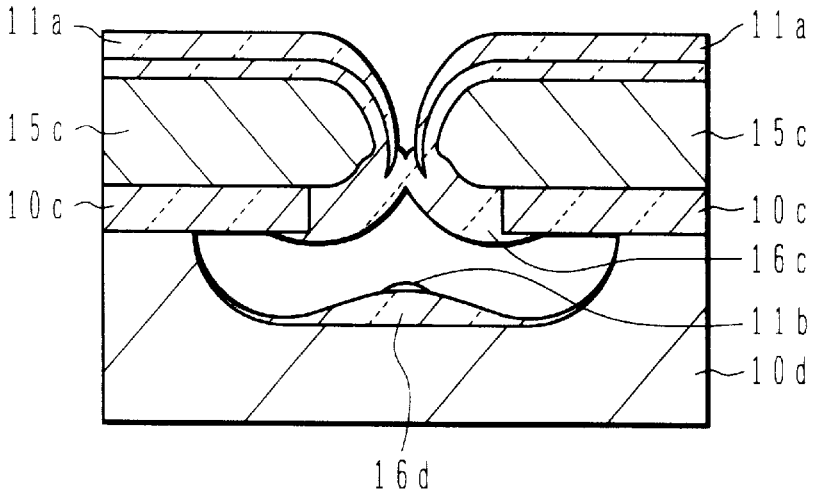

As the oxidation process proceeds, the volumes of the regions 63 and 62 of the first sacrificial film not covered with the reaction preventing film 11*a* expand. Oxidation reaction proceeds most at the lower side surface of the overhang portion at which the region 63 is positioned, and the two parts of the overhang portion at the lower side surface connect each other. A reacted film 16*c* with the connected two parts is shown in FIG. 20D. When the two parts are connected each other, the oxidation reaction is stopped. The reacted film 16*c* is formed when the two parts of the overhang portion contact each other. A sharp cusp portion is formed at this contact area.

As the first sacrificial film 15*a* (FIG. 20C) is oxidized, it becomes $SiO_2$ and is integrated with the same material $SiO_2$ of the second sacrificial film 16*a* to thereby form the reacted film 16*c* ($SiO_2$) shown in FIG. 20D. The first sacrificial film is not completely oxidized, but the first sacrificial film 15*c* shown in FIG. 20D is left. A reacted film 16*d* is also formed on the substrate 10*d* during the oxidation reaction.

The cusp portion formed by the reacted film 16*c* and reaction preventing film 11*a* has a shape of two-stage curves. The first curve is formed by the mold of the reaction preventing film 11*a*, and the second curve is formed by the mold of the reacted film 16*c*. The cusp portion formed by the reacted film has a sharp acute angle having a cross section like two contacted circles or ellipses. By using this cusp portion as a mold, a two-stage type emitter electrode is formed.

Figure 20E:
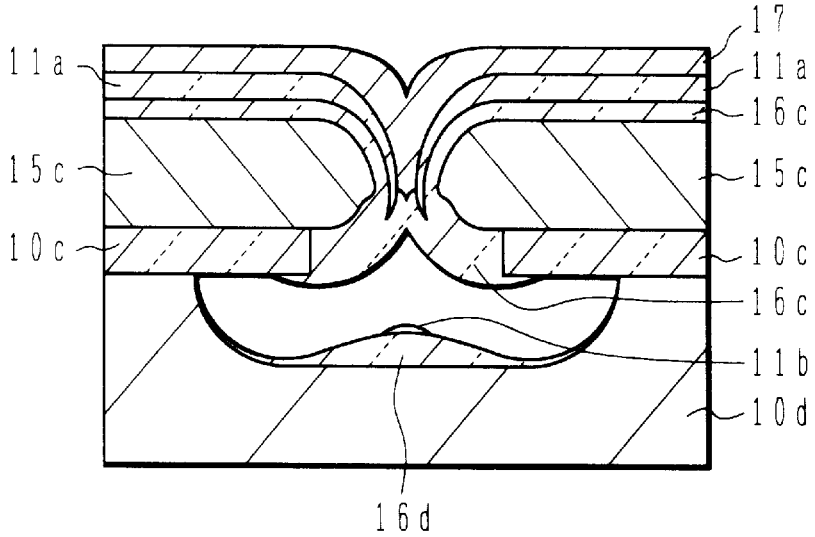

As shown in FIG. 20E, an emitter electrode 17 made of, for example, TiN is deposited on the reaction preventing film 11*a* and reacted film 16*c* about 0.2 $\mu$m by reactive sputtering. The emitter electrode 17 may be made of Mo, Cr, Ti, or W, instead of TiN. CVD instead of sputtering may be used.

Figure 20F:
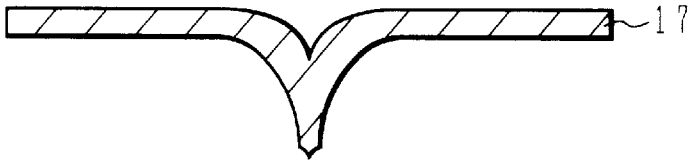

As shown in FIG. 20F, the substrate 10*d*, reacted film 16*c*, and reaction preventing film 11*a* are wet etched to expose the emitter electrode 17. The emitter electrode 17 is preferably reinforced by the methods illustrated in FIGS. 2A to 2C, because it is thin.

It is easy to make small the apex angle and radius of curvature of the tip of the two-stage type emitter electrode. Therefore, the performance of field emission elements can be improved.

In the fourth embodiment, oxidation reaction is performed by forming the second sacrificial film on the first sacrificial film and further forming the reaction preventing film thereon. Either the second sacrificial film or the reaction preventing film may be formed on the first sacrificial film.

If the second sacrificial film is formed between the first sacrificial film and the reaction preventing film, a buffer function can be given to the second sacrificial film. Specifically, distortion is likely to be generated by deformation of the first sacrificial film and deformation of the reaction preventing film during the oxidation reaction or other processes because the substrate is once heated to a high temperature and thereafter cooled. This second sacrificial film functions as a buffer for absorbing such distortion.

The emitter electrode manufacture methods have been described so far. Next, a method of manufacturing another type of a field emission element of a two-electrode element will be described.

Figure 21:
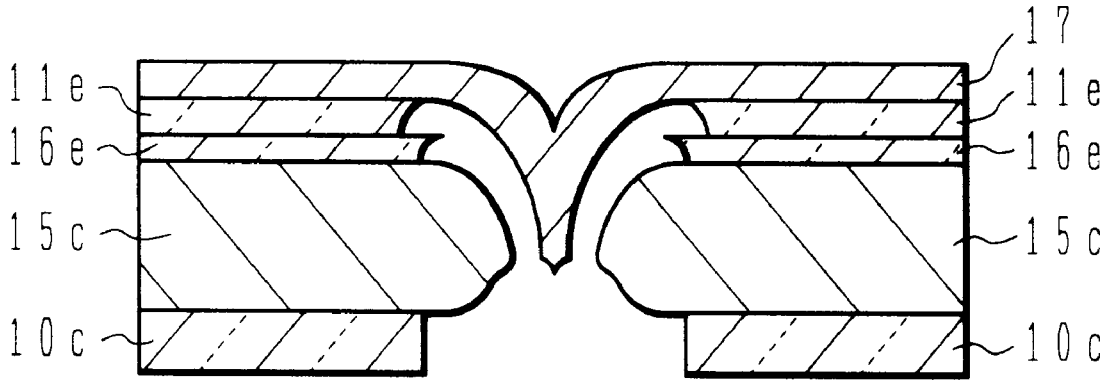
FIG. 21 is a diagram showing a two-electrode field emission element.

FIG. 21 is a diagram illustrate the method of manufacturing a two-electrode element. First, an element shown in FIG. 20E is formed by the above described processes. Thereafter, the substrate 10*d*, reacted film 16*c*, and reaction preventing film 11*a* are etched to leave a reaction preventing film lie and a reacted film 16*e* such as shown in FIG. 21 to thereby expose the tip of the emitter 17.

If the first sacrificial film 15*c* is made of conductive polysilicon or amorphous silicon, the first sacrificial film 15*c*, which is unreacted, can be used as a gate electrode. The two-electrode element has two electrodes—the emitter electrode 17 and gate electrode 15*c*. The reacted film 16*e* and reaction preventing film lie electrically isolate the emitter electrode 17 and gate electrode 15*c*. Since the insulating film has a two-layer structure, the dielectric breakdown voltage can be improved, because a probability of a presence of pin hole or weak spot at the same area of the two layers is a product of two probabilities of the two layer. The reaction preventing film lie may be made of conductive material. The lamination film 10*c* may be removed by etching.

The manufacture method of a two-electrode element has been described. Next, a manufacture method of another type of a field emission element of a three-electrode element will be described.

Figure 22A:
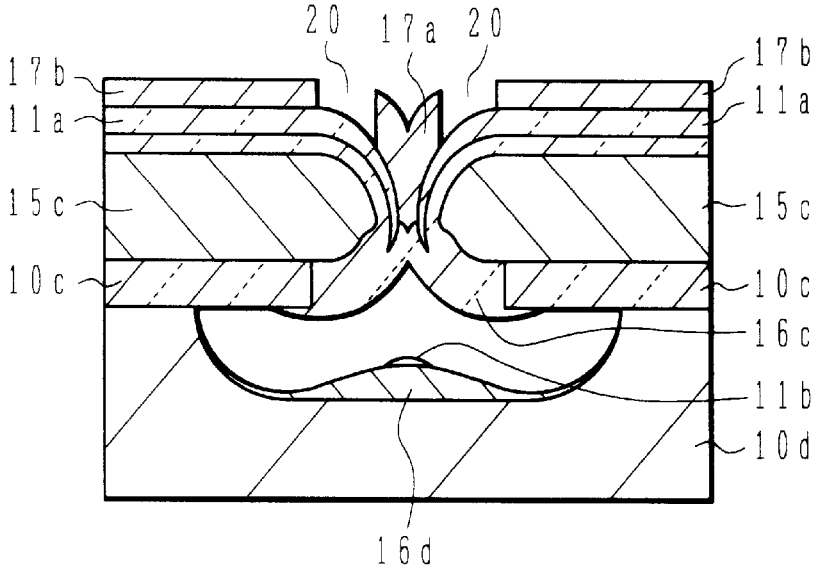
FIGS. 22A and 22B are diagrams illustrating the manufacture steps of a three-electrode field emission element.
Figure 22B:
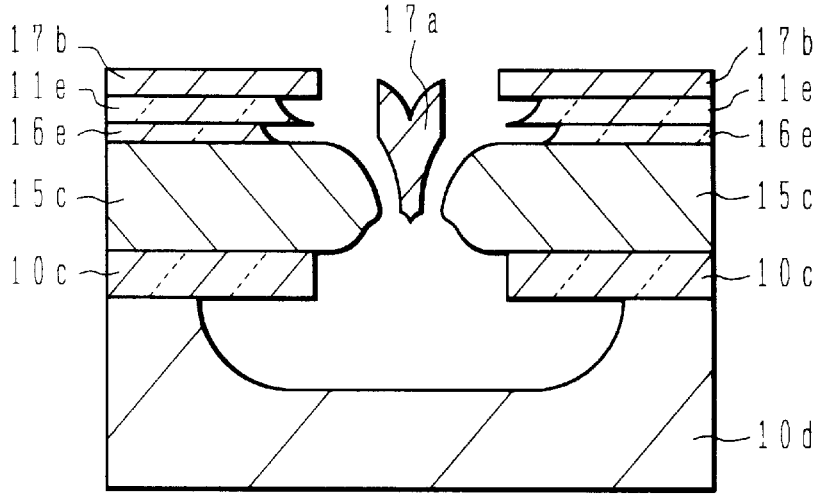

FIGS. 22A and 22B are diagrams illustrating a method of manufacturing a three-electrode element.

First, the element shown in FIG. 20E is manufactured by the previously described processes. Thereafter, as shown in FIG. 22A, a resist film having a predetermined pattern (not shown) is formed on the emitter electrode 17. By using this resist pattern as a mask, slit openings 20 are formed on both sides of an emitter electrode 17*a* by RIE using $Cl_2$ containing etchant. An emitter electrode 17*b* is formed at the outer sides of the slit openings 20. The diameter of the emitter electrode 17*a* is about 0.3 μm, and the depth of the slit openings 20 is about 0.2 μm.

Next, as shown in FIG. 22B, the reaction preventing film 11*a* and reacted film 16*c* are wet etched to leave a reaction preventing film 11*e* and a reacted film 16*e*, so that the emitter electrode 17*a*, gate electrode 15*c*, and anode electrode 10*d* are exposed.

In the fourth embodiment, the second sacrificial film is formed on the surface of the first sacrificial film by CVD. Next, instead of CVD, oxidation process is used for forming the second sacrificial film on the surface of the first sacrificial film.

FIGS. 23A to 23F are diagrams illustrating the manufacture steps of a field emission element according to the fifth embodiment of the invention. In the following, the manufacture steps of an emitter constituting a field emission element will be described.

Figure 23A:
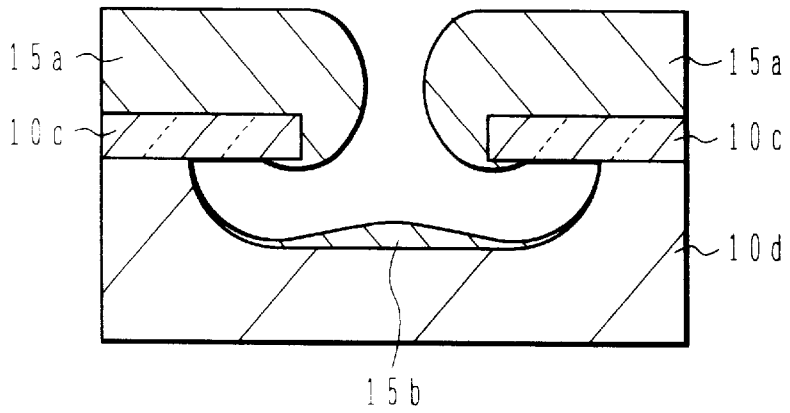
FIGS. 23A to 23F are diagrams illustrating the manufacture steps of a field emission element according to a fifth embodiment of the invention.

FIG. 23A illustrates the manufacture step after the steps of FIGS. 1A to 1C. As shown in FIG. 23A, a first sacrificial film 15*a* made of, for example, polysilicon is anisotropically deposited by CVD on the lamination film 10*c* with two parts. At the same time, a first sacrificial film 15*b* is also deposited through an opening on the substrate 10*d* at the bottom of the hole 12*a*.

The first sacrificial film 15*a* is deposited uniformly thick on the upper surface of the lamination film 10*c*, and thin on the lower surface thereof. The two parts of the first sacrificial film 15*a* are maintained.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used in place of CVD.

Figure 23B:
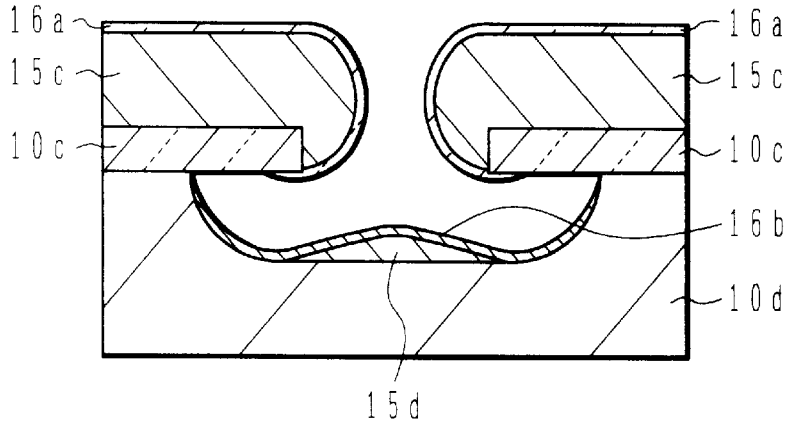

Next, as shown in FIG. 23B, the first sacrificial film 15*c* is oxidized by wet oxidation to uniformly form a second sacrificial film 16*a* made of, for example, $SiO_2$ on the surface of the first sacrificial film 15*c*. A second sacrificial film 16*b* is also formed on the surface of the substrate 10*d*.

For example, wet oxidation is performed by using a vertical furnace under the conditions of a furnace temperature of 850° C., a supply of $H_2$ gas at 30000 cc/min, and a supply of $O_2$ gas at 20000 cc/min.

Figure 23C:
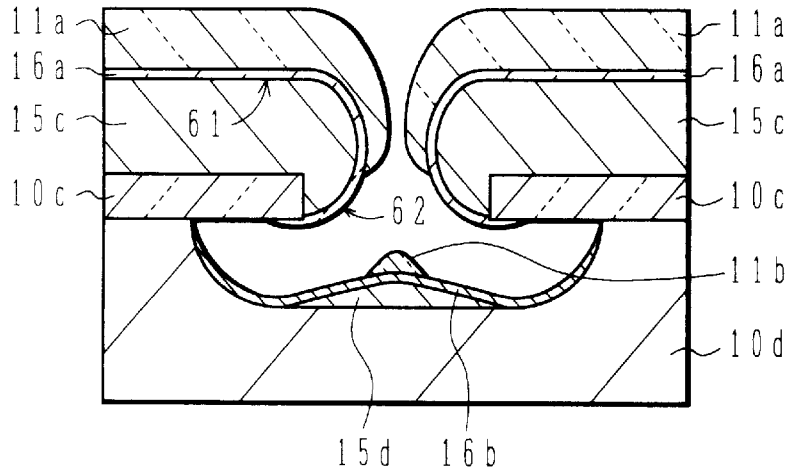

As shown in FIG. 23C, a reaction preventing film 11*a* made of, for example, $SiN_x$, is anisotropically deposited on the second sacrificial film 16*a*. The reaction preventing film 11*a* is deposited on the upper surface and the upper side surface of the overhang portion with the two parts, and not deposited on the lower surface and the lower side surface thereof. A reaction preventing film 11*b* is also deposited on the second sacrificial film 16*b*. The reaction preventing films 11*a* and 11*b* have a function of preventing oxidation reaction.

The reaction preventing film 11*a* may be deposited thick. The reaction preventing film 11*a* is thereafter isotropically wet etched by a uniform amount from the surface thereof to obtain a desired thickness distribution. The reaction preventing film on the lower surface of the overhang portion, if any, can be reliably removed.

The surface of the first sacrificial film 15*c* has two regions 61 and 62. The region 61 is covered with the reaction preventing film 11*a* and second sacrificial film 16*a*, and positioned at the upper area of the overhang portion. The region 62 is covered with only the second sacrificial film 16*a*, and positioned at the lower area of the overhang portion.

Next, the first sacrificial film 15*c* is oxidized by wet oxidation. The region 61 of the first sacrificial film 15*c* is covered with the reaction preventing film 11*a* so that the oxidation reaction is prevented, whereas the region 62 is not covered with the reaction preventing film 11*a* 3 so that the oxidation reaction progresses.

However, since the region 62 is covered with the second sacrificial film 16*a*, the oxidation speed is lowered depending upon the thickness of the second sacrificial film 16*a*. The thicker the second sacrificial film 16*a*, the faster the oxidation speed.

The second sacrificial film 16*a* controls not only the reaction of the first sacrificial film 15*c*, but also has a function of a buffer layer between the reaction preventing film 11*a* and first sacrificial film 15*c* similar to the fourth embodiment.

Figure 23D:
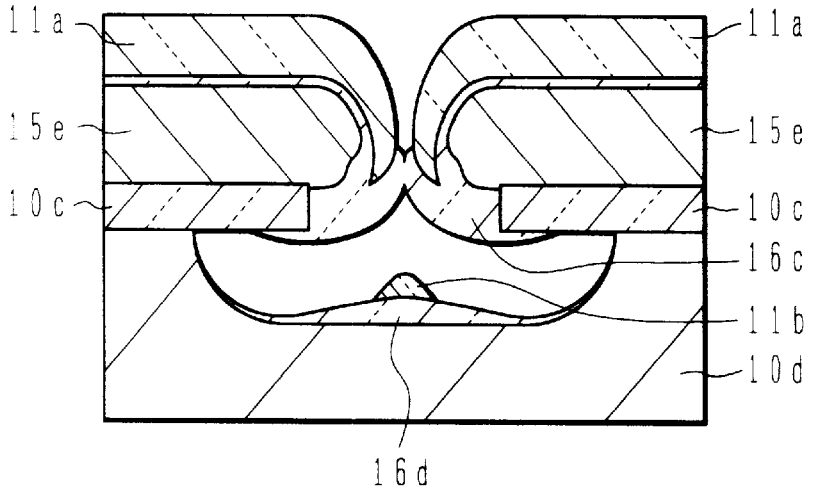

As the oxidation process proceeds, the volume of the region 62 of the first sacrificial film not covered with the reaction preventing film 11*a* expand. As the volume of the region 62 expands, the two parts of the overhang portion at the lower side surface connect each other. A reacted film 16*c* with the connected two parts is shown in FIG. 23D. When the two parts are connected each other, the oxidation reaction is stopped. The reacted film 16*c* is formed when the two parts of the overhang portion contact each other. A sharp cusp portion is formed at this contact area.

As the first sacrificial film 15*c* (FIG. 23C) is oxidized, it becomes $SiO_2$ and is integrated with the same material $SiO_2$ of the second sacrificial film 16*a* to thereby form the reacted film 16*c* ($SiO_2$) shown in FIG. 23D. The first sacrificial film is not completely oxidized, but the first sacrificial film 15*c* shown in FIG. 23D is left. A reacted film 16*d* is also formed on the substrate 10*d* during the oxidation reaction.

The cusp portion formed by the reacted film 16*c* and reaction preventing film 11*a* has a shape of two-stage curves. The first curve is formed by the mold of the reaction preventing film 11*a*, and the second curve is formed by the mold of the reacted film 16*c*. The cusp portion formed by the reacted film has a sharp acute angle having a cross section like two contacted circles or ellipses. By using this cusp portion as a mold, a two-stage type emitter electrode is formed.

Figure 23E:
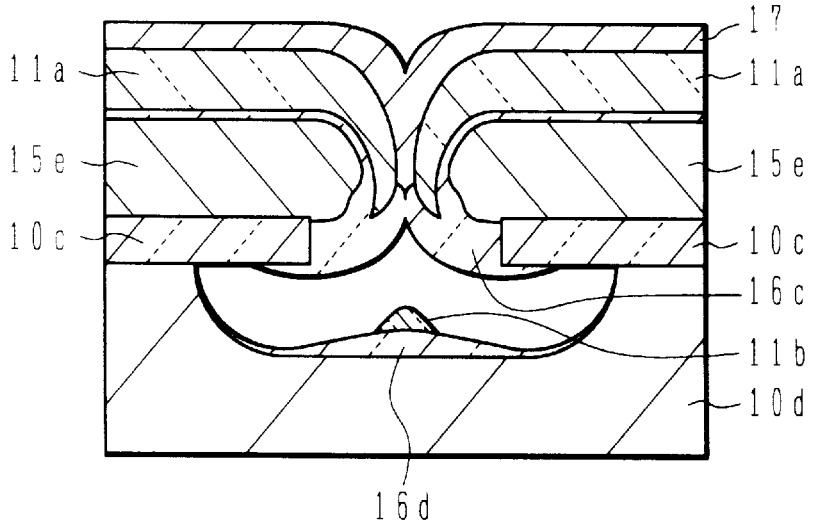

As shown in FIG. 23E, an emitter electrode 17 made of, for example, TiN is deposited on the reaction preventing film 11*a* and reacted film 16*c* about 0.2 μm by reactive sputtering. The emitter electrode 17 may be made of Mo, Cr, Ti, or W, instead of TiN. CVD instead of sputtering may be used.

Figure 23F:
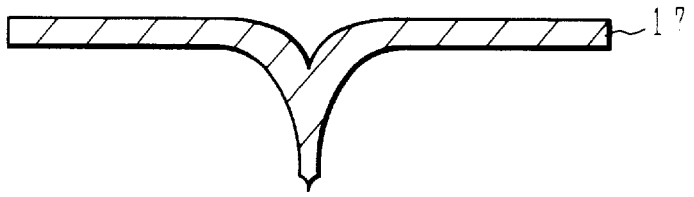

As shown in FIG. 23F, the substrate 10*d*, reacted film 16*c*, and reaction preventing film 11*a* are wet etched to expose the emitter electrode 17. The emitter electrode 17 is preferably reinforced by the methods illustrated in FIGS. 2A to 2C, because it is thin.

In the fifth embodiment, in forming the emitter electrode 17 of the two-stage type, the second sacrificial film is formed uniformly on the surface of the first sacrificial film by oxidation reaction, and thereafter the reaction preventing film is formed. With the emitter electrode of the two-stage type, the apex angle and radius of curvature of the tip of can be easily made smaller. Even if the mold having a small apex angle and radius of curvature is used, emitter material can be easily filled in the cusp portion of the mold so that the relative position between the emitter electrode 17 and gate electrode 15*c* can be determined precisely. If the apex angle and radius of curvature of the emitter electrode are made small, electric field can be easily concentrated on the emitter electrode 17 so that the product uniformity, reproductivity, and performance of field emission elements can be improved.

The emitter electrode manufacture methods have been described so far. Next, a method of manufacturing another type of a field emission element of a two-electrode element will be described.

Figure 24:
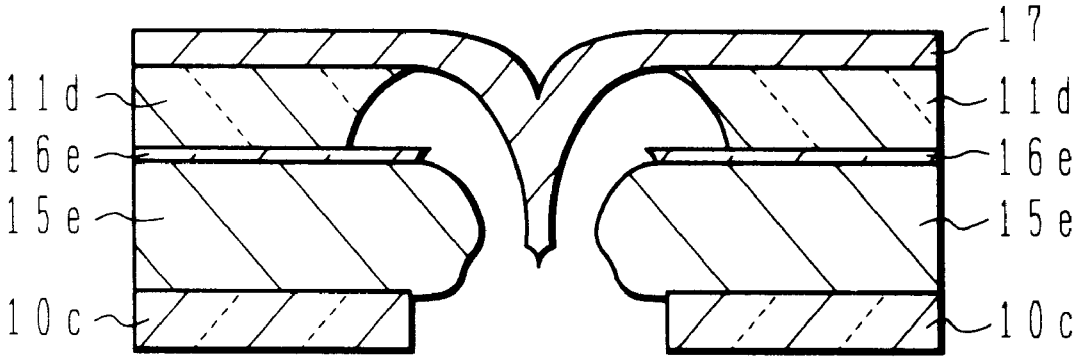
FIG. 24 is a diagram showing a two-electrode field emission element.

FIG. 24 is a diagram illustrate the method of manufacturing a two-electrode element. First, an element shown in FIG. 23E is formed by the above described processes. Thereafter, the substrate 10*d*, reacted film 16*c*, and reaction preventing film 11*a* are etched to leave a reaction preventing film 11*d* and a reacted film 16*e* such as shown in FIG. 24 to thereby expose the tip of the emitter 17.

If the first sacrificial film 15*e* is made of conductive polysilicon or amorphous silicon, the first sacrificial film 15*e*, which is unreacted, can be used as a gate electrode. The two-electrode element has two electrodes—the emitter electrode 17 and gate electrode 15*e*. The reacted film 16*e* and reaction preventing film 11*d* electrically isolate the emitter electrode 17 and gate electrode 15*e*. Since the insulating film has a two-layer structure, the dielectric breakdown voltage can be improved, because a probability of a presence of pin hole or weak spot at the same area of the two layers is a product of two probabilities of the two layer. The reaction preventing film 11*d* may be made of conductive material. The lamination film 10*c* may be removed by etching.

The manufacture method of a two-electrode element has been described. Next, a manufacture method of another type of a field emission element of a three-electrode element will be described.

Figure 25A:
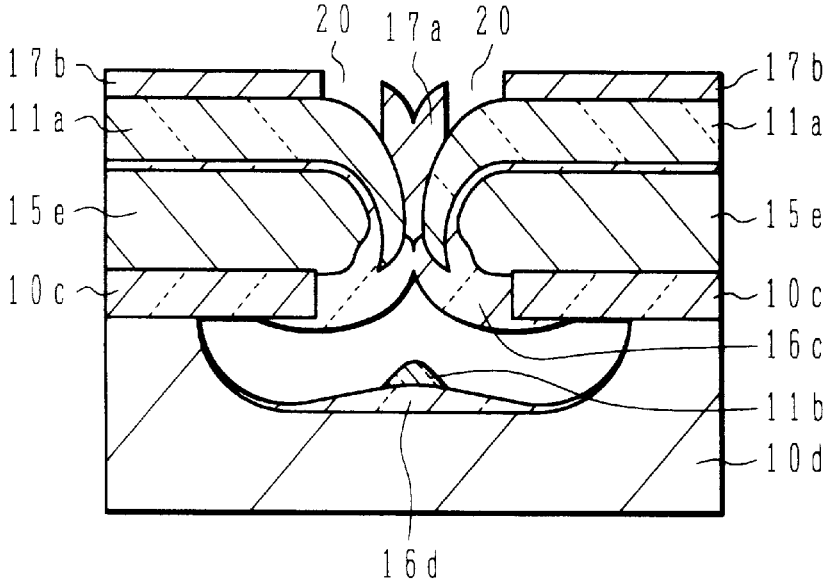
FIGS. 25A and 25B are diagrams illustrating the manufacture steps of a three-electrode field emission element.
Figure 25B:
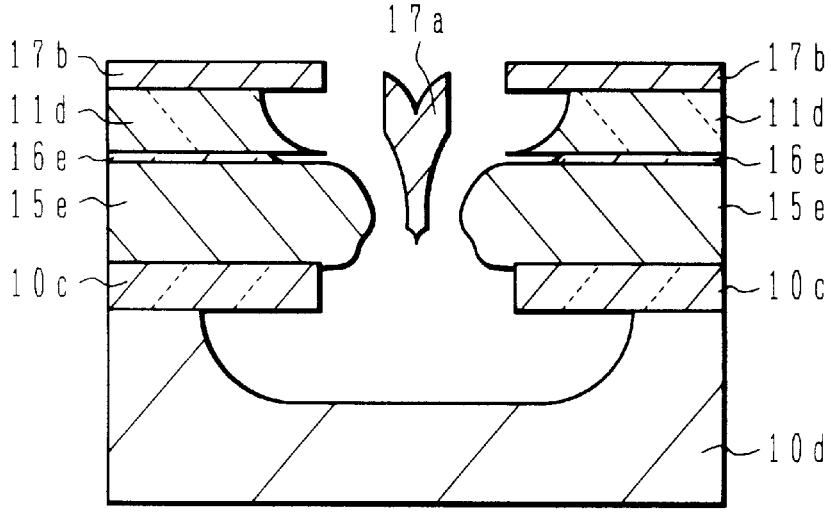

FIGS. 25A and 25B are diagrams illustrating a method of manufacturing a three-electrode element.

First, the element shown in FIG. 23E is manufactured by the previously described processes. Thereafter, as shown in FIG. 25A, a resist film having a predetermined pattern (not shown) is formed on the emitter electrode 17. By using this resist pattern as a mask, slit openings 20 are formed on both sides of an emitter electrode 17*a* by RIE using $Cl_2$ containing etchant. An emitter electrode 17*b* is formed at the outer sides of the slit openings 20. The diameter of the emitter electrode 17*a* is about 0.3 $\mu$m, and the depth of the slit openings 20 is about 0.2 $\mu$m.

Next, as shown in FIG. 25B, the reaction preventing film 11*a* and reacted film 16*c* are wet etched to leave a reaction preventing film 11*d* and a reacted film 16*e*, so that the emitter electrode 17*a*, gate electrode 15*e*, and anode electrode 10*d* are exposed.

In the fourth and fifth embodiments, the second sacrificial film and reaction preventing film are formed on the surface of the first sacrificial film, and thereafter oxidation reaction is performed. Next, another method will be described in which the reaction preventing film is formed on the first sacrificial film, oxidation reaction is performed, and then an insulating film is formed on the surface of an emitter electrode forming mold.

FIGS. 26A to 26F are diagrams illustrating the manufacture steps of a field emission element according to the sixth embodiment of the invention. In the following, the manufacture steps of an emitter constituting a field emission element will be described.

Figure 26A:
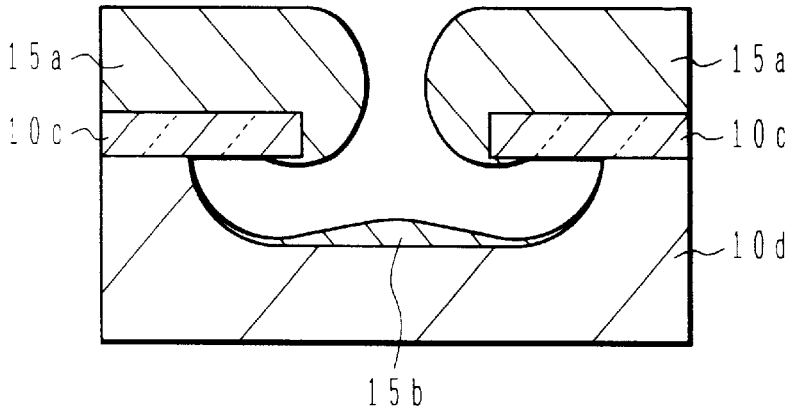
FIGS. 26A to 26F are diagrams illustrating the manufacture steps of a field emission element according to a sixth embodiment of the invention.

FIG. 26A illustrates the manufacture step after the steps of FIGS. 1A to 1C. As shown in FIG. 26A, a first sacrificial film 15*a* made of, for example, polysilicon is anisotropically deposited by CVD on the lamination film 10*c* with two parts. At the same time, a first sacrificial film 15*b* is also deposited through an opening on the substrate 10*d* at the bottom of the hole 12*a*.

The first sacrificial film 15*a* is deposited uniformly thick on the upper surface of the lamination film 10*c*, and thin on the lower surface thereof. The two parts of the first sacrificial film 15*a* are maintained.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used in place of CVD.

Figure 26B:
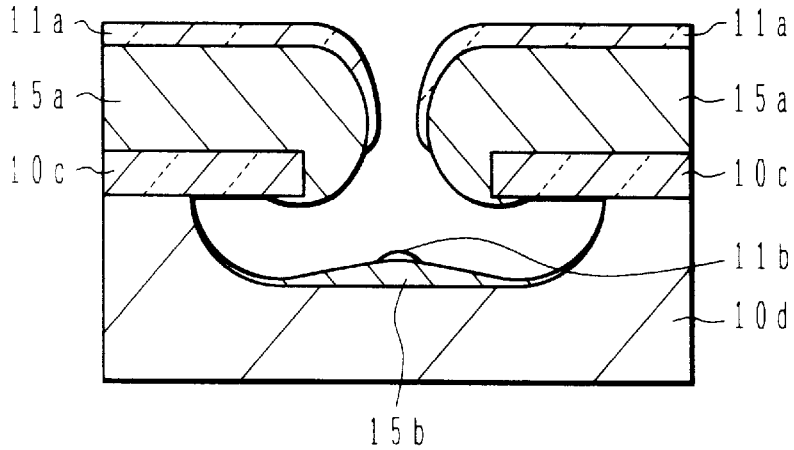

Next, as shown in FIG. 26B, a reaction preventing film 11*a* made of, for example, $SiN_x$ is anisotropically deposited on the first sacrificial film 15*a*. The reaction preventing film 11*a* is deposited on the upper surface and the upper side surface of the overhang portion (first sacrificial film 15*a*), and not deposited on the lower surface and the lower side surface thereof. A reaction preventing film 11*b* is also deposited on the first sacrificial film 15*b*. The reaction preventing films 11*a* and 11*b* have a function of preventing oxidation reaction.

The reaction preventing film 11*a* may be deposited thick. The reaction preventing film 11*a* is thereafter isotropically wet etched by a uniform amount from the surface thereof to obtain a desired thickness distribution. The reaction preventing film on the lower surface of the overhang portion, if any, can be reliably removed.

Next, by using the reaction preventing film 11*a* as a mask, the exposed portion of the first sacrificial film 15*a* is oxidized by wet oxidation. The upper surface and the upper side surface of the first sacrificial film 15*a* are covered with the reaction preventing film 11*a*, and the lower surface and the lower side surface thereof are not covered with the first reaction preventing film 11*a*. Oxidation reaction at the region covered with the reaction preventing film 11*a* is stopped, whereas it is progressed at the lower surface and the lower side surface of the overhang portion to effect volume expansion.

Figure 26C:
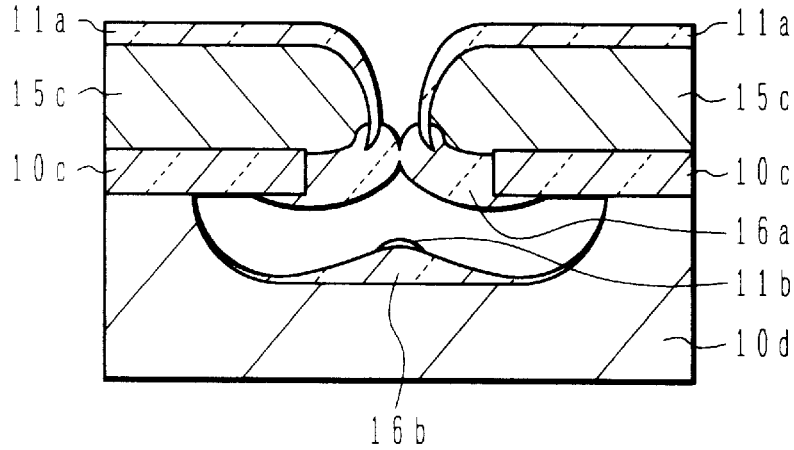

Oxidation process continues until the two parts of the overhang portion are connected each other by the volume expansion at the lower regions of the overhang portion. As the first sacrificial film 15*a* is oxidized, a reacted film 16*a* of $SiO_2$ such as shown in FIG. 26C is formed. The reacted film 16*a* connects the two parts of the overhang portion.

The first sacrificial film is not completely oxidized, but the first sacrificial film 15*c* shown in FIG. 26C is left. A reacted film 16*b* is also formed on the substrate 10*d* during the oxidation reaction.

The cusp portion formed by the reacted film 16*a* and reaction preventing film 11*a* has a shape of two-stage curves. The first curve is formed by the mold of the reaction preventing film 11*a*, and the second curve is formed by the mold of the reacted film 16*a*. The cusp portion formed by the reacted film 16*a* has a sharp acute angle having a cross section like two contacted circles or ellipses.

Figure 26D:
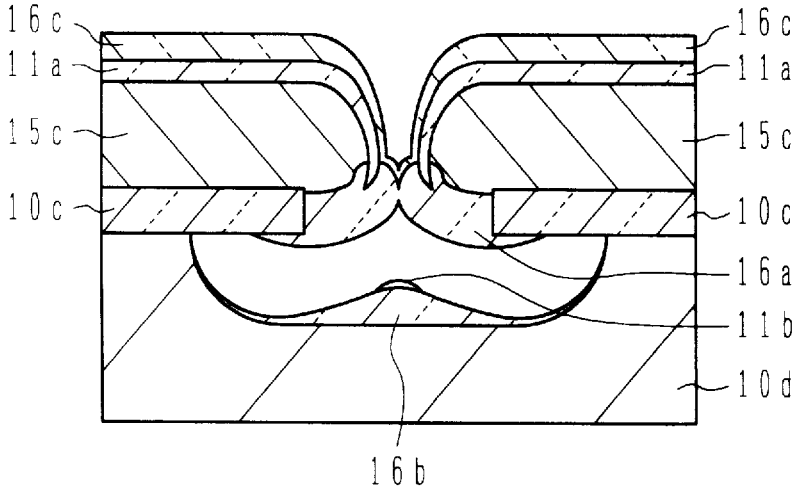

Next, as shown in FIG. 26D, an insulating film 16*c* made of, for example, $SiO_2$ is isotropically deposited on the surface of the cusp portion formed by the reaction preventing film 11*a* and reacted film 16*a*. The insulating film 16*c* has a shape conformal to the shape of the cusp portion formed by the two-stage curves.

This insulating film 16*c* serves to adjust the shape of the cusp portion, i.e., the shape of an emitter electrode forming mold. For example, it can adjust the height and width of the emitter electrode.

The reacted film 16*a* is not necessarily required to connect the two parts of the overhang. Even if the reacted film 16*a* is separated to have two parts, the insulating film 16*c* can fill the gap between the two parts of the reacted film 16*a*.

Namely, at the process of FIG. 26C, the oxidation reaction may be stopped immediately before the two parts of the overhang connect each other. It is sufficient if the two parts of the overhang portion at the lower side surface are expanded in volume to form two projected portions. With these projected portions and the insulating film, the cusp portion of the two-stage type can be formed.

By using this cusp portion of the insulating film 16*c* as a mold, a two-stage type emitter electrode is formed.

Figure 26E:
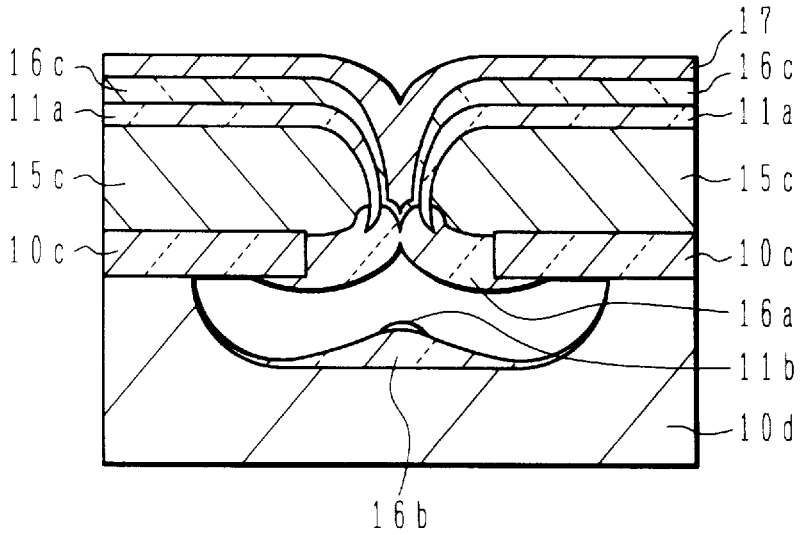

As shown in FIG. 26E, an emitter electrode 17 made of, for example, TiN is deposited on the insulating film 16*c* about 0.2 $\mu$m by reactive sputtering. The emitter electrode 17 may be made of Mo, Cr, Ti, or W, instead of TiN. CVD or evaporation instead of sputtering may be used.

Figure 26F:
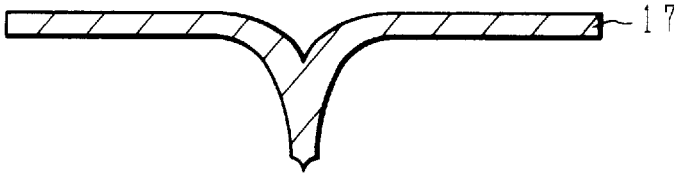

As shown in FIG. 26F, the insulating film 16*c* is wet etched to expose the emitter electrode 17. The emitter electrode 17 is preferably reinforced by the methods illustrated in FIGS. 2A to 2C, because it is thin.

In the sixth embodiment, in forming the emitter electrode 17 of the two-stage type, the first sacrificial film is oxidized to form the emitter electrode forming mold by using the reaction preventing film as a mask, and thereafter the insulating film is deposited on the surface of this mold. With the emitter electrode of the two-stage type, the apex angle and radius of curvature of the tip of can be easily made smaller. Even if the mold having a small apex angle and radius of curvature is used, emitter material can be easily filled in the cusp portion of the mold so that the relative position between the emitter electrode 17 and gate electrode 15*c* can be determined precisely. If the apex angle and radius of curvature of the emitter electrode are made small, electric field can be easily concentrated on the emitter electrode 17 so that the product uniformity, reproductivity, and performance of field emission elements can be improved.

The emitter electrode manufacture methods have been described so far. Next, a method of manufacturing another type of a field emission element of a two-electrode element will be described.

Figure 27:
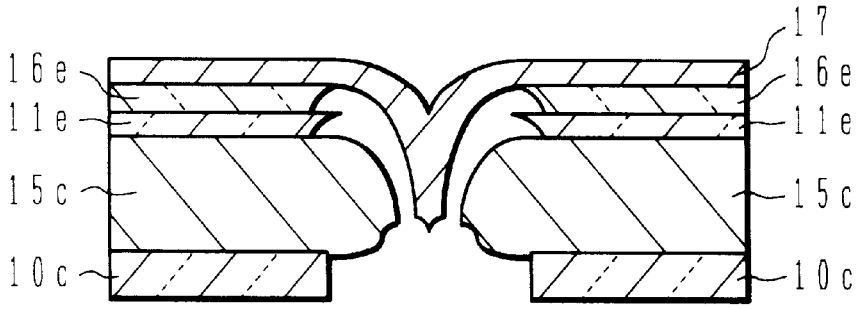
FIG. 27 is a diagram showing a two-electrode field emission element.

FIG. 27 is a diagram illustrate the method of manufacturing a two-electrode element. First, an element shown in FIG. 26E is formed by the above described processes. Thereafter, the substrate 10*d*, reacted film 16*a*, reaction preventing film 11*a*, and insulating film 16*c* are etched to leave an insulating film 16*e* and a reaction preventing film 11*e* such as shown in FIG. 27 to thereby expose the tip of the emitter 17.

If the first sacrificial film 15*c* is made of conductive polysilicon or amorphous silicon, the first sacrificial film 15*c*, which is unreacted, can be used as a gate electrode. The two-electrode element has two electrodes—the emitter electrode 17 and gate electrode 15*c*. The insulating film 16*e* and reaction preventing film 11*e* electrically isolate the emitter electrode 17 and gate electrode 15*c*. The reaction preventing film 11*e* may be made of conductive material. The lamination film 10*c* may be removed by etching.

Figure 28:
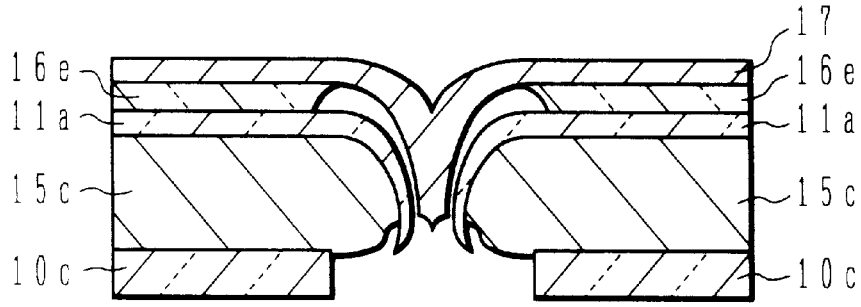
FIG. 28 is a diagram showing another two-electrode field emission element.

FIG. 28 shows another example of the two-electrode element. In this two-electrode element, the reaction preventing film 11*a* is left unetched, whereas in the two-electrode element shown in FIG. 27, part of the reaction preventing film 11*e* is left. Namely, only the insulation film ($SiO_2$) is etched and the reaction preventing film ($SiN_x$) is not etched. Therefore, part of the insulating film 16*e* and the whole of the reaction preventing film 11*a* are left.

The reaction preventing film 11*a* is located between the emitter electrode 17 and the gate electrode 15*c* to prevent leak current from flowing between the emitter electrode 17 and the gate electrode 15*c*. The two-electrode element shown in FIG. 27 has a drawback that if foreign dielectric substance is captured between the emitter electrode 17 and gate electrode 15*c*, leak current is likely to flow between the emitter electrode 17 and the gate electrode 15*c*. Such a drawback is not associated with the two-electrode element shown in FIG. 28. By leaving the reaction preventing film 11*a* having a dielectric constant larger than a vacuum dielectric constant of 1 on the gate electrode 15*c*, the equipotential surface (line) can be set to the proximity of the emitter electrode 17 so that the electric field at the emitter electrode tip becomes strong.

The manufacture method of a two-electrode element has been described. Next, a manufacture method of another type of a field emission element of a three-electrode element will be described.

Figure 29A:
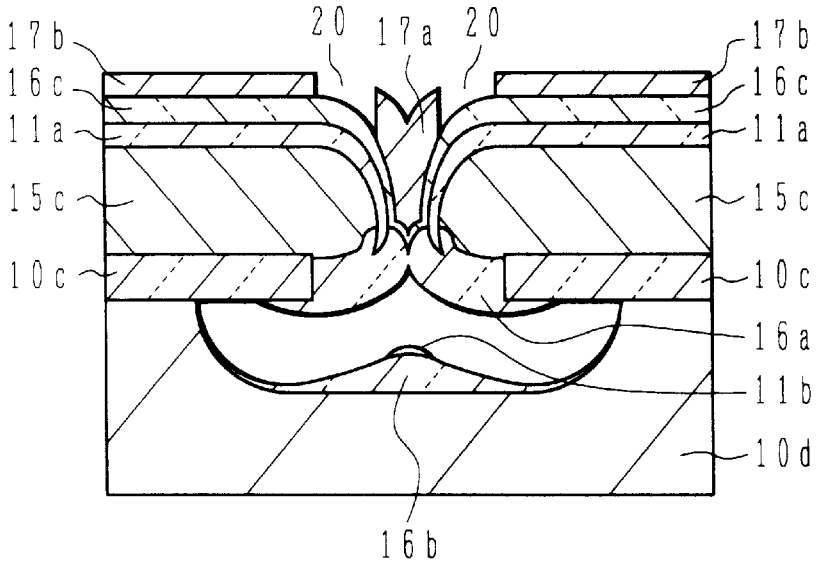
FIGS. 29A and 29B are diagrams illustrating the manufacture steps of a three-electrode field emission element.
Figure 29B:
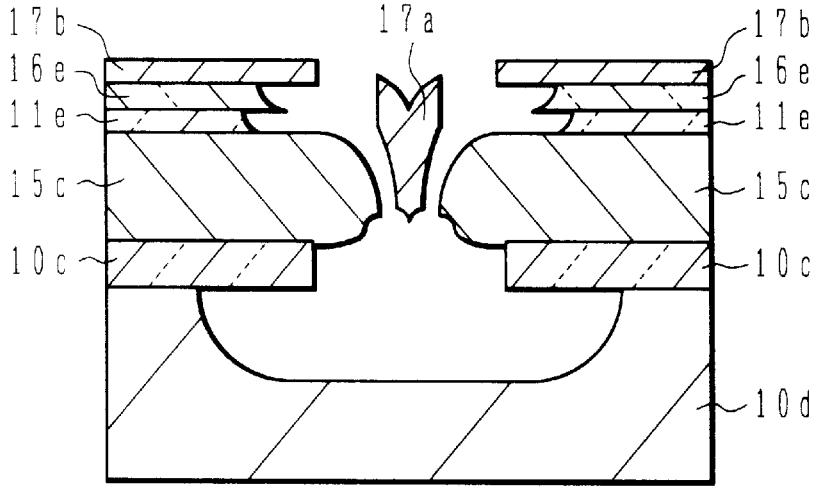

FIGS. 29A and 29B are diagrams illustrating a method of manufacturing a three-electrode element.

First, the element shown in FIG. 26E is manufactured by the previously described processes. Thereafter, as shown in FIG. 29A, a resist film having a predetermined pattern (not shown) is formed on the emitter electrode 17. By using this resist pattern as a mask, slit openings 20 are formed on both sides of an emitter electrode 17*a* by RIE using $Cl_2$ containing etchant. An emitter electrode 17*b* is formed at the outer sides of the slit openings 20. The diameter of the emitter electrode 17*a* is about 0.3 $\mu$m, and the depth of the slit openings 20 is about 0.2 $\mu$m.

Next, as shown in FIG. 29B, the insulating film 16*c* and reaction preventing film 11*a* are wet etched to leave an insulating film 16*e* and a reaction preventing film 11*e*, so that the emitter electrode 17*a*, gate electrode 15*c*, and anode electrode 10*d* are exposed.

FIGS. 30A to 30I are diagrams illustrating the manufacture steps of a field emission element according to the seventh embodiment of the invention. In the following, the manufacture steps of an emitter (cathode) constituting a field emission element will be described.

Figure 30A:
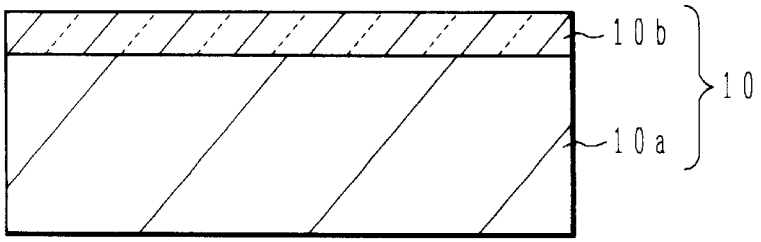
FIGS. 30A to 30I are diagrams illustrating the manufacture steps of a field emission element according to a seventh embodiment of the invention.
Figure 30B:
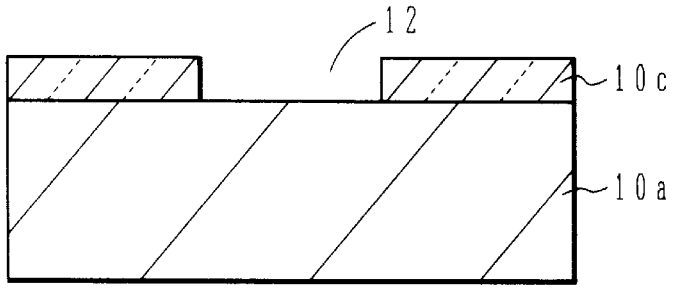

As shown in FIG. 30A, a substrate 10 is structured by a starting substrate 10*a* and a lamination film 10*b* of about 140 nm thick stacked upon the starting substrate 10*a*. For example, the starting substrate 10*a* is made of Si, and the lamination film 10*b* is made of $SiN_x$.

The lamination film 10*b* may be made of $SiO_2$ instead of $SiN_x$. The starting substrate 10*a* may be made of Al. If Al is used, the lamination film 10*b* is made of $AlN_x$, $Al_2O_3$, or the like. In the following, it is assumed that the starting substrate 10*a* is made of Si and the lamination film 10*b* is made of $SiN_x$.

A resist film having a predetermined pattern is formed on the lamination film 10*b*. By using the resist pattern as a mask, the lamination film 10*b* is selectively etched to form a hole 12 shown in FIG. 30B in the lamination film 10*b* so that a surface of the starting substrate 10*a* is exposed from an aperture of the hole 12. A lamination film 10*c* having two opposing parts in cross section is therefore formed. The above selective etching is performed by RIE using $SF_6$ containing etching gas. The hole 12 has a diameter of about 0.5 $\mu$m and a depth of about 140 nm.

Figure 30C:
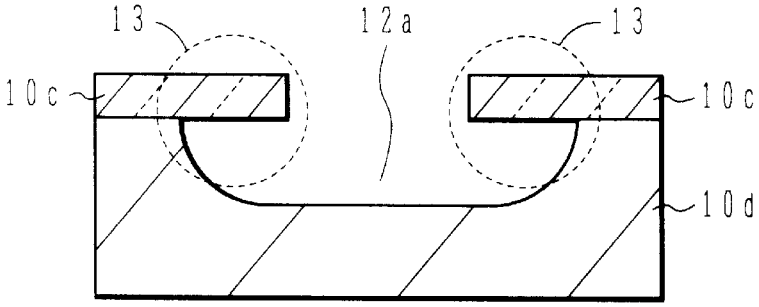

As shown in FIG. 30C, by using the lamination film 10*c* as an etching mask, the starting substrate 10*a* is wet etched to form a hole 12*a* in the starting substrate. A substrate 10*d* is therefore formed. The hole 12*a* forms a hollow space and has a diameter of about 1.5 $\mu$m and a depth of about 0.5 $\mu$m. Isotropical wet etching is performed through the hole 12 to etch the starting substrate 10*a* not only along the vertical direction of the substrate 10*a* but also along the horizontal direction in the cross-section of the starting substrate 10*a*. Therefore, the starting substrate 10*a* is etched partially at the underneath of the lamination film 10*c*. The lamination film 10*c* extends like a hood near at the hole 12*a*. As shown in FIG. 30C, an overhang portion 13 is therefore formed having two opposing parts in cross section separated along the horizontal direction of the substrate.

Figure 30D:
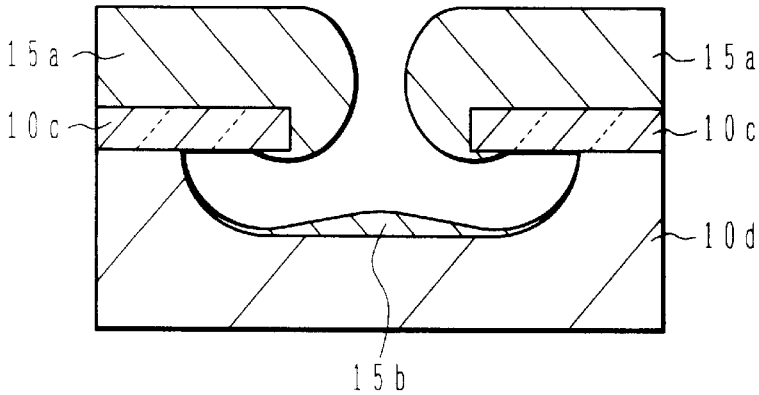

As shown in FIG. 30D, a first sacrificial film 15*a* made of, for example, polysilicon is deposited by CVD on the lamination film 10*c* with two parts. At the same time, a first sacrificial film 15*b* is also deposited through an opening on the substrate 10*d* at the bottom of the hole 12*a*.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used instead of CVD. For example, the first sacrificial films 15*a* and 15*b* of amorphous silicon may be formed by a DC sputtering system using, as a target, polysilicon which contains P or B. For example, sputtering is performed under the conditions of a power of 1 kW and an Ar gas pressure of 8 mTorr.

Figure 30E:
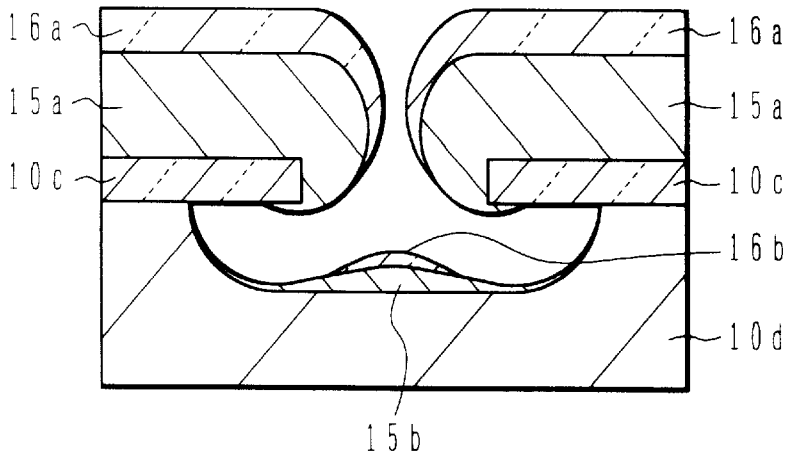

Next, as shown in FIG. 30E, second sacrificial films 16*a* and 16*b* made of, for example, $SiO_2$, are deposited by plasma CVD. The second sacrificial film 16*a* is isotropically deposited on the first sacrificial film 15*a* with the two parts. The bottom area of the overhang portion of the two parts is rarely deposited with the second sacrificial film 16*a*. The second sacrificial film 16*b* is deposited on the first sacrificial film 15*b*.

The second sacrificial films 16*a* and 16*b* may be made of $Al_2O_3$, $Ta_2O_5$, $MoO_x$, or $TiO_2$, in addition to $SiO_2$.

Figure 30F:
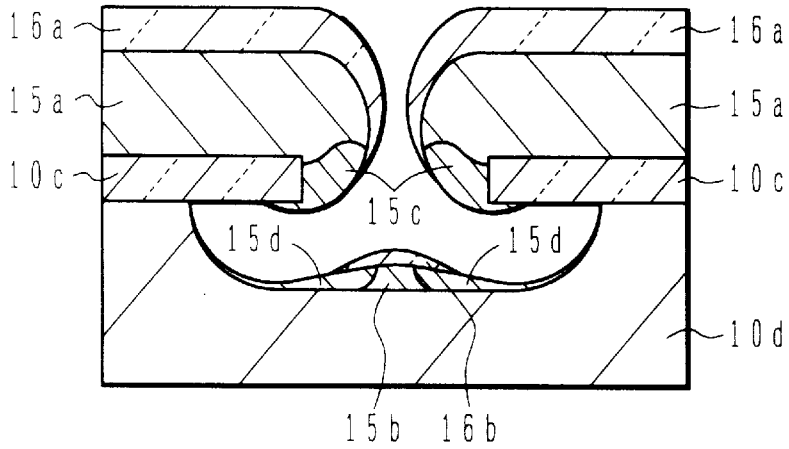

As shown in FIG. 30F, P ions are diffused partially into the first sacrificial films 15*a* and 15*b* by vapor phase thermal diffusion to form diffused regions 15*c* and 15*d*. The second sacrificial films serve as a mask for vapor phase thermal diffusion. P ions start diffusing from the regions not covered with the second sacrificial films 16*a* and 16*b*, while the second sacrificial films 16*a* and 16*b* function to stop impurity diffusion. The regions 15*c* and 15*d* are P-ion diffused regions. The diffused regions 15*c* is formed only on the bottom surface of the overhang, i.e., at the lower area thereof.

Vapor phase thermal diffusion may be performed under the conditions of a temperature of 850° C. and flow rates of 20 slm of $N_2$, 0.1 slm of $O_2$, and 0.05 g/min of $POCl_3$. Doped impurities may be B or As instead of P.

Figure 30G:
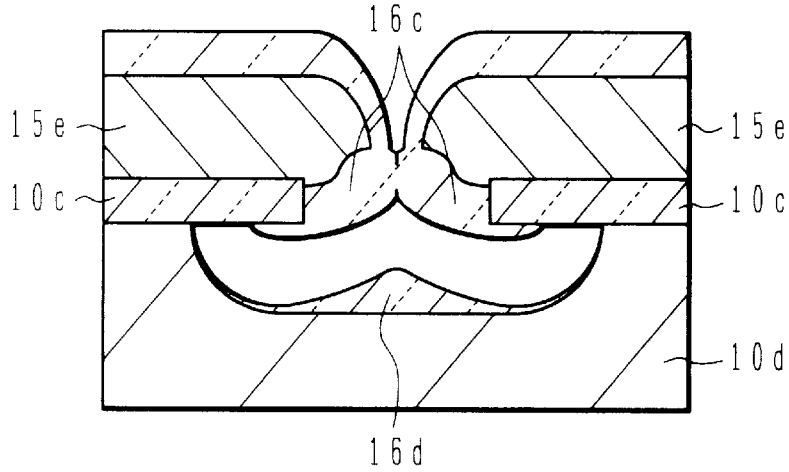

As shown in FIG. 30G, wet oxidation is performed to form a reacted film 16*c* on the surface of the overhang portion and a reacted film 16*d* on the substrate 10*d*. A first sacrificial film 15*e* is the first sacrificial film 15*a* shown in FIG. 30F and not oxidized.

For example, wet oxidation is performed by using a vertical furnace under the conditions of a furnace temperature of 850° C., a supply of $H_2$ gas at 30000 cc/min, and a supply of $O_2$ gas at 20000 cc/min. The reacted films 16*c* and 16*d* are made of $SiO_2$. If the first sacrificial films 15*a* and 15*b* are made of Al, the reacted films 16*c* and 16*d* are $Al_2O_3$.

In FIG. 30F, the surface of the overhang portion includes the second sacrificial film 16*a* and the diffused region 15*c*. The oxidation speed of the diffused region 15*c* of the first sacrificial film 15*a* is about two times faster than the other region of the first sacrificial film 15*a*. As a result, as shown in FIG. 30G, the volume of the overhang expands less at the upper area than at the lower area, and the two parts of the overhang become in contact with each other.

Since the reaction speed changed at the upper and lower areas of the overhang, the cusp portion formed at the contact area of the two parts has a shape of two-stage curves and can form an acute angle. This cusp portion has an acute angle area having a cross section like two contacted circles or ellipses. By using this cusp portion as a mold, an emitter electrode of the two-stage type is formed.

Figure 30H:
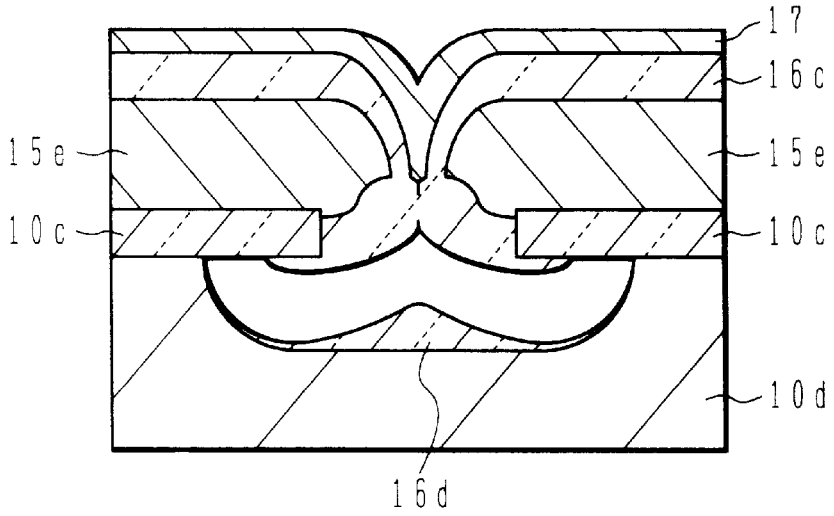

As shown in FIG. 30H, an emitter electrode 17 made of, for example, TiN is deposited on the reacted film 16*c* about 0.2 $\mu$m by reactive sputtering. For example, the reactive sputtering is performed by using a DC sputtering system under the conditions of a power of 5 kW, a pressure of 4 mTorr, a target of Ti, a supply of $N_2$ gas at 84 sccm, and a supply of Ar gas at 56 sccm. The emitter electrode 17 may be made of Mo, Cr, Ti, or W, instead of TiN. CVD or evaporation instead of sputtering may be used.

Figure 30I:
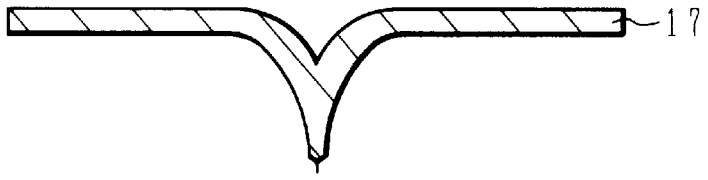

The substrate 10*d* is wet etched by $HF+HNO_3+H_2O$, and thereafter the reacted film 16*c* is wet etched by $HF+NH_4F$ to expose the tip of the emitter electrode as shown in FIG. 30I.

With the seventh embodiment, the emitter electrode 17 of the two-stage type can be formed. This emitter electrode may be reinforced by the methods illustrated in FIGS. 2A to 2C, because it is thin.

In the seventh embodiment, the process of forming the second sacrificial film 16*a* shown in FIG. 30E is important for determining the shape of the emitter electrode. The second sacrificial film 16*a* may be formed by the following method.

Figure 31A:
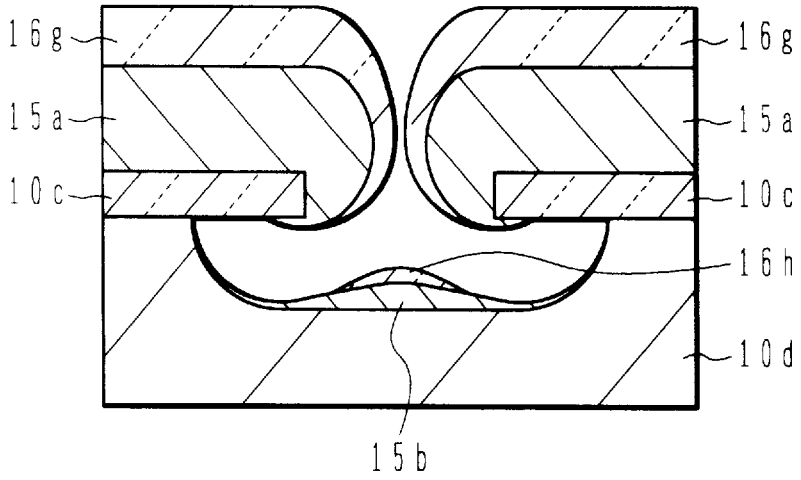
FIGS. 31A and 31B are diagrams illustrating another method of forming a second sacrificial film.
Figure 31B:
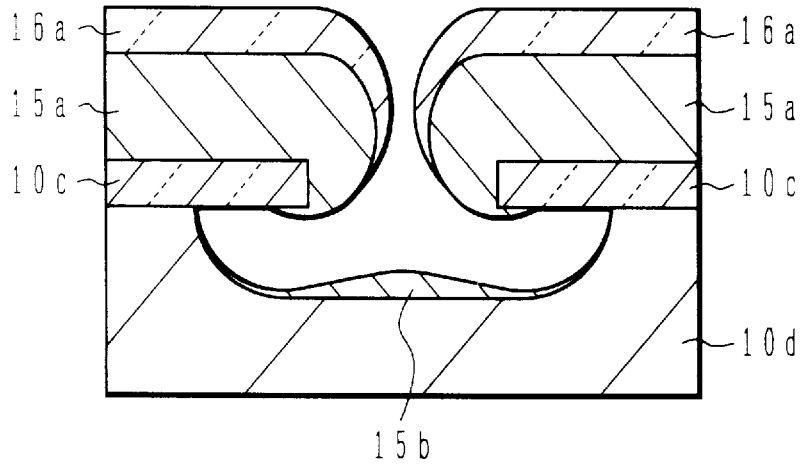

FIGS. 31A and 31B are diagrams illustrating another method of forming the second sacrificial film.

After the process illustrated in FIG. 30D, second sacrificial films 16*g* and 16*h* are deposited thick by plasma CVD or the like, as shown in FIG. 31A. The second sacrificial film 16*g* is controlled to have two parts.

Next, the surface of the second sacrificial film 16*g* is etched by a uniform amount by isotropic wet etching. Therefore, as shown in FIG. 31B, a desired thickness distribution of the second sacrificial film 16*a* can be obtained. The bottom area of the overhang portion of the second sacrificial film 16*a* can be made thin. Thereafter, the processes starting from FIG. 30F are executed.

Figure 32A:
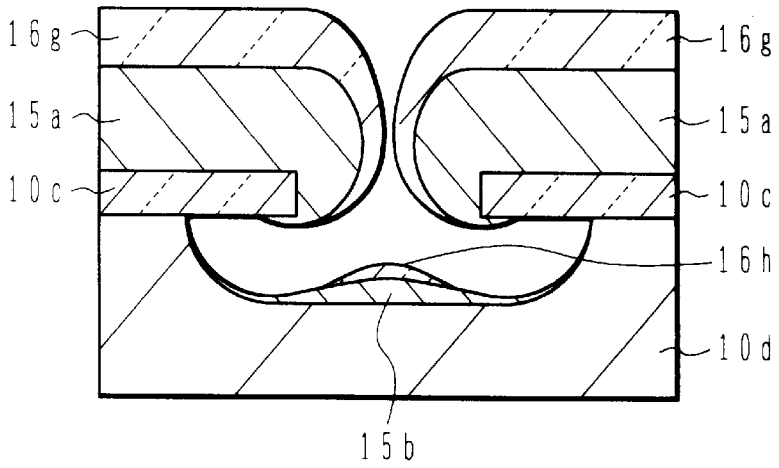
FIGS. 32A to 32C are diagrams illustrating another method of forming a second sacrificial film.
Figure 32B:
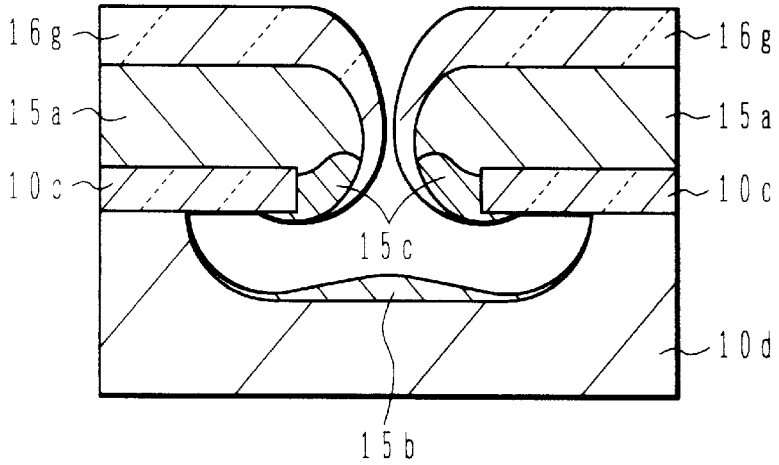
Figure 32C:
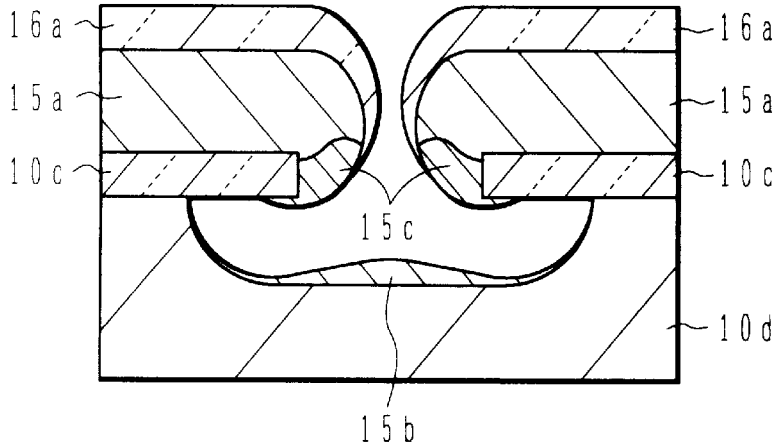

FIGS. 32A to 32C are diagrams illustrating a method of adjusting the thickness of the second sacrificial film after impurities are doped in the second sacrificial film.

As shown in FIG. 32A, after the process of FIG. 30D, second sacrificial films 16*g* and 16*h* are deposited thick by plasma CVD or the like. The second sacrificial film 16*g* is controlled to have two parts.

Next, as shown in FIG. 32B, P ions are diffused partially into the first sacrificial films 15*a* and 15*b* by thermal diffusion to form a diffused region 15*c*. P ions start diffusing from the region of the first sacrificial films 15*a* and 15*b* not covered or thinly covered with the second sacrificial films 16*g*. The region 15*c* is P-ion diffused region. The diffused regions 15*c* is formed only on the bottom surface of the overhang, i.e., at the lower area thereof.

Next, the surface of the second sacrificial film 16*a* is etched by a uniform amount by isotropic wet etching. Therefore, as shown in FIG. 32C, the second sacrificial film

16*g* is made thin at the bottom surface of the overhang portion, and maintained unchanged at the upper surface thereof. Thereafter, the processes starting from FIG. 30G are executed.

In the process illustrated in FIG. 30G, the reacted film 16*c* is formed by wet oxidation. Instead of wet oxidation, a reacted film 16*c* of $SiN_x$ may be formed by nitridation.

For example, nitridation is performed under the conditions of a temperature of 1050° C., an RF power of 10 kW, a pressure of 130 Pa, and a supply of $NH_3$ at 1 slm.

The emitter electrode manufacture methods have been described so far. Next, a method of manufacturing another type of a field emission element of a two-electrode element will be described.

Figure 33:
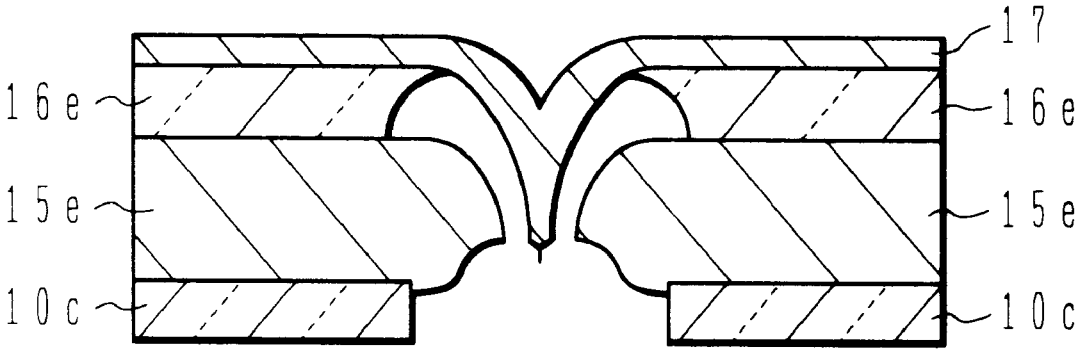
FIG. 33 is a diagram illustrating the manufacture steps of a two-electrode field emission element.

FIG. 33 is a diagram illustrate the method of manufacturing a two-electrode element. First, an element shown in FIG. 30H is formed by the above described processes. Thereafter, the substrate 10*d*, reacted film 16*d*, and part of the reacted film 16*c* are etched. By partially removing the reacted film 16*c* and leaving the reacted film 16*e* unetched as shown in FIG. 33, the tip of the emitter electrode 17 is exposed.

If the first sacrificial film 15*e* is made of conductive polysilicon or amorphous silicon, the first sacrificial film 15*e*, which is unreacted, can be used as a gate electrode. The two-electrode element has the emitter electrode 17 and gate electrode 15*c*. The reacted film 16*e* electrically isolates the emitter electrode 17 and gate electrode 15*e*. The lamination film 10*c* may be removed by etching.

The first sacrificial film 15*a* anisotropically deposited on the lamination film 10*c* as illustrated in FIG. 30D may be isotropically deposited. However, anisotropical deposition makes the diameter of a hole (gate hole) of the gate electrode small so that the electrical performance can be improved.

For example, if the gate electrode (first sacrificial film) of the two-electrode element shown in FIG. 33 is made thick, the diameter of the gate hole becomes small. In order to increase the thickness of the gate electrode (first sacrificial film), it is sufficient if the first sacrificial film 15*a* is anisotropically deposited. Anisotropical deposition of the first sacrificial film 15*a* can make the gate hole diameter small. Therefore, electrons can be emitted from the emitter even at a low gate-emitter voltage. Similar advantages are also obtained by a three-electrode element.

With isotropic deposition, the first sacrificial film 15*a* on the overhang portion and the first sacrificial film 15*b* on the substrate 10*d* become likely to be integrated together and the first sacrificial film 15*a* with two parts is difficult to form.

In the seventh embodiment, after the first sacrificial film is formed, impurities are diffused only into the lower region of the overhang portion, and oxidation or nitridation is performed to expand the volume of the overhang portion. The position of the tip of the emitter electrode can therefore be controlled more precisely than volume expansion using CVD, from the reasons already described above.

The two-electrode element has the emitter electrode 17 as a cathode and the gate electrode 15*c* as a control electrode. If the tip of the emitter electrode 17 is positioned properly, electrons can be emitted easily from the tip of the emitter electrode even at a low control voltage applied to the gate electrode.

In the seventh embodiment, even if the mold having a small apex angle and radius of curvature is used, emitter material can be easily filled in the cusp portion of the mold so that the relative position between the emitter electrode 17 of the two-stage type and gate electrode 15*c* can be determined precisely. Since the apex angle and radius of curvature of the emitter electrode can be made small, the product uniformity, reproductivity, and performance of field emission elements can be improved.

The two-electrode element may be reinforced by a support plate 18 by the methods illustrated in FIGS. 6A to 6C.

The manufacture method of a two-electrode element has been described above. Next, a manufacture method of another type of a field emission element of a three-electrode element will be described.

Figure 34A:
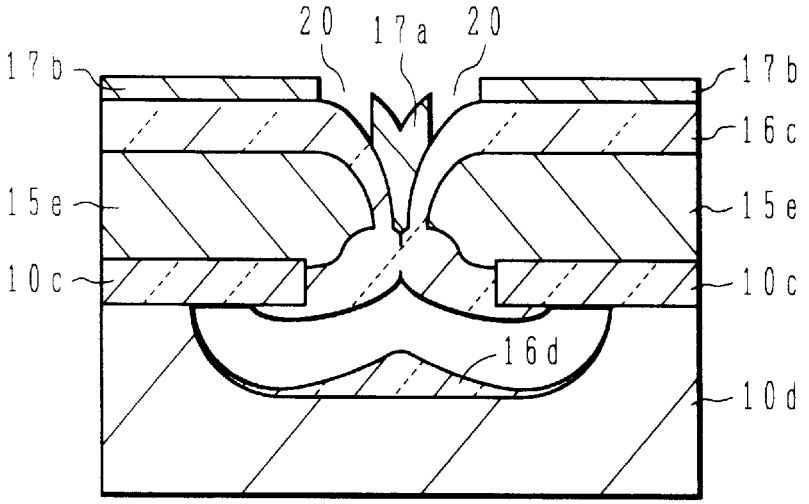
FIGS. 34A and 34B are diagrams illustrating the manufacture steps of a three-electrode field emission element.
Figure 34B:
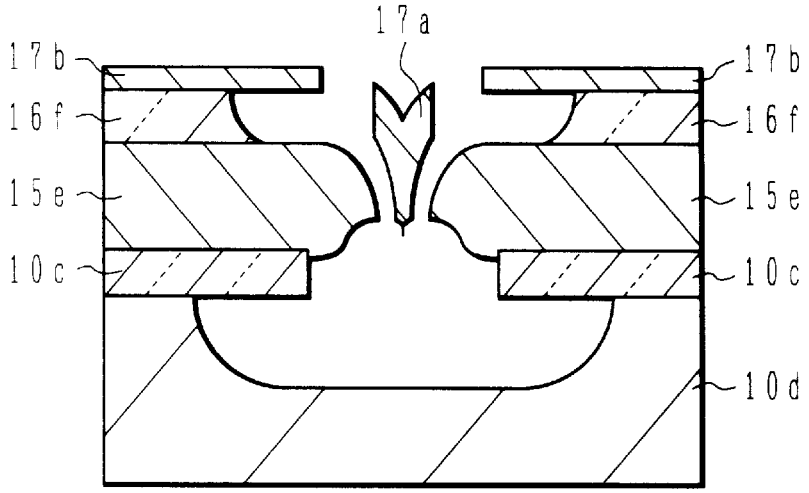

FIGS. 34A and 34B are diagrams illustrating a method of manufacturing a three-electrode element. First, the element shown in FIG. 30H is manufactured by the previously described processes.

Thereafter, as shown in FIG. 34A, a resist film having a predetermined pattern (not shown) is formed on the emitter electrode 17. By using this resist pattern as a mask, slit openings 20 are formed on both sides of an emitter electrode 17*a* by RIE using $Cl_2$ containing etchant. An emitter electrode 17*b* is formed at the outer sides of the slit openings 20.

The diameter of the emitter electrode 17*a* is about 0.3 $\mu$m, and the depth of the slit openings 20 is about 0.2 $\mu$m.

Next, as shown in FIG. 34B, part of the reacted film 16*c* and the whole of the reacted film 16*d* are wet etched. For example, $HF+NH_4F$ is used for wet etching the reacted films 16*c* and 16*d* made of $SiO_2$.

Part of the reacted film 16*c* is etched and a reacted film 16*f* is left unetched as shown in FIG. 34B so that the emitter electrode 17*a*, gate electrode 15*e*, and anode electrode 10*d* are exposed.

The three-electrode element shown in FIG. 34B has the emitter electrode 17 as a cathode and an anode electrode 10*d* as an anode wherein a positive potential is applied to the gate electrode 15*e* to emit electrons from the emitter electrode 17*a* toward the anode electrode 10*e*.

Also in the case of a three-electrode element, the apex angle and radius of curvature of the tip of the emitter electrode 17*a* can be made small, because even if the mold having a small apex angle and radius of curvature is used, emitter material can be easily filled in the cusp portion. The relative position of the emitter electrode 17*a* and gate electrode 15*e* can be controlled precisely. The strength of the tip of the emitter electrode can be retained.

In the above description, the lamination film 10*c* is made of insulating material such as $SiN_x$. Next, forming the lamination film 10*c* by conductive material will be described.

Figure 35A:
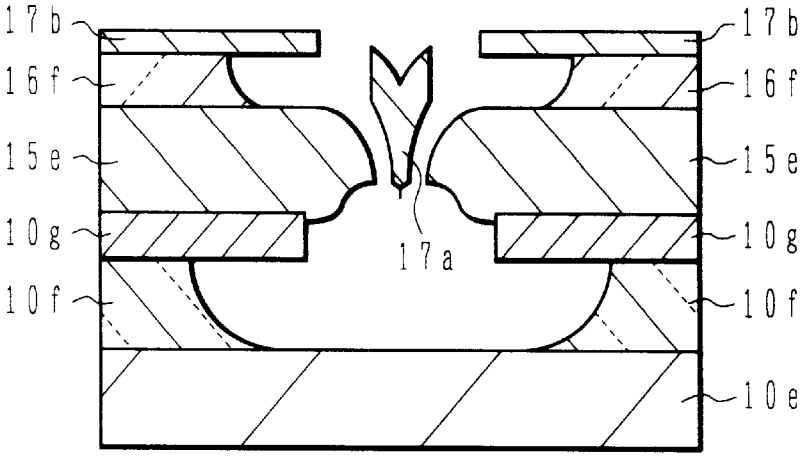
FIGS. 35A to 35C are diagrams illustrating the other manufacture steps of a three-electrode field emission element.

FIG. 35A is a cross sectional view showing another example of a three-electrode element. A lamination film (first gate electrode) log is made of conductive material such as $WSi_x$, $TaSi_x$, and $MoSi_x$. Between the anode electrode 10*e* and lamination film 10*g*, an insulating film 10*f* made of $SiO_2$, $SiN_x$, or the like is formed. The manufacture method of this three-electrode element will be described next.

The substrate 10 shown in FIG. 30A is constituted of the starting substrate 10*a* and the lamination film 10*b* made of insulating material and stacked on the starting substrate 10*a*. In the case of the three-electrode element shown in FIG. 35A, on a substrate 10*e* made of, for example, Si, an insulating film 10*f* made of $SiO_2$ or the like and a lamination film 10*g* made of conductive material are sequentially laminated. Thereafter, the processes described previously are performed to manufacture the three-electrode element shown in FIG. 35A.

By using the conductive lamination film 10*g*, a lamination of the first gate electrode log and second gate electrode 15*e* forms a low resistance gate electrode. The gate electrodes 10*g* and 15*e* are electrically isolated from the anode electrode 10*e* by the insulating film 10*f*.

Figure 35B:
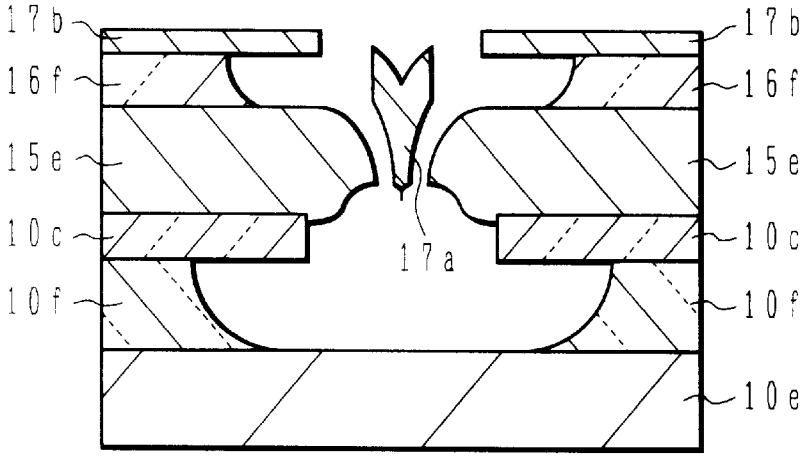

In a three-electrode element shown in FIG. 35B, instead of the lamination film 10*g* of the three-electrode element made of conductive material and shown in FIG. 35A, a lamination film 10*c* made of insulating material is used. The lamination film 10*c* may be made of $SiN_x$, $SiO_2$, $AlN_x$, $Al_2O_3$, or the like. The gate electrode 15*e* and the anode electrode 10*e* are electrically isolated by the insulating films 10*c* and 10*f*.

Figure 35C:
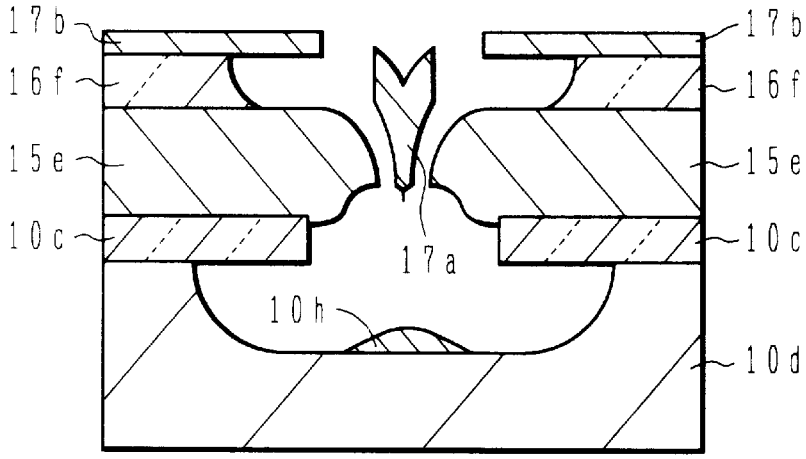

In a three-electrode element shown in FIG. 35C, an anode electrode 10*h* is added to the anode electrode 10*d* of the three-electrode element shown in FIG. 34B. The anode electrode 10*h* is left when the gate electrode 15*e* is deposited thick, and is made of, for example, polysilicon. The anode electrode is therefore constituted of the electrode 10*h* stacked upon the electrode 10*d*.

FIGS. 36A to 36H are diagrams illustrating the manufacture steps of a field emission element according to the eighth embodiment of the invention. In the following, the manufacture steps of an emitter (cathode) constituting a field emission element will be described.

Figure 36A:
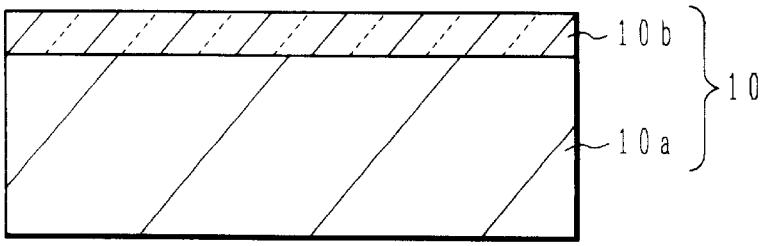
FIGS. 36A to 36H are diagrams illustrating the manufacture steps of a field emission element according to an eighth embodiment of the invention.
Figure 36B:
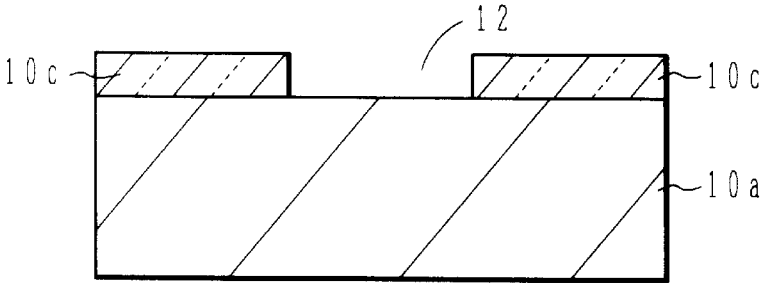

As shown in FIG. 36A, a substrate 10 is structured by a starting substrate 10*a* and a lamination film 10*b* of about 140 nm thick stacked upon the starting substrate 10*a*. For example, the starting substrate 10*a* is made of Si, and the lamination film 10*b* is made of $SiN_x$.

The lamination film 10*b* may be made of $SiO_2$ instead of $SiN_x$. The starting substrate 10*a* may be made of Al. If Al is used, the lamination film 10*b* is made of $AlN_x$, $Al_2O_3$, or the like. In the following, it is assumed that the starting substrate 10*a* is made of Si and the lamination film 10*b* is made of $SiN_x$.

A resist film having a predetermined pattern is formed on the lamination film 10*b*. By using the resist pattern as a mask, the lamination film 10*b* is selectively etched to form a hole 12 shown in FIG. 36B in the lamination film 10*b* so that a surface of the starting substrate 10*a* is exposed from an aperture of the hole 12. A lamination film 10*c* having two opposing parts in cross section is therefore formed. The above selective etching is performed by RIE using $SF_e$ containing etching gas. The hole 12 has a diameter of about 0.5 $\mu$m and a depth of about 140 nm.

Figure 36C:
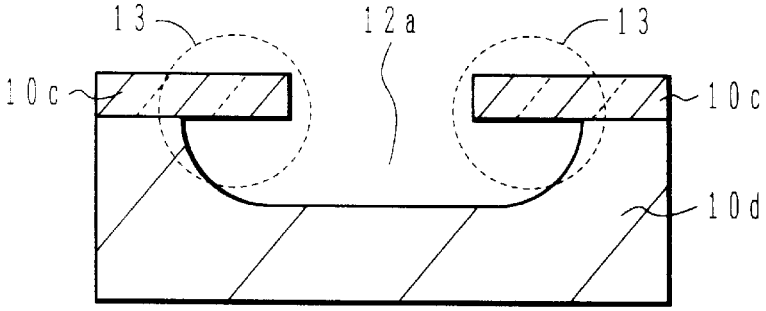

As shown in FIG. 36C, by using the lamination film 10*c* as an etching mask, the starting substrate 10*a* is wet etched to form a hole 12*a* in the starting substrate. A substrate 10*d* is therefore formed. The hole 12*a* forms a hollow space and has a diameter of about 1.5 $\mu$m and a depth of about 0.5 $\mu$m. Isotropical wet etching is performed through the hole 12 to etch the stating substrate 10*a* not only along the vertical direction of the substrate 10*a* but also along the horizontal direction in the cross-section of the starting substrate 10*a*. Therefore, the starting substrate 10*a* is etched partially at the underneath of the lamination film 10*c*. The lamination film 10*c* extends like a hood near at the hole 12*a*. As shown in FIG. 36C, an overhang portion 13 is therefore formed having two opposing parts in cross section separated along the horizontal direction of the substrate.

Figure 36D:
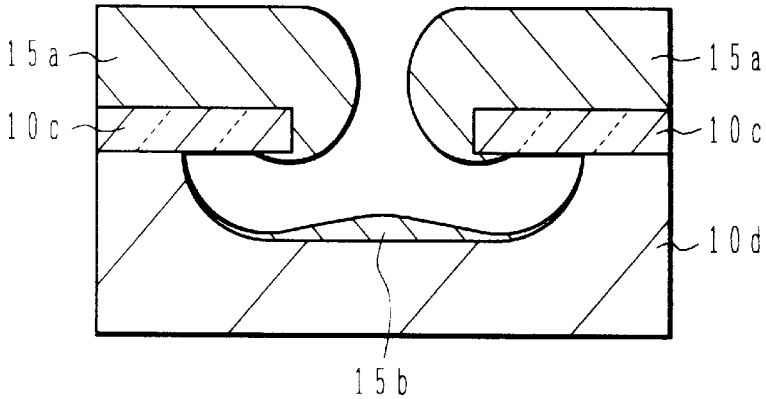

As shown in FIG. 36D, a first sacrificial film 15*a* made of, for example, polysilicon is deposited by CVD on the lamination film 10*c* with two parts. At the same time, a first sacrificial film 15*b* is also deposited through an opening on the substrate 10*d* at the bottom of the hole 12*a*.

The first sacrificial films 15*a* and 15*b* may be made of amorphous silicon, $WSi_x$, $MoSi_x$, $TaSi_x$, Al, Ta, Mo, or Ti, instead of polysilicon. Sputtering may be used instead of CVD. For example, the first sacrificial films 15*a* and 15*b* of amorphous silicon may be formed by a DC sputtering system using, as a target, polysilicon which contains P or B. For example, sputtering is performed under the conditions of a power of 1 kW and an Ar gas pressure of 8 mTorr.

Figure 36E:
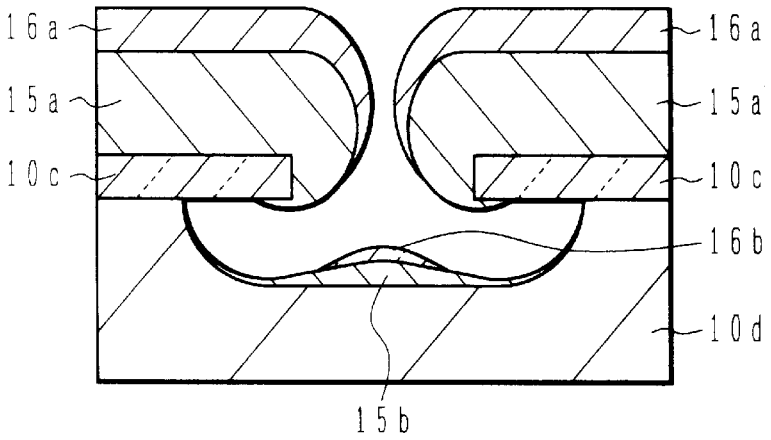

Next, as shown in FIG. 36E, second sacrificial films 16*a* and 16*b* made of, for example, $WSi_x$, are deposited. The second sacrificial film 16*a* is isotropically deposited on the first sacrificial film 15*a* with the two parts. The bottom area of the overhang portion of the two parts is not deposited or rarely deposited with the second sacrificial film 16*a*. The second sacrificial film 16*b* is deposited on the first sacrificial film 15*b*.

The second sacrificial films 16*a* and 16*b* may be made of $TaSi_x$ or $MoSi_x$, in addition to $WSi_x$. However, it is necessary to select material of the second sacrificial films 16*a* and 16*b* having a slower oxidation or nitridation speed than that of the first sacrificial films 15*a* and 15*b*.

Figure 36F:
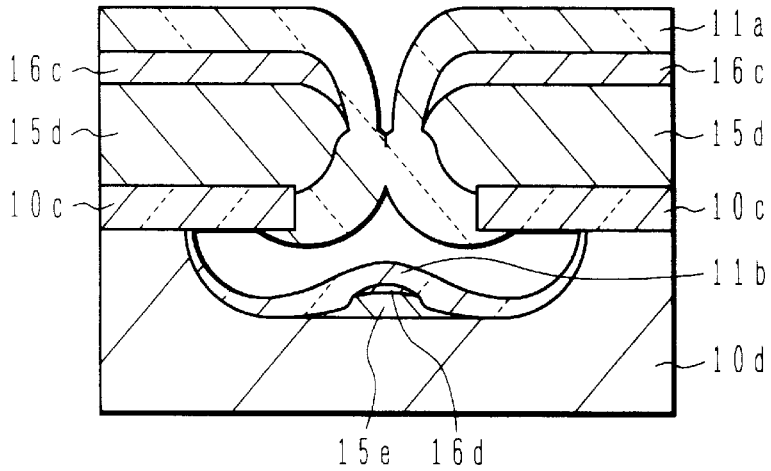

As shown in FIG. 36F, wet oxidation is performed to form a reacted film 11*a* on the surface of the overhang portion and a reacted film 11*b* on the substrate 10*d*. First sacrificial films 15*d* and 15*e* are made of, for example, polysilicon, and the first sacrificial films 15*a* and 15*b* shown in FIG. 36E are not oxidized. Second sacrificial films 16*c* and 16*d* are made of, for example, $WSi_x$, and the second sacrificial films 16*a* and 16*b* shown in FIG. 36E are not oxidized.

For example, wet oxidation is performed by using a vertical furnace under the conditions of a furnace temperature of 850° C., a supply of $H_2$ gas at 30000 cc/min, and a supply of $O_2$ gas at 20000 cc/min. The reacted films 11*a* and 11*b* are made of $SiO_2$.

In FIG. 36E, the upper surface of the overhang portion is deposited thick with the second sacrificial film 16*a*, and the lower surface thereof is not deposited or thinly deposited with the second sacrificial film 16*a*. The overhang portion is oxidized fast at the area where the first sacrificial film 15*a* is exposed or where the second sacrificial film is thinly deposited. The oxidation speed of the first sacrificial film is faster than that of the second sacrificial film, because the first sacrificial film 15*a* is made of, for example, polysilicon, and the second sacrificial film 16*a* is made of, for example, $WSi_x$.

Figure 36G:
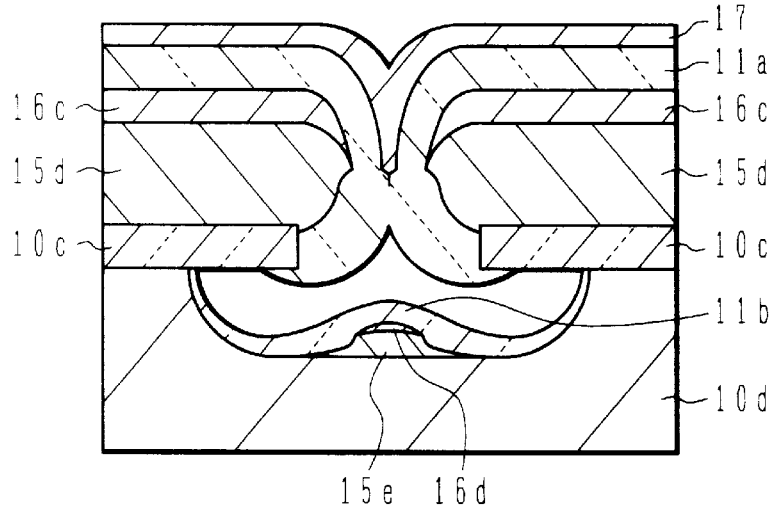

As a result, as shown in FIG. 36G, the volume of the overhang expands less at the upper area than at the lower area, and the two parts of the overhang become in contact with each other.

Since the reaction speed changed at the upper and lower areas of the overhang, the cusp portion formed at the contact area of the two parts has a shape of two-stage curves and can form an acute angle. This cusp portion has an acute angle area having a cross section like two contacted circles or ellipses. By using this cusp portion as a mold, an emitter electrode of the two-stage type is formed.

As shown in FIG. 36G, an emitter electrode 17 made of, for example, TiN is deposited on the reacted film 11*a* about 0.2 $\mu$m by reactive sputtering. For example, the reactive sputtering is performed by using a DC sputtering system under the conditions of a power of 5 kW, a pressure of 4 mTorr, a target of Ti, a supply of $N_2$ gas at 84 sccm, and a supply of Ar gas at 56 sccm. The emitter electrode 17 may be made of Mo, Cr, Ti, or W, instead of TiN. CVD or evaporation instead of sputtering may be used.

Figure 36H:
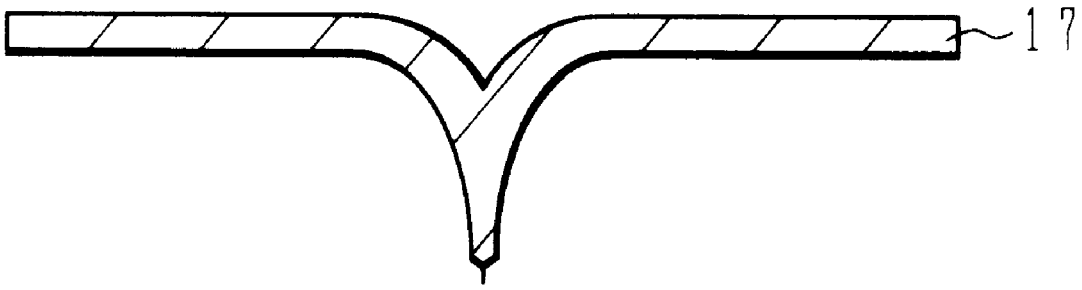

The substrate 10*d* is wet etched by $HF+HNO_3+H_2O$, and thereafter the reacted film 11*a* is wet etched by $HF+NH_4F$ to expose the tip of the emitter electrode as shown in FIG. 36H.

With the eighth embodiment, the emitter electrode 17 of the two-stage type can be formed. This emitter electrode may be reinforced by the methods illustrated in FIGS. 2A to 2C, because it is thin.

In the eighth embodiment, the process of forming the second sacrificial film 16*a* shown in FIG. 36E is important for determining the shape of the emitter electrode. The second sacrificial film 16*a* may be formed by the following method.

Figure 37A:
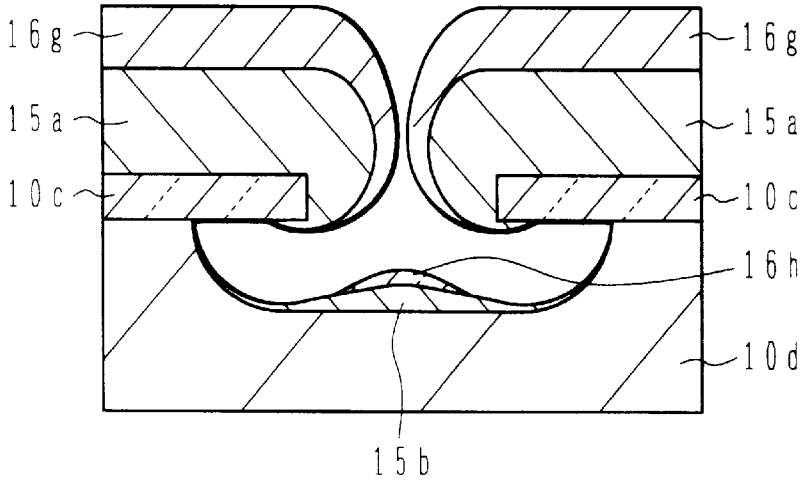
FIGS. 37A and 37B are diagrams illustrating another method of forming a second sacrificial film.
Figure 37B:
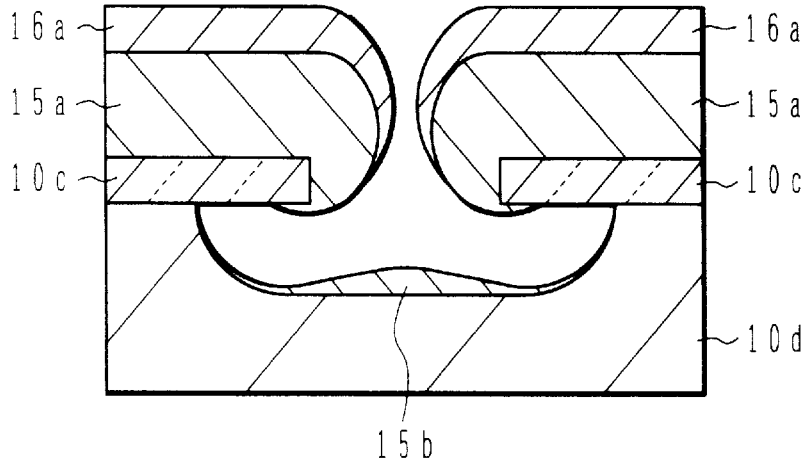

FIGS. 37A and 37B are diagrams illustrating another method of forming the second sacrificial film.

After the process illustrated in FIG. 36D, second sacrificial films 16*g* and 16*h* are deposited thick by plasma CVD or the like, as shown in FIG. 37A. The second sacrificial film 16*g* is controlled to have two parts.

Next, the surface of the second sacrificial film 16*g* is etched by a uniform amount by isotropic wet etching. Therefore, as shown in FIG. 37B, a desired thickness distribution of the second sacrificial film 16*a* can be obtained. The bottom area of the overhang portion of the second sacrificial film 16*a* can be made thin. The upper area of the overhang is maintained thick. Thereafter, the processes starting from FIG. 36F are executed.

In the process illustrated in FIG. 36F, the reacted films 11*a* and 11*b* are formed by wet oxidation. Instead of wet oxidation, reacted films 11*a* and lib of $SiN_x$ may be formed by nitridation.

For example, nitridation is performed under the conditions of a temperature of 1050° C., an RF power of 10 kW, a pressure of 130 Pa, and a supply of $NH_3$ at 1 slm.

The emitter electrode manufacture methods have been described so far. Next, a method of manufacturing another type of a field emission element of a two-electrode element will be described.

Figure 38:
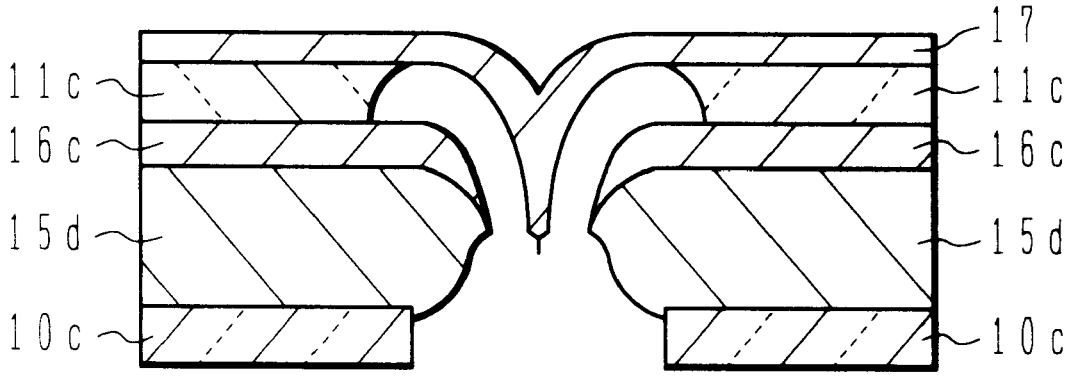
FIG. 38 is a diagram illustrating the manufacture steps of a two-electrode field emission element.

FIG. 38 is a diagram illustrate the method of manufacturing a two-electrode element. First, an element shown in FIG. 36G is formed by the above described processes. Thereafter, the substrate 10*d* and part of the reacted film 11*a* are etched. By partially removing the reacted film 11*a* and leaving the reacted film 11*c* unetched as shown in FIG. 38, the tip of the emitter electrode 17 is exposed.

If the first sacrificial film 15*d* and second sacrificial film 16*c* are made of conductive polysilicon or amorphous silicon, the first sacrificial film 15*d* and the second sacrificial film 16*c*, which are unreacted, can be used as a gate electrode. The two-electrode element has two electrodes—the emitter electrode 17 and gate electrodes 15*d* and 16*c*. The reacted film 11*c* electrically isolates the emitter electrode 17 and gate electrodes 15*d* and 16*c*. The lamination film 10*c* may be removed by etching.

The first sacrificial film 15*a* anisotropically deposited on the lamination film 10*c* as illustrated in FIG. 36D may be isotropically deposited. However, anisotropical deposition makes the diameter of a hole (gate hole) of the gate electrode small so that the electrical performance can be improved.

For example, if the gate electrode (first sacrificial film) of the two-electrode element shown in FIG. 38 is made thick, the diameter of the gate hole becomes small. In order to increase the thickness of the gate electrode (first sacrificial film), it is sufficient if the first sacrificial film 15*a* is anisotropically deposited. Anisotropical deposition of the first sacrificial film 15*a* can make the gate hole diameter small. Therefore, electrons can be emitted from the emitter even at a low gate-emitter voltage. Similar advantages are also obtained by a three-electrode element.

With isotropic deposition, the first sacrificial film 15*a* on the overhang portion and the first sacrificial film 15*b* on the substrate 10*d* become likely to be integrated together and the first sacrificial film 15*a* with two parts is difficult to form.

In the eighth embodiment, after the first and second sacrificial films having different reaction speeds are formed, oxidation or nitridation is performed to expand the volume of the overhang portion. The position of the tip of the emitter electrode can therefore be controlled more precisely than volume expansion using CVD, from the reasons already described above.

The two-electrode element has the emitter electrode 17 as a cathode and the gate electrodes 15*d* and 16*c* as a control electrode. If the tip of the emitter electrode 17 is positioned properly, electrons can be emitted easily from the tip of the emitter electrode even at a low control voltage applied to the gate electrodes.

Furthermore, in the eighth embodiment, even if the mold having a small apex angle and radius of curvature is used, emitter material can be easily filled in the cusp portion of the mold so that the relative position between the emitter electrode 17 of the two-stage type and gate electrode 15*c* can be determined precisely. Since the apex angle and radius of curvature of the emitter electrode can be made small, the product uniformity, reproductivity, and performance of field emission elements can be improved.

The two-electrode element may be reinforced by a support plate 18 by the methods illustrated in FIGS. 6A to 6C.

The manufacture method of a two-electrode element has been described above. Next, a manufacture method of another type of a field emission element of a three-electrode element will be described.

Figure 39A:
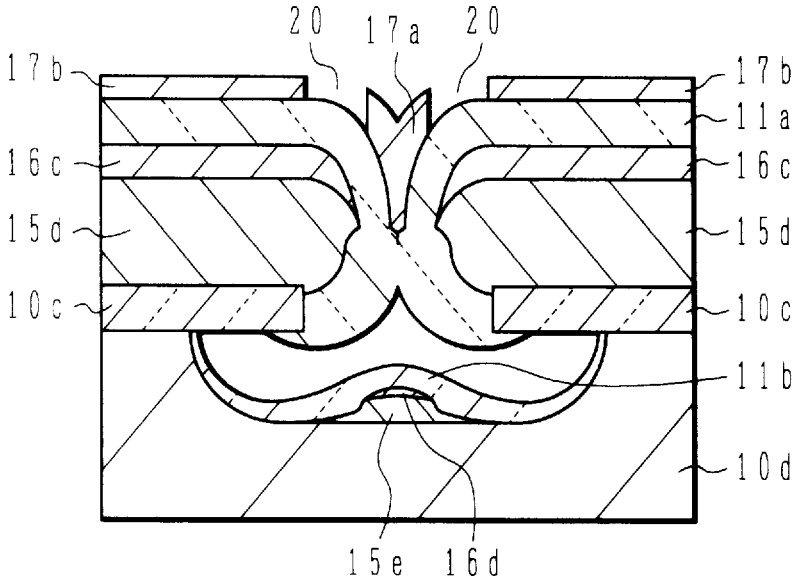
FIGS. 39A and 39B are diagrams illustrating the manufacture steps of a three-electrode field emission element.
Figure 39B:
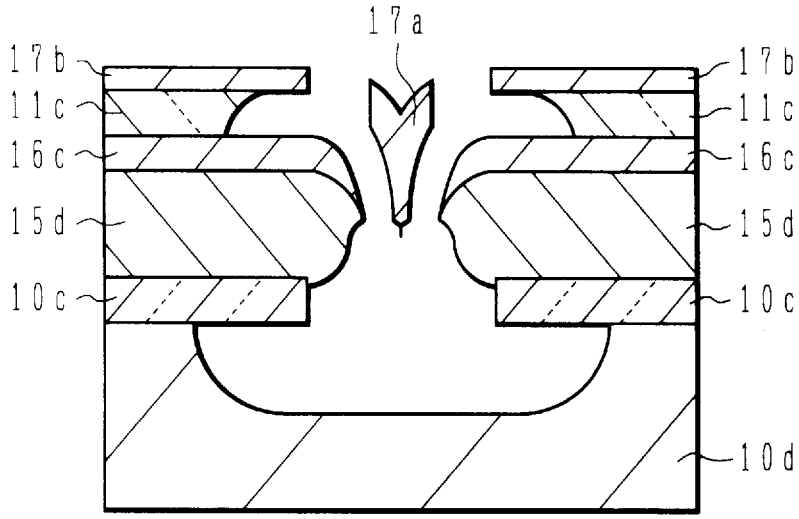

FIGS. 39A and 39B are diagrams illustrating a method of manufacturing a three-electrode element. First, the element shown in FIG. 36G is manufactured by the previously described processes.

Thereafter, as shown in FIG. 39A, a resist film having a predetermined pattern (not shown) is formed on the emitter electrode 17. By using this resist pattern as a mask, slit openings 20 are formed on both sides of an emitter electrode 17*a* by RIE using $Cl_2$ containing etchant. An emitter electrode 17*b* is formed at the outer sides of the slit openings 20.

The diameter of the emitter electrode 17*a* is about 0.3 $\mu$m, and the depth of the slit openings 20 is about 0.2 $\mu$m.

Next, as shown in FIG. 39B, part of the reacted film 11*a* and the whole of the films 11*b*, 15*d*, and 16*d* on the substrate are wet etched via the slit openings 20. For example, $HF+NH_4F$ is used for wet etching the reacted films 11*a* and 11*b* made of $SiO_2$.

Part of the reacted film 11*a* is etched and a reacted film 11*c* is left unetched as shown in FIG. 39B so that the emitter electrode 17*a*, gate electrodes 15*d* and 16*c*, and anode electrode 10*d* are exposed. The gate electrodes are formed by the first gate electrode 15*d* made of, for example, polysilicon, and the second gate electrode 16*c* made of, for example, $WSi_x$.

The three-electrode element shown in FIG. 39B has the emitter electrode 17 as a cathode and an anode electrode 10*d* as an anode wherein a positive potential is applied to the gate electrodes 15*d* and 16*c* to emit electrons from the emitter electrode 17*a* toward the anode electrode 10*e*.

Also in the case of a three-electrode element, the apex angle and radius of curvature of the tip of the emitter electrode 17*a* can be made small, because even if the mold having a small apex angle and radius of curvature is used, emitter material can be easily filled in the cusp portion. The relative position of the emitter electrode 17*a* and gate electrodes 15*d* and 16*c* can be controlled precisely. The strength of the tip of the emitter electrode can be retained.

In the above description, the lamination film 10*c* is made of insulating material such as $SiN_x$. Next, forming the lamination film 10*c* by conductive material will be described.

Figure 40A:
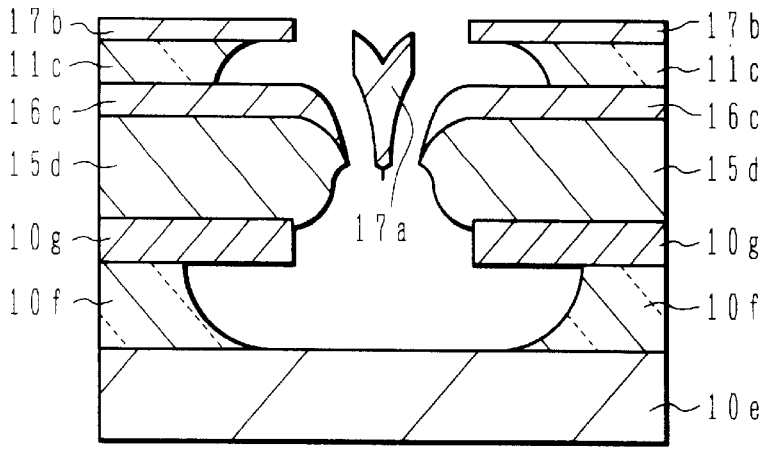
FIGS. 40A to 40C are diagrams illustrating the other manufacture steps of a three-electrode field emission element.

FIG. 40A is a cross sectional view showing another example of a three-electrode element. A lamination film (third gate electrode) log is made of conductive material such as Au, Pt, Ed, and Ag. Between the anode electrode 10*e* and lamination film 10*g*, an insulating film 10*f* made of $SiO_2$, $SiN_x$, or the like is formed. The manufacture method of this three-electrode element will be described next.

The substrate 10 shown in FIG. 36A is constituted of the starting substrate 10*a* and the lamination film 10*b* made of insulating material and stacked on the starting substrate 10*a*. In the case of the three-electrode element shown in FIG. 40A, on a substrate 10*e* made of, for example, Si, an insulating film 10*f* made of $SiO_2$ or the like and a lamination film 10*g* made of conductive material are sequentially laminated. Thereafter, the processes described previously are performed to manufacture the three-electrode element shown in FIG. 40A.

By using the conductive lamination film 10*g*, a lamination of the third gate electrode 10*g*, first gate electrode 15*d*, and second gate electrode 16*c* forms a low resistance gate electrode. The gate electrodes 10*g*, 15*d*, and 16*c* are electrically isolated from the anode electrode 10*e* by the insulating film 10*f*.

Figure 40B:
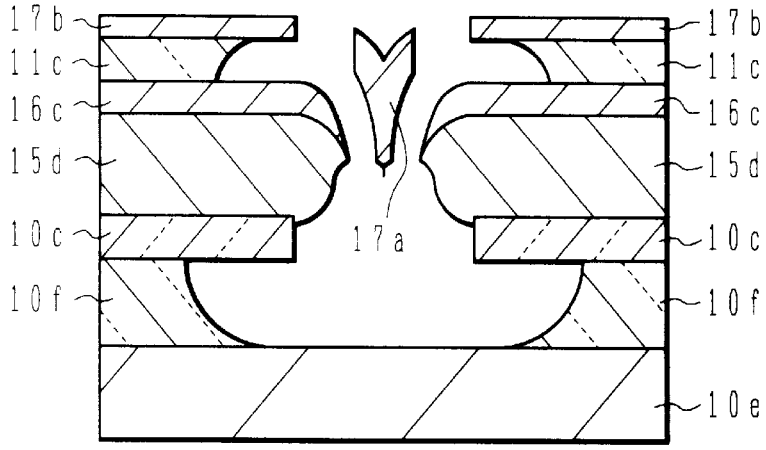

In a three-electrode element shown in FIG. 40B, instead of the lamination film 10*g* of the three-electrode element made of conductive material and shown in FIG. 40A, a lamination film 10*c* made of insulating material is used. The lamination film 10*c* may be made of $SiN_x$, $SiO_2$, $AlN_x$, $Al_2O_3$, or the like. The gate electrodes 15*d* and 16*c* and the anode electrode 10*e* are electrically isolated by the insulating films 10*c* and 10*f*.

Figure 40C:
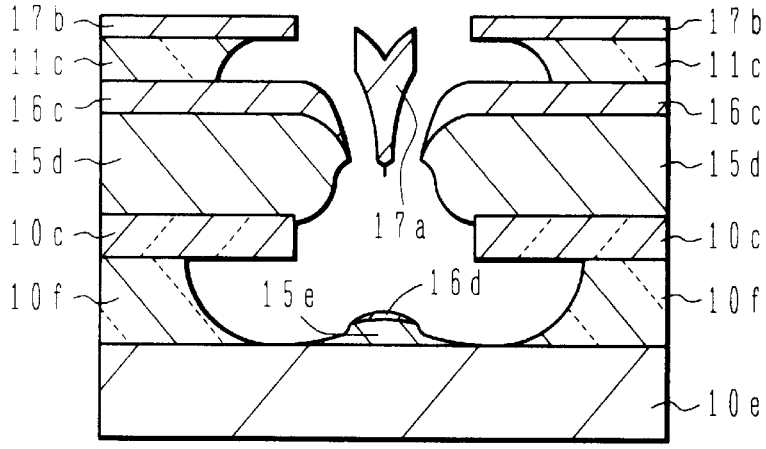

In a three-electrode element shown in FIG. 40C, anode electrodes 15*e* and 16*d* are added to the anode electrode 10*e* of the three-electrode element shown in FIG. 40B. The anode electrode 15*d* is left when the first gate electrode 15*d* is deposited thick, and is made of, for example, polysilicon. The anode electrode 16*d* is left when the second gate electrode 16*c* is deposited thick, and is made of, for example, $WSi_x$.

Next, the shapes of the one-stage type emitter electrode of the first embodiment and the multi-stage (two-stage) type emitter electrode of the second embodiment will be described. The one-stage type emitter electrode is such as shown in FIG. 1H, and is formed by depositing $SiO_2$ (second sacrificial film) on the first sacrificial film and conducting a reaction such as an oxidation reaction. The multi-stage (two-stage) type emitter electrode is such as shown in FIG. 12E, and is formed by depositing $SiN_x$ (reaction preventing film) on the first sacrificial film and conducting a reaction such as an oxidation reaction.

More specifically, if $SiO_2$ is deposited on the first sacrificial film, the one-stage type emitter electrode is formed, whereas $SiN_x$ is deposited on the first sacrificial film, the multi-stage (two-stage) type emitter electrode is formed. Therefore, if $SiO_xN_y$ is deposited on the first sacrificial film, the emitter electrode having an intermediate shape between the one-stage type and multi-stage (two-stage) type can be formed. As the ratio of x and y of $SiO_xN_y$ is changed, the shape of the emitter electrode can be made more similar to the one-stage type or multi-stage (two-stage) type. This film of $SiO_xN_y$ has a function of controlling a reaction of the first sacrificial film.

Figure 41A:
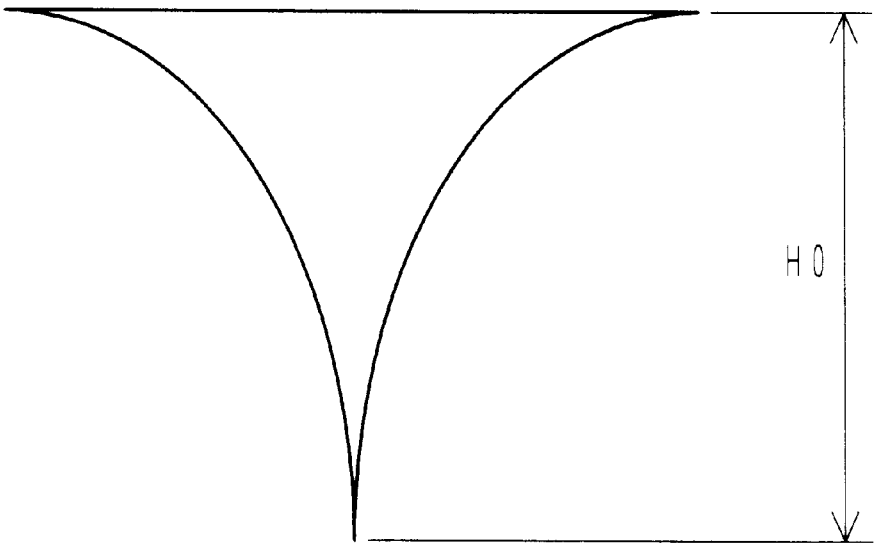
FIGS. 41A and 41B illustrate a first definition of an emitter, using height as a parameter.
Figure 41B:
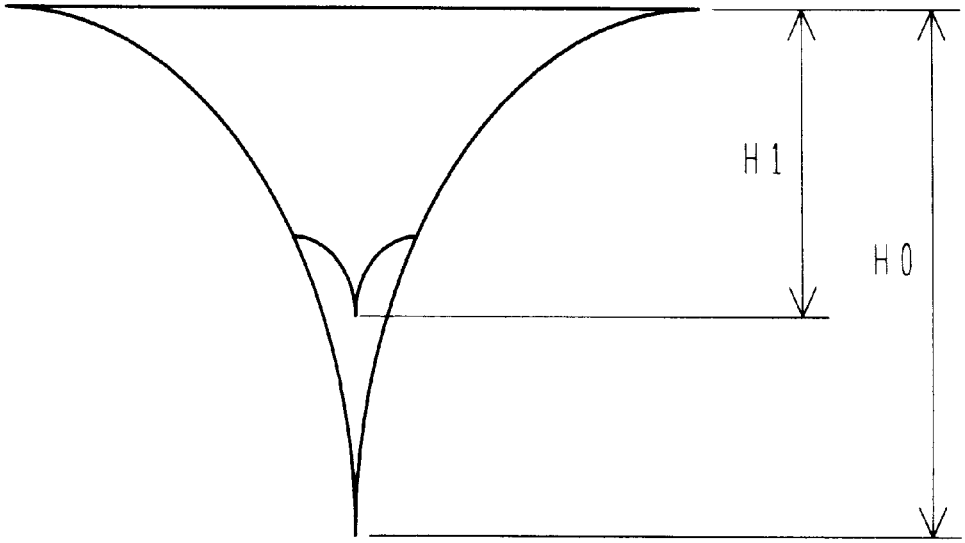

FIGS. 41A and 41B illustrate the first definition of a multi-stage (two-stage) type emitter, using height as a parameter.

FIG. 41A shows the shape of an one-stage type emitter. The one-stage type emitter is defined by an one-stage curve, and has a height of H0.

FIG. 41B shows the shape of a multi-stage (two-stage) type emitter. The multi-stage (two-stage) type emitter is defined by two two-stage curves having different curvatures, and has a height of H1. If the first stage curve of the two two-stage curves is used for forming an one-stage type emitter, this emitter has a height of H0 same as the emitter shown in FIG. 41A.

Assuming that the first stage curve is the arc of a quadrant with a radius of H0, an aspect ratio of the emitter is represented by "height (length from base to apex)/base diameter (base thickness). The one-stage type emitter (FIG. 41A) has a height of H0 and a base diameter of 2×H0 so that the aspect ratio of H0/(2×H0)=0.5. The two-stage type emitter has an aspect ratio smaller than the one-stage type emitter, and can be defined by:

$$H1<H0 \quad (1)$$

It is however desired that H1 is as near as H0, because of the electric performance of a field emission element in which electrons are required to be emitted even at a low gate-emitter voltage.

To this end, assuming that the same quadrant with a diameter of H0 is used and the aspect ratio is set to 0.25, the height H1=0.5×H0 is required at the base diameter of 2×H0.

Therefore, the two-stage emitter is defined preferably by:

$$H0>H1>0.5\times H0 \quad (2)$$

It is however desired that H1 is not too long, in order to control the position of the emitter tip with high precision and to reliably fill emitter material deep into the bottom of the mold.

To this end, assuming that the same quadrant with a diameter of H0 is used and the aspect ratio is set to 0.475, the height H1=0.95×H0 is required at the base diameter of 2×H0.

Therefore, the two-stage emitter is defined more preferably by:

$$0.5\times H0<H1<0.95\times H0 \quad (3)$$

Figure 42A:
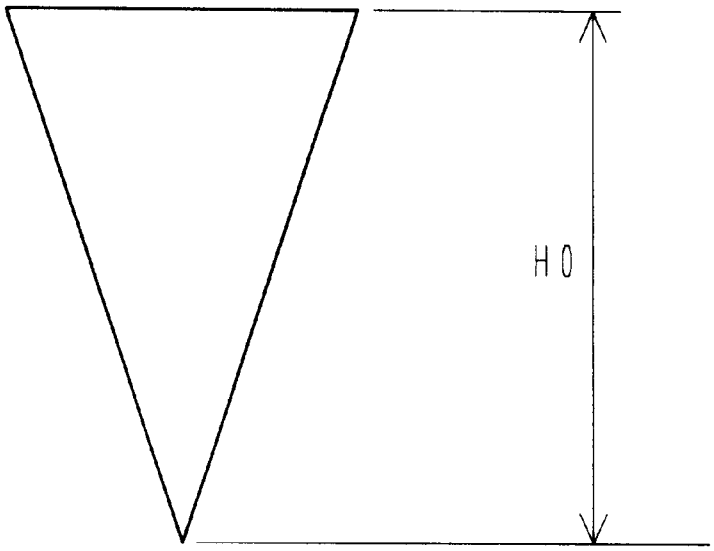
FIGS. 42A and 42B illustrate a second definition of an emitter, using height as a parameter.
Figure 42B:
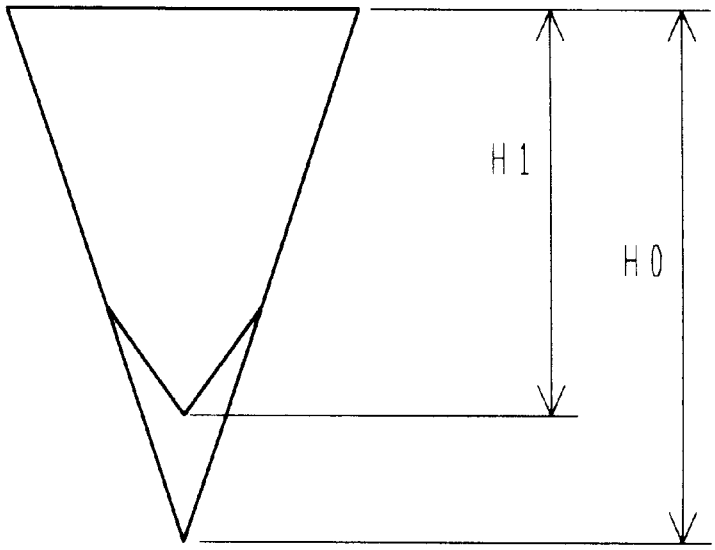

FIGS. 42A and 42B illustrate the second definition of a multi-stage (two-stage) type emitter, using height as a parameter.

FIG. 42A shows the shape of an one-stage type emitter. The one-stage type emitter is defined by an one-stage straight line, and has a height of H0.

FIG. 42B shows the shape of a multi-stage (two-stage) type emitter. The multi-stage (two-stage) type emitter is defined by two two-stage straight lines having different slopes, and has a height of H1. If the first stage straight line of the two two-stage straight lines is used for forming an one-stage type emitter, this emitter has a height of H0 same as the emitter shown in FIG. 42A.

In manufacturing the multi-stage (two-stage) type emitter of this shape, first a multi-stage (two-stage) type emitter similar to the above embodiments is formed and then the emitter is partially etched to form the first and second stage straight lines. The emitter electrode of this shape can improve the integration degree, and the maximum electric field strength at the emitter tip can be increased.

The two-stage type emitter can be defined by the same formulas (1) to (3) represented by the heights H1 and H0.

Figure 43A:
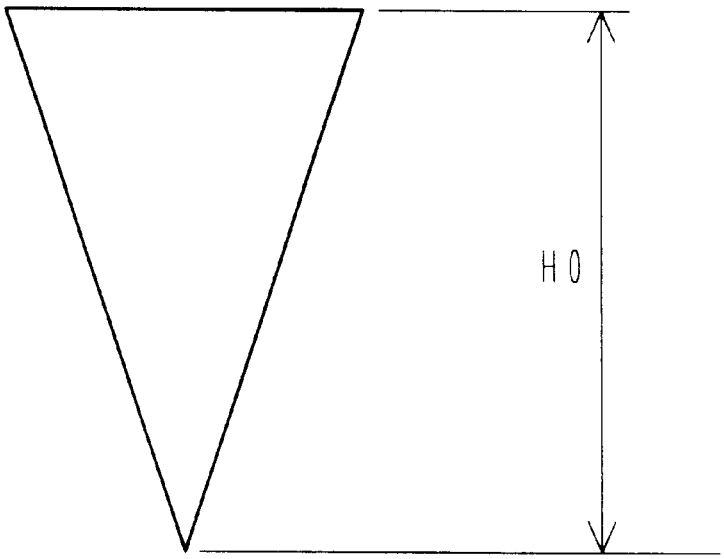
FIGS. 43A and 43B illustrate a third definition of an emitter, using height as a parameter.
Figure 43B:
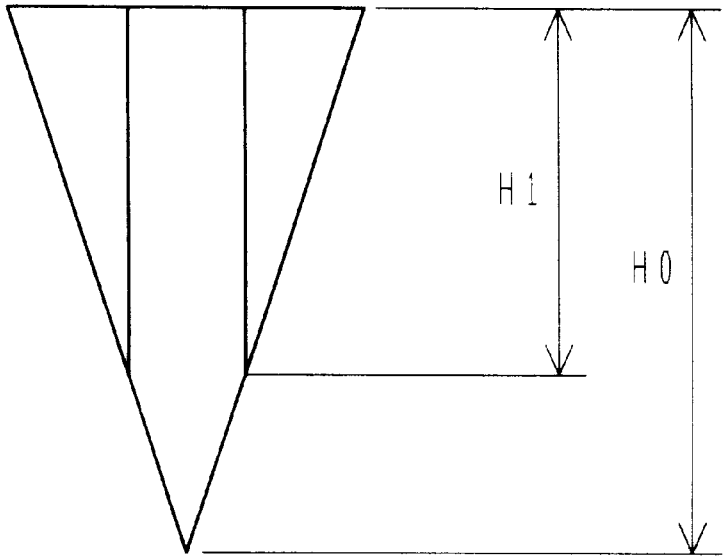

FIGS. 43A and 43B illustrate the third definition of a multi-stage (two-stage) type emitter, using height as a parameter.

FIG. 43A shows the shape of an one-stage type emitter. The one-stage type emitter is defined by an one-stage straight line, and has a height of H0.

FIG. 43B shows the shape of a multi-stage (two-stage) type emitter. The multi-stage (two-stage) type emitter is defined by two two-stage straight lines having different slopes, and has a height of H1. The first stage straight lines are parallel. If the second stage straight line of the two two-stage straight lines is used for forming an one-stage type emitter, this emitter has a height of H0 same as the emitter shown in FIG. 43A.

The two-stage type emitter can be defined by the same formulas (1) to (3) represented by the heights H1 and H0.

Figure 44A:
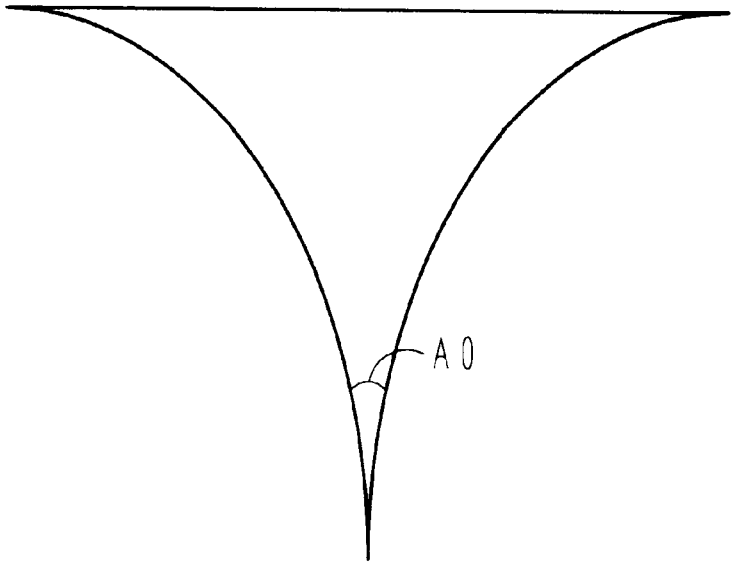
FIGS. 44A and 44B illustrate a first definition of an emitter, using apex angle as a parameter.
Figure 44B:
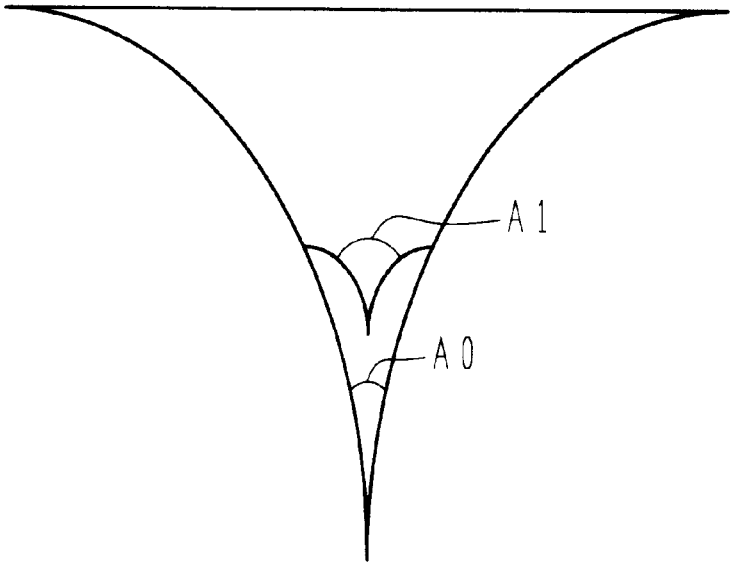

FIGS. 44A and 44B illustrate the first definition of a multi-stage (two-stage) type emitter, using apex angle as a parameter.

FIG. 44A shows the shape of an one-stage type emitter. The one-stage type emitter is defined by an one-stage curve, and has an apex angle of A0.

FIG. 44B shows the shape of a multi-stage (two-stage) type emitter. The multi-stage (two-stage) type emitter is defined by two two-stage curves having different curvatures, and has an apex angle of A1. If the first stage curve of the two two-stage curves is used for forming an one-stage type emitter, this emitter has an apex angle A0 same as the emitter shown in FIG. 44A.

The two-stage type emitter can be defined by:

$$A1>A0 \tag{4}$$

It is however desired that A1 is as near as A0, because of the electric performance of a field emission element in which electrons are required to be emitted even at a low gate-emitter voltage.

Therefore, the two-stage type emitter can be defined preferably by:

$$A0<A1<1.1\times A0 \tag{5}$$

It is however desired that A1 is not too small, in order to control the position of the emitter tip with high precision and to reliably fill emitter material deep into the bottom of the mold.

Therefore, the two-stage emitter is defined more preferably by:

$$1.05\times A0<A1<1.1\times A0 \tag{6}$$

Figure 45A:
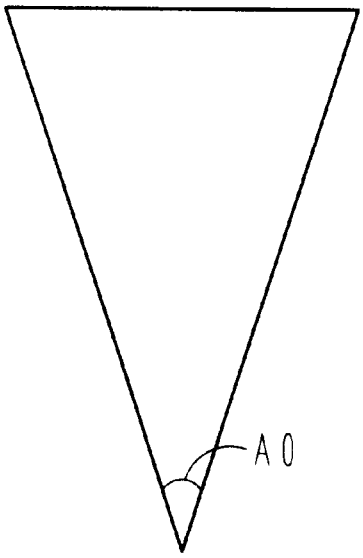
FIGS. 45A and 45B illustrate a second definition of an emitter, using apex angle as a parameter.
Figure 45B:
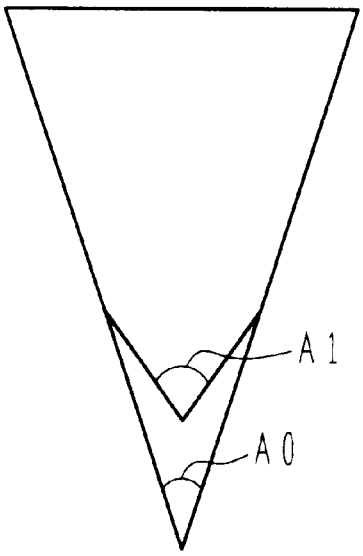

FIGS. 45A and 45B illustrate the second definition of a multi-stage (two-stage) type emitter, using apex angle as a parameter.

FIG. 45A shows the shape of an one-stage type emitter. The one-stage type emitter is defined by an one-stage straight line, and has an apex angle of A0.

FIG. 45B shows the shape of a multi-stage (two-stage) type emitter. The multi-stage (two-stage) type emitter is defined by two two-stage straight lines having different slopes, and has an apex angle of A1. If the first stage straight line of the two two-stage straight lines is used for forming an one-stage type emitter, this emitter has an apex angle A0 same as the emitter shown in FIG. 45A.

The two-stage type emitter can be defined by the same formulas (4) to (6) represented by the apex angles A1 and A0.

Figure 46A:
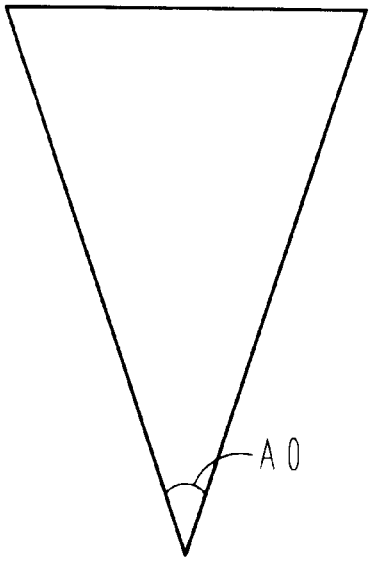
FIGS. 46A and 46B illustrate a third definition of an emitter, using apex angle as a parameter.
Figure 46B:
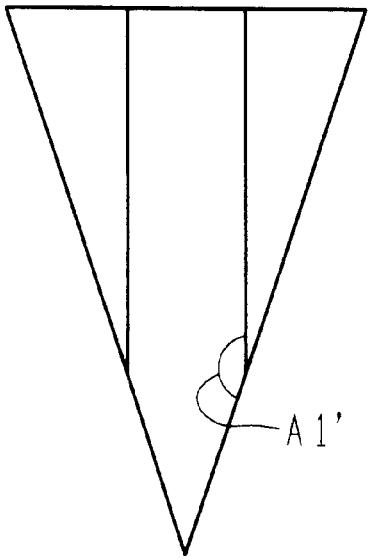

FIGS. 46A and 46B illustrate the second definition of a multi-stage (two-stage) type emitter, using apex angle as a parameter.

FIG. 46A shows the shape of an one-stage type emitter. The one-stage type emitter is defined by an one-stage straight line, and has an apex angle of A0.

FIG. 46B shows the shape of a multi-stage (two-stage) type emitter. The multi-stage (two-stage) type emitter is defined by two two-stage straight lines having different slopes. The first stage straight lines are parallel.

Assuming that the angle between the two two-stage straight lines is A1', the two-stage type emitter is defined by:

$$A1'<180^\circ\ C. \tag{7}$$

Figure 47A:
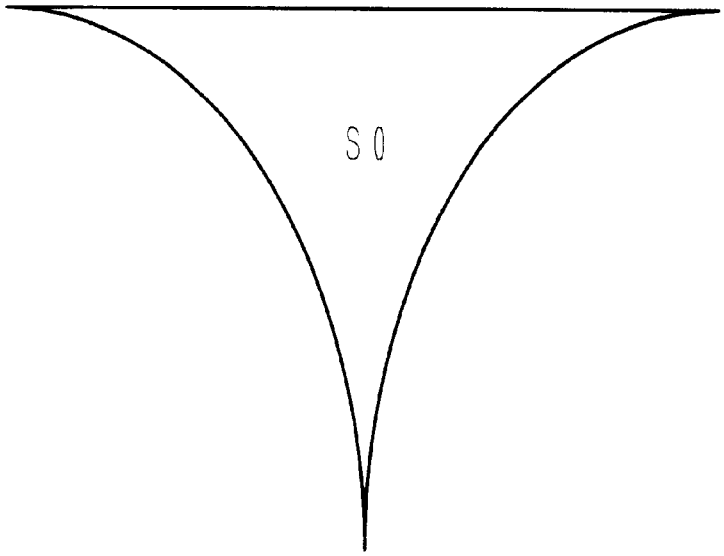
FIGS. 47A and 47B illustrate a first definition of an emitter, using cross sectional area as a parameter.
Figure 47B:
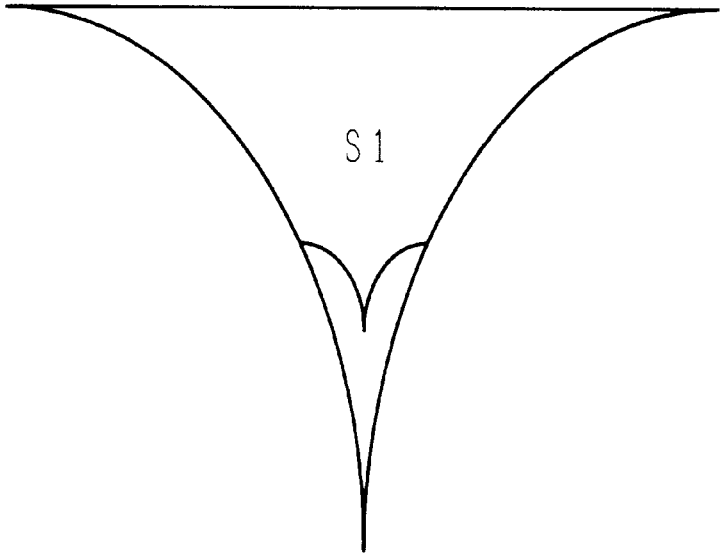

FIGS. 47A and 47B illustrate the first definition of a multi-stage (two-stage) type emitter, using cross sectional area as a parameter.

FIG. 47A shows the shape of an one-stage type emitter. The one-stage type emitter is defined by an one-stage curve, and has a cross sectional area of S0.

FIG. 47B shows the shape of a multi-stage (two-stage) type emitter. The multi-stage (two-stage) type emitter is defined by two two-stage curves having different curvatures, and has a cross sectional area of S1. If the first stage curve of the two two-stage curves is used for forming an one-stage type emitter, this emitter has a cross sectional area of S0 same as the emitter shown in FIG. 47A.

Assuming that the first stage curve is the arc of a quadrant with a radius of H0 and the aspect ratio is set smaller than 0.5, the two-stage type emitter is defined similar to the formula (1) by:

$$S1<S0 \tag{8}$$

It is however desired that S1 is as near as S0, because of the electric performance of a field emission element in which electrons are required to be emitted even at a low gate-emitter voltage.

To this end, assuming that the same quadrant with a diameter of H0 is used and the aspect ratio is set to 0.25, it is necessary to set $S1\cong 0.9\times S0$ similar to the formula (2).

Therefore, the two-stage type emitter is defined preferably by:

$$S0>S1>0.9\times S0 \tag{9}$$

It is however desired that S1 is not too large, in order to control the position of the emitter tip with high precision and to reliably fill emitter material deep into the bottom of the mold.

Therefore, the two-stage emitter is defined more preferably by:

$$0.95\times S0>S1>0.95\times S0 \tag{10}$$

Figure 48A:
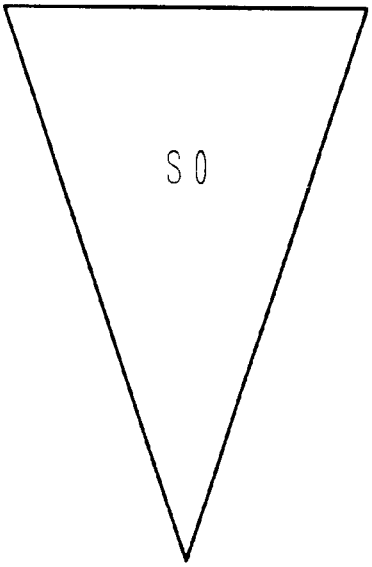
FIGS. 48A and 48B illustrate a second definition of an emitter, using cross sectional area as a parameter.
Figure 48B:
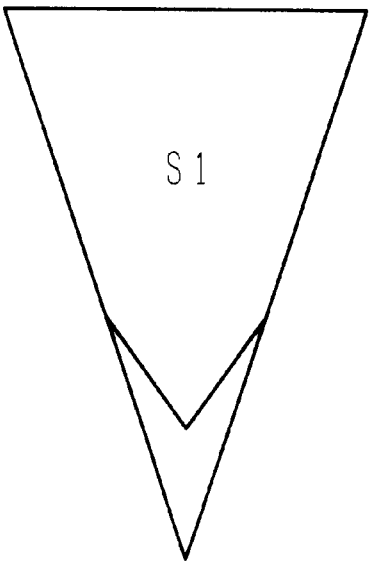

FIGS. 48A and 48B illustrate the second definition of a multi-stage (two-stage) type emitter, using cross sectional area as a parameter.

FIG. 48A shows the shape of an one-stage type emitter. The one-stage type emitter is defined by an one-stage straight line, and has a cross sectional area of S0.

FIG. 48B shows the shape of a multi-stage (two-stage) type emitter. The multi-stage (two-stage) type emitter is defined by two two-stage straight lines having different slopes, and has a cross sectional area of S1. If the first stage straight line of the two two-stage straight lines is used for forming an one-stage type emitter, this emitter has a cross sectional area of S0 same as the emitter shown in FIG. 48A.

The two-stage type emitter can be defined by the same formulas (8) to (10) represented by the cross sectional areas S1 and S0.

Figure 49A:
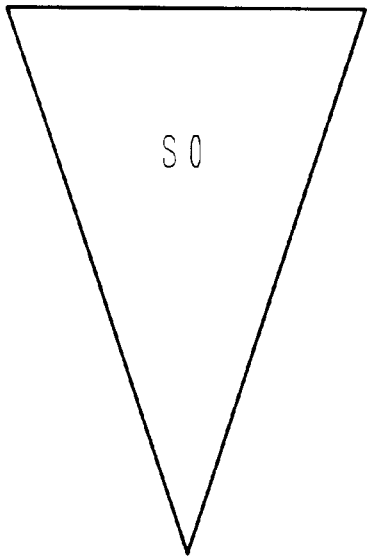
FIGS. 49A and 49B illustrate a third definition of an emitter, using cross sectional area as a parameter.
Figure 49B:
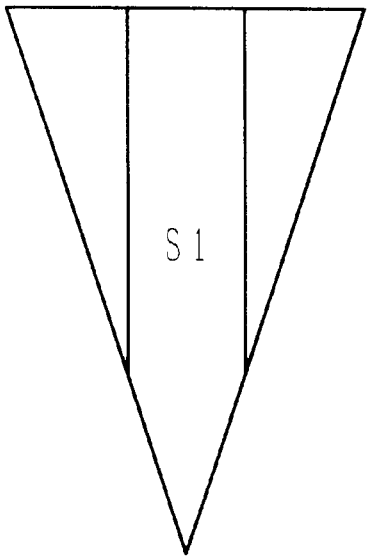

FIGS. 49A and 49B illustrate the third definition of a multi-stage (two-stage) type emitter, using height as a parameter.

FIG. 49A shows the shape of an one-stage type emitter. The one-stage type emitter is defined by an one-stage straight line, and has a cross sectional area of S0.

FIG. 49B shows the shape of a multi-stage (two-stage) type emitter. The multi-stage (two-stage) type emitter is defined by two two-stage straight lines having different slopes, and has a cross sectional area of S1. The first stage straight lines are parallel. If the second stage straight line of the two two-stage straight lines is used for forming an one-stage type emitter, this emitter has a cross sectional area of S0 same as the emitter shown in FIG. 49A.

The two-stage type emitter can be defined by the same formulas (8) to (10) represented by the cross sectional areas S1 and S0.

Figure 50:
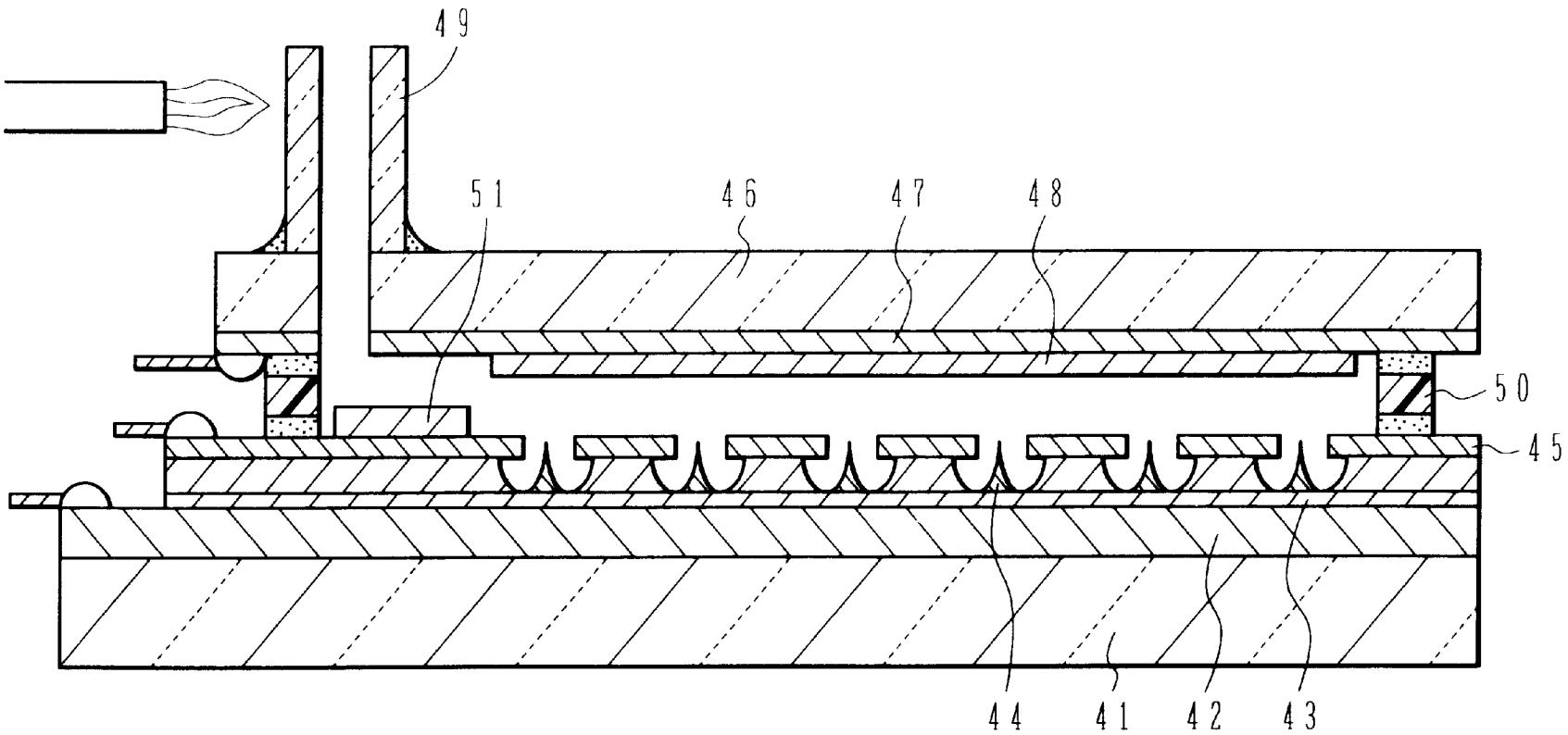
FIG. 50 is a cross sectional view of a flat panel display using field emission elements.

FIG. 50 is a cross sectional view of a flat panel display using field emission elements.

Each field emission element used is an emitter electrode or a two-electrode element formed by one of the manufacture methods of the first to eighth embodiments. On a support substrate 41 made of insulating material, a wiring layer 42 made of Al, Cu, or the like and a resistor layer 43 made of polysilicon or the like are formed. On the resistor layer 43, a number of emitter electrodes having a small apex angle and radius of curvature of the emitter tip are disposed to form a field emitter array (FEA). Each gate electrode 45 has an opening (gate hole) near at the tip of each emitter electrode 44 and a voltage can be applied independently to each gate electrode. A plurality of emitter electrodes can also be independently applied with a voltage.

Facing an electron source including the emitter electrode 44 and gate electrode 45, an opposing substrate is disposed including a transparent substrate 46 made of glass, quartz, or the like. The opposing substrate has a transparent electrode (anode electrode) 47 made of ITO or the like disposed under the transparent electrode 46 and a fluorescent member 48 disposed under the transparent electrode 47.

The electron source and opposing substrate are joined together via a spacer 50 made of a glass substrate and coated with adhesive, with the distance between the transparent electrode 47 and emitter electrode 44 being maintained about 0.1 to 5 mm. The adhesive may be low melting point glass.

Instead of the spacer 50 of a glass substrate, a spacer 50 made of adhesive such as epoxy resin with glass beads being dispersed therein may be used.

A getter member 51 is made of Ti, Al, Mg, or the like and prevents emitted gas from attaching again to the surface of the emitter electrode 44.

An air exhaust pipe 49 is coupled to the opposing substrate. By using this air exhaust pipe 49, the inside of the flat display panel is evacuated to about $10^{-5}$ to $10^{-9}$ Torr, and then the air exhaust pipe 49 is sealed by using a burner or the like. Thereafter, the anode electrode (transparent electrode) 47, emitter electrode 44, gate electrode 45 are wired to complete the flat panel display.

Figure 51:
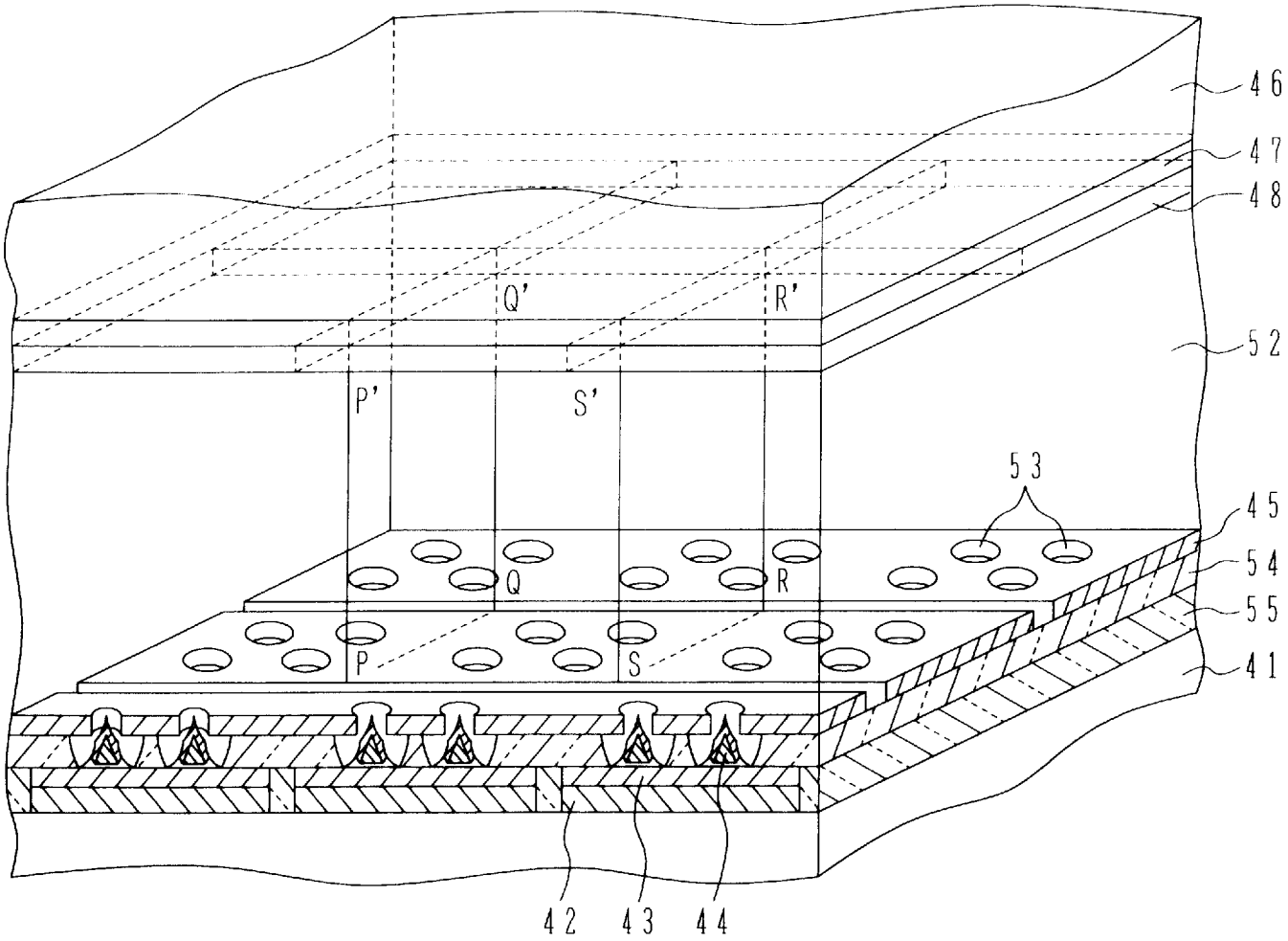
FIG. 51 is a perspective view partially in cross section of a flat panel display.

FIG. 51 is a perspective view of a flat panel display. A gate electrode 45 has a number of gate holes 53. An emitter electrode 44 is formed in one-to-one correspondence with each gate hole 53. Each emitter electrode is partitioned by an insulating film 54. Electrons emitted from the emitter electrode 44 pass through a vacuum hollow space 52 and collide with a fluorescent member 48 to radiate light therefrom.

The flat panel display is constituted of a plurality of pixels. Each pixel is constituted of a region PQRS made of four emitter electrodes 44 and a corresponding region P'Q'R'S' of the opposing substrate.

A resistor layer 43 and a wiring layer 42 formed under the emitter electrodes 44 are partitioned by a planarizing film (insulating film) 55 in unit of pixel (four emitter electrodes).

Figure 52:
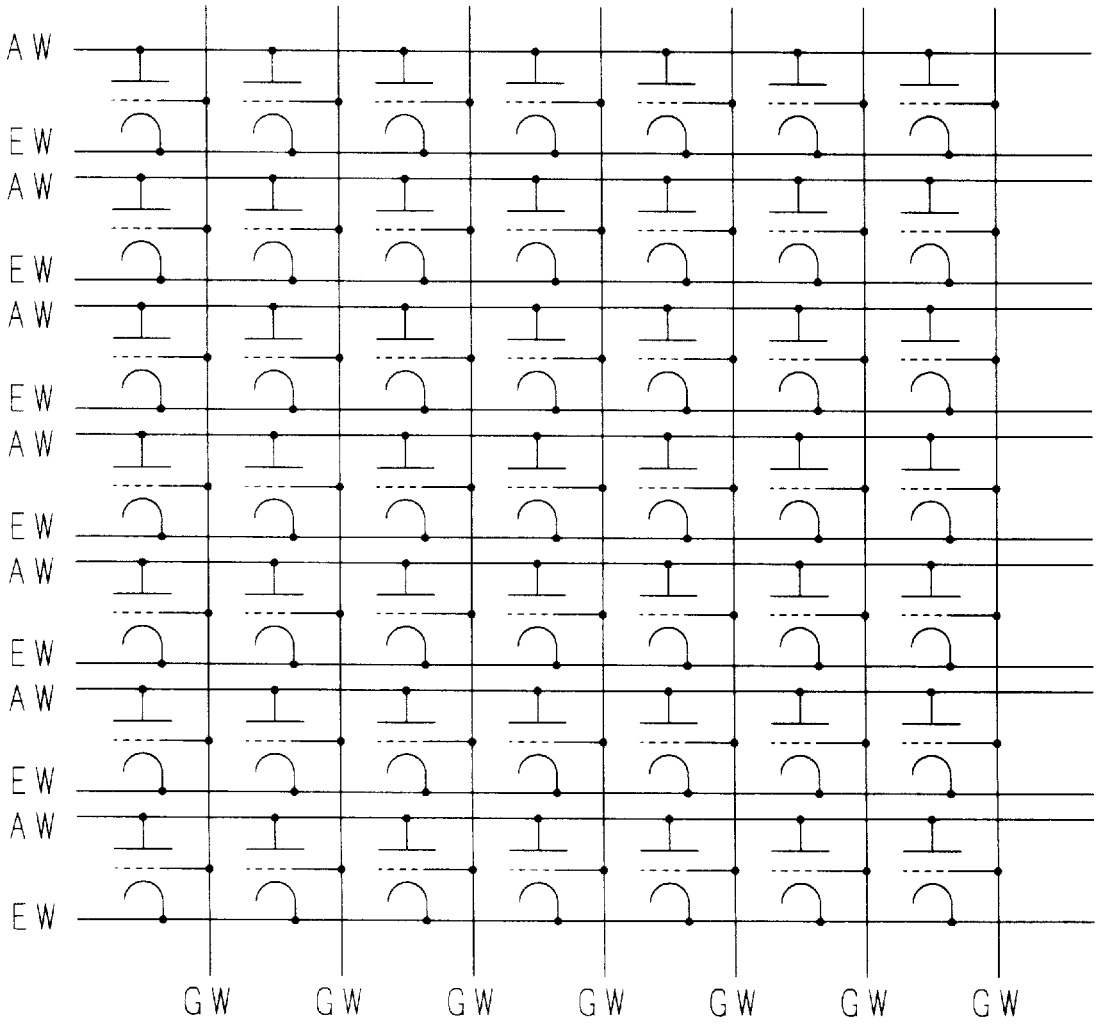
FIG. 52 is a circuit diagram of a flat panel display.
Figure 53A:
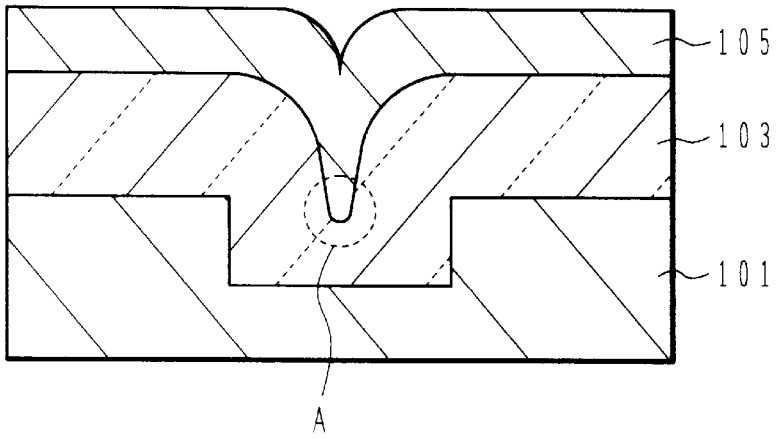
FIG.53A PRIOR ART
FIGS. 53A and 53B are cross sectional views of conventional field emission elements.
Figure 53B:
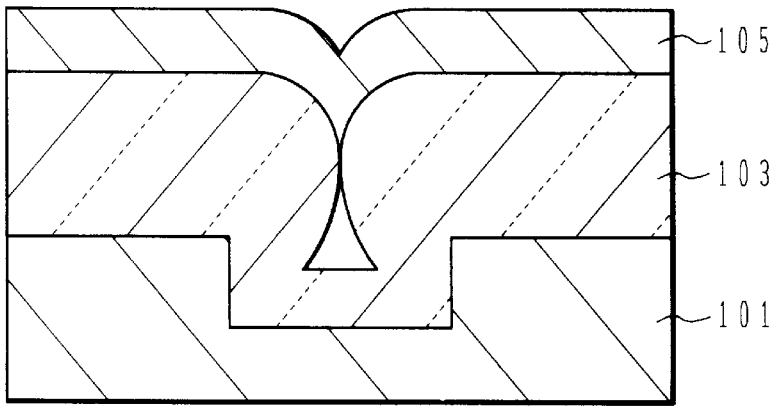
FIG.53B PRIOR ART

FIG. 52 is an equivalent circuit diagram of a flat panel display which is made of a field emitter array (FEA) having a number of triodes.

A number of triodes are disposed at cross points between two-dimensionally patterned emitter wirings EW and gate wirings GW. The anode wiring AW of an anode electrode (transparent substrate) 47 of each triode is always maintained at a positive potential. The triodes are two-dimensionally disposed by the emitter wirings EW and gate wirings GW, and the triode at the cross point of the voltage-applied emitter wiring EW and gate wiring GW is selected.

The emitter electrode and gate electrode of the selected triode are applied with negative and positive potentials, respectively, so that electrons are emitted from the emitter electrode to the anode electrode.

In the first to eighth embodiments, the volume expansion is conducted by a chemical reaction to locally expand the overhand portion. A mold of a desired shape for the one-stage or multi-stage (two-stage) type emitter can be therefore formed. By using the cusp portion as the mold, an emitter electrode having a small apex angle and radius of curvature of the emitter tip can be formed.

Further, through the volume expansion of a sacrificial film by chemical reaction, the relative position of the emitter electrode and gate electrode can be determined precisely. Furthermore, the distance (gate diameter) of the two parts of the gate electrode can be shortened by forming the gate electrode on the overhang portion of the lamination film 10*c*. Therefore, the control voltage to be applied to the gate electrode can be lowered and the performance of the field emission element can be improved.

The present invention has been described in connection with the preferred embodiments. The invention is not limited only to the above embodiments. It is apparent that various modifications, improvements, combinations, and the like can be made by those skilled in the art.

I claim:

1. A method of manufacturing a field emission element, comprising:

(a) forming an overhang portion on a substrate, the overhang portion having a cross section with two confronting parts;

(b) depositing a first sacrificial film on the overhang portion with the two parts, the first sacrificial film being made of material capable of chemical reaction, having a cross section with two parts, and having a curved surface continuous from above the overhang portion to below the overhang portion;

(c) depositing a reaction control film on the first sacrificial film thicker at an upper area of the first sacrificial film with the two parts than at a lower area of the first sacrificial film, the reaction control film having a cross section with two parts and controlling to decelerate chemical reaction of the first sacrificial film;

(d) chemically reacting the first sacrificial film having the reaction control film to expand the volume of a lower region of the first sacrificial film more than an upper region thereof so as to make the two parts of the overhang portion contact each other;

(e) depositing a field emission cathode film on the contacted area of the two parts; and (f) exposing a tip of the field emission cathode film.

2. A method according to claim 1, wherein said step (c) deposits a reaction control film made of an oxide film, and said step (d) is an oxidizing step.

3. A method according to claim 1, wherein said step (c) deposits a reaction control film made of a nitride film, and said step (d) is a nitrizing step.

4. A method according to claim 1, wherein said step (c) deposits a reaction control film made of a nitride film, and said step (d) is an oxidizing step.

5. A method according to claim 1, wherein said step (c) deposits a reaction control film made of an oxynitride film, and said step (d) is an oxidizing step.

6. A method according to claim 1, further comprising the step of:

(c-1) after said step (c), depositing a second sacrificial film covering the chemical reaction control film.

7. A method according to claim 1, further comprising the step of:

(b-1) after said step (b), depositing a second sacrificial film on the surface of the first sacrificial film, wherein said reaction control film depositing step is a step of depositing a reaction control film on the second sacrificial film.

8. A method according to claim 1, wherein said step (b) includes the step of:

(b-1) isotropically etching the reaction control film after the reaction control film is deposited thicker above the first sacrificial film than below the first sacrificial film.

9. A method according to claim 1, wherein:

the first sacrificial film is made of semiconductor or conductive material;

said step (d) chemically reacts only part of the first sacrificial film;

the field emission cathode film is a field emission cathode made of conductive material; and said step (f) exposes a tip of the field emission cathode and an edge of an unreacted region of the first sacrificial film, the field emission element having a two-electrode structure.

10. A method according to claim 1, wherein:

the substrate is made of semiconductor or conductive material;

the first sacrificial film is made of semiconductor or conductive material;

said step (d) chemically reacts only part of the first sacrificial film;

the field emission cathode film is made of conductive material; and said step (f) exposes a tip of the field emission cathode, an end of an unreacted region of the first sacrificial film, and a partial upper surface of the substrate, the field emission element having a three-electrode structure.

11. A method according to claim 1, further comprising the step of:

supporting the field emission cathode film with a support substrate.

12. A method of manufacturing a field emission element, comprising:

(a) forming an overhang portion on a substrate, the overhang portion having a cross section with two confronting parts;

(b) depositing a first sacrificial film on the overhang portion with the two parts, the first sacrificial film being made of material capable of chemical reaction, having a cross section with two parts, and having a curved surface continuous from above the overhang portion to below the overhang portion;

(c) depositing a reaction control film on the first sacrificial film thicker at an upper area of the first sacrificial film with the two parts than at a lower area of the first sacrificial film, the reaction control film having a cross section with two parts and controlling to decelerate chemical reaction of the first sacrificial film;

(d) reacting the first sacrificial film having the reaction control film to expand the volume of a lower region of the first sacrificial film more than an upper region thereof;

(e) depositing an insulating film on the overhang portion with the two parts and making the two parts of the overhang portion contact each other via the insulating film;

(f) depositing a field emission cathode film on the contacted area of the two parts; and (g) exposing step of exposing a tip of the field emission cathode film.

13. A method of manufacturing a field emission element, comprising:

(a) forming an overhang portion on a substrate, the overhang portion having a cross section with two confronting parts;

(b) depositing step of depositing a first sacrificial film on the overhang portion with the two parts, the first sacrificial film having a cross section with two parts;

(c) forming two parts of a diffusion region at the lower portion of the first sacrificial film with the two parts;

(d) chemically reacting the first sacrificial film with the two parts so as to make the two parts of the diffusion region contact each other;

(e) depositing a field emission cathode film on the contacted area of the diffusion region; and (f) exposing a tip of the field emission cathode film.

14. A method according to claim 13, wherein said step (c) includes the step of:

(c-1) depositing a second sacrificial film on the first sacrificial film with the two parts at an area other than the lower area of the first sacrificial film or thin at the lower area of the first sacrificial film.

15. A method according to claim 13, wherein:

said step (d) chemically reacts only part of the first sacrificial film, a chemically unreacted region of the first sacrificial film being a gate electrode made of semiconductor or conductive material;

the field emission cathode film is an emitter electrode made of conductive material; and said step (f) exposes a tip of the emitter electrode and an end of the gate electrode, the field emission element having a two-electrode structure.

16. A method according to claim 13, wherein:

said step (d) chemically reacts only part of the first sacrificial film, a chemically unreacted region of the first sacrificial film being a gate electrode made of semiconductor or conductive material;

the field emission cathode film is an emitter electrode made of semiconductor or conductive material;

the substrate is an anode electrode made of semiconductor or conductive material; and said step (f) exposes a tip of the emitter electrode, an end of the gate electrode, and the anode electrode, the field emission element having a three-electrode structure.

17. A method according to claim 13, further comprising the step of:

supporting the field emission cathode film with a support substrate.

18. A method according to claim 14, wherein said step (c) includes the step of:

(c-1) isotropically etching the second sacrificial film, and thereafter diffusing impurity into the first sacrificial film.

19. A method according to claim 14, wherein said step (c) includes the step of:

(c-1) diffusing impurity into the first sacrificial film after the second sacrificial film is deposited, and thereafter isotropically etching the second sacrificial film.

20. A method of manufacturing a field emission element, comprising:

(a) forming an overhang portion on a substrate, the overhang portion having a cross section with confronting two parts;

(b) depositing a first sacrificial film on the overhang portion with the two parts, the first sacrificial film having a cross section with two parts;

(c) depositing a second sacrificial film on the first sacrificial film at an area other than a lower area of the first sacrificial film, or thick at an upper area and thin at the lower area, the second sacrificial film having a reaction speed lower than the first sacrificial film and having a cross section with two parts;

(d) chemically reacting the first and second sacrificial films so as to make the two parts of the first and second sacrificial films contact each other;

(e) depositing a field emission cathode film on the contacted area of the two parts; and (f) exposing a tip of the field emission cathode film.

21. A method according to claim 20, wherein said step (c) includes the step of:

(c-1) isotropically etching the second sacrificial film after the second sacrificial film is deposited.

22. A method according to claim 20, wherein:

said step (d) chemically reacts only part of the first sacrificial film, a chemically unreacted region of the first sacrificial film being a gate electrode made of semiconductor or conductive material;

the field emission cathode film is an emitter electrode made of conductive material; and said step (f) exposes a tip of the emitter electrode and an end of the gate electrode, the field emission element having a two-electrode structure.

23. A method according to claim 20, wherein:

said step (d) chemically reacts only part of the first sacrificial film, a chemically unreacted region of the first sacrificial film being a gate electrode made of semiconductor or conductive material;

the field emission cathode film is an emitter electrode made of semiconductor or conductive material;

the substrate is an anode electrode made of semiconductor or conductive material; and said step (f) exposes a tip of the emitter electrode, an end of the gate electrode, and the anode electrode, the field emission element having a three-electrode structure.

24. A method according to claim 20, further comprising the step of:

supporting the field emission cathode film with a support substrate.

* * * * *